US010092067B2

(12) United States Patent
Van Varick et al.

(10) Patent No.: US 10,092,067 B2
(45) Date of Patent: Oct. 9, 2018

(54) WALKING STICK

(71) Applicant: Michael Graves Design Group, Inc., Princeton, NJ (US)

(72) Inventors: Robert B. Van Varick, Princeton, NJ (US); Donald S. Strum, Princeton, NJ (US); Michael E. Graves, Princeton, NJ (US); William R. Parcells, Princeton, NJ (US); Jennifer A. Tuetken, Princeton, NJ (US); Vladimir Anokhin, Princeton, NJ (US); Daniel C. Sosa, Princeton, NJ (US); Michael A. Daley, Neenah, WI (US); Bryan J. Semkuley, Roswell, GA (US); Clarice M. Theisen, Roswell, GA (US); Lynn R. Healey, Neenah, WI (US); Elizabeth W. Clubb, Atlanta, GA (US); Richmond A. Hornby, Milford, CT (US); Adam I. Lehman, Milford, CT (US); Leland R. Adams, Milford, CT (US); Jeffrey Randsen, Milford, CT (US)

(73) Assignee: Michael Graves Design Group, Inc., Princeton, NJ (US)

( * ) Notice: Subject to any disclaimer, the term of this patent is extended or adjusted under 35 U.S.C. 154(b) by 0 days.

(21) Appl. No.: 15/519,226

(22) PCT Filed: Oct. 15, 2015

(86) PCT No.: PCT/US2015/055760

§ 371 (c)(1),
(2) Date: Apr. 14, 2017

(87) PCT Pub. No.: WO2016/061364

PCT Pub. Date: Apr. 21, 2016

(65) Prior Publication Data

US 2017/0224072 A1 Aug. 10, 2017

Related U.S. Application Data

(60) Provisional application No. 62/064,345, filed on Oct. 15, 2014.

(51) Int. Cl.
*A45B 9/02* (2006.01)
*A45B 9/04* (2006.01)
(Continued)

(52) U.S. Cl.
CPC ..... *A45B 9/02* (2013.01); *A45B 1/04* (2013.01); *A45B 9/04* (2013.01); *A45B 2009/007* (2013.01)

(58) Field of Classification Search
CPC .... A45B 1/04; A45B 9/02; A45B 9/04; A45B 2009/007
(Continued)

(56) References Cited

U.S. PATENT DOCUMENTS 1,621,255 A * 3/1927 Hunter ..... A61H 3/0288 135/68
3,712,652 A * 1/1973 Uilkema ..... A63C 11/22 248/188.5
(Continued)

FOREIGN PATENT DOCUMENTS

WO 93/15626 8/1993

OTHER PUBLICATIONS

PCT International Search Report and Written Opinion, PCT Application No. PCT/US2015/055760, dated Jan. 22, 2016.

*Primary Examiner* — Noah Chandler Hawk
(74) *Attorney, Agent, or Firm* — Kilpatrick Townsend & Stockton LLP

(57) ABSTRACT

A walking stick can include a handle (50) including a head (52). The head (52) can include at least one internal reinforcement member (90). The at least one internal reinforcement member (90) can have a shape that is substantially the same as a shape of the head (52). The bathing wand can include a neck (54) and a shaft (20). The bathing wand can also include a foot (150, 180) for engaging the ground. The foot (150, 180) can be coupled to the shaft (20). In some
(Continued)

aspects, the foot (180) can include at least two arms (186) extending from a top portion (190) towards a bottom portion (194) of the foot (180). Each of the at least two arms (186) can be coupled together through a base (188) of the of the bottom portion (194). In some aspects, at least one arm (186) can form a loop (193).

20 Claims, 51 Drawing Sheets

(51) Int. Cl.
*A45B 1/04* (2006.01)
*A45B 9/00* (2006.01)

(58) Field of Classification Search
USPC ..... 135/72, 76, 77, 78
See application file for complete search history.

(56) References Cited

U.S. PATENT DOCUMENTS 4,528,998 A 7/1985 Gamm et al.
4,730,632 A 3/1988 Mace et al.
5,139,283 A * 8/1992 Dow ..... A63C 11/221 135/72
5,197,501 A * 3/1993 Ragatz ..... A45B 3/00 135/66
5,301,704 A * 4/1994 Brown ..... A45B 9/04 135/78
5,387,048 A * 2/1995 Kuo ..... A45B 19/04 135/25.1
5,392,801 A * 2/1995 Hannoosh ..... A45B 3/00 135/65
6,079,894 A * 6/2000 Obitts ..... A61H 3/02 135/75
7,958,902 B2 * 6/2011 Ruddy ..... A45B 9/04 135/65
7,984,723 B2 * 7/2011 Seivert ..... A45B 1/00 135/65
8,851,094 B2 * 10/2014 Kuma ..... A45B 9/04 135/75
2005/0210627 A1 9/2005 Luebbering et al.
2008/0169011 A1 7/2008 Ewell et al.
2009/0159106 A1 * 6/2009 Schulz ..... A45B 9/02 135/75
2010/0313925 A1 12/2010 Jiang et al.
2011/0271990 A1 11/2011 Diamond et al.

* cited by examiner

WALKING STICK

This application is a National Phase application of International Application No. PCT/US2015/055760, filed Oct. 15, 2015, which claims priority to U.S. Application No. 62/064,345, filed Oct. 15, 2014, which is incorporated herein by reference in its entirety.

TECHNICAL FIELD

The present disclosure relates to an apparatus to facilitate walking. More particularly, the present disclosure relates to a walking stick that includes a plurality of interchangeable parts such as handles, shafts, and feet.

BACKGROUND OF THE DISCLOSURE

Walking sticks are widely used ambulatory aids. Most conventional walking sticks include an elongated shaft (A) with a ground engaging foot (C) at one end, and a handle for grasping (B) at an opposite end. See, FIG. 1, prior art. Conventional walking sticks may have numerous drawbacks.

For example, words to describe the aesthetics of conventional walking sticks include "clinical" or "medical." This is because the aesthetics of such apparatuses are often very poor, with many products looking as though they are heavily mass-produced versus being customized for the individual consumer's needs. This creates possible stigma for the user, in his or her mind and possibly the minds of others.

Though there are some decorative walking sticks available, e.g. painted with floral patterns, colors, and stripe patterns, they tend to have the same appearance as their mass-produced counterparts with prints or patterns introduced as an afterthought. The foot is most often colored black or a dull neutral color, which lends to the appearance that the product is for use in a clinical setting and not the everyday world. Therefore, even the decorative walking sticks that are available are merely manufactured for the generic consumer, and not designed for the individual consumer and their lifestyle.

Some walking sticks include height adjustment mechanisms. While the height adjustment mechanism of conventional sticks allows for efficiencies in mass production, such mechanisms negatively impact the aesthetics and function of the walking stick. A visible row of holes in the stick shaft can make the walking stick look utilitarian and mass produced. If a user wants a custom stick with no holes, they must accurately size the stick when purchasing. If done incorrectly, they can suffer pain or discomfort over extended use. It also does not allow the user to adjust the height of the stick depending on footwear, which can change the user's height by an inch or more.

The users of walking sticks often suffer from multiple conditions, arthritis being one of the most common. Handles and feet are not quickly or easily replaced by someone with limited strength or dexterity. For instance, metal spring-loaded pins commonly-used for height-adjustment are sometimes small and sometimes painful to press. During adjustment the telescoping tube sections are prone to twisting, and locating the pin to the appropriate hole becomes difficult and time-consuming. Height adjustment pins that are external to the pole can be dropped or lost when removed. This is problematic for users who may have difficulty bending over to retrieve it, or may have reduced vision and would be unable to find it once dropped. In addition, commonly available adjustable-height walking sticks are often loosely assembled at the height adjustment mechanism, causing them to rattle or click when in use. This creates a nuisance for the user and others around them. It also draws unwanted attention to the user.

Walking stick feet are typically small and make poor contact with the ground when they strike the ground at an angle while the user is walking. While stick feet are made of flexible materials like rubber, they do not adequately compress to conform to the walking surface. The design of conventional feet does not allow adequate traction when striking the ground at such angles, hence raising the possibility for the stick to slip. Many stick tips are not well designed to distribute the dynamic forces created between the stick and the ground surface.

Another drawback to traditional walking sticks is that they are not adapted to be self-standing when not in use, requiring the user to prop it against a wall or the like, or to lay it on the ground. Both ways of storing the stick pose potential trip hazards for people walking past the area. Further, once a walking stick is lying on the ground, it may be difficult if not impossible for the user to retrieve it. Although some walking sticks have been provided with feet having three or four tips extending therefrom, they are often unsightly and cumbersome to use.

No users hand is the same, requiring different handles for different users. As users age, their hands and needs also change. The user is forced to purchase an entirely new walking stick, or as is more common, they continue to use an item that is no longer suitable for them.

Many conventional stick handles are made of solid wood or plastic. One possible problem with these handles is that they can break suddenly. Further, conventional stick handles often have poor ergonomics. Most sticks tend to have traditional hook shaped handles or simple rectilinear handles. Various handle shapes have been devised which attempt to address the ergonomics over traditional hook or rectilinear shapes. For example, some handles are covered with a foam substrate or have indentations for the fingers of an average-sized hand. However, such features do not provide much comfort especially if the user's hand is very large or very small. Because of the extremely pliable padding materials used on many stick handles, users must often choose between comfort and control/proprioception.

Accordingly, there exists a need for an improved walking stick. An improved walking stick can be convenient and easy to use while being stylish, providing assistance to the user while instilling confidence. For example, an improved walking stick may be aesthetically more pleasing. An improved walking stick may provide the consumer or user the ability to interchange components to meet the demands of a given environment or use. Further, an improved walking stick may better conform to the environment in which it is used.

SUMMARY OF THE DISCLOSURE

The present disclosure is directed to an improved walking stick. In one embodiment, a walking stick can include a handle including a head. The head can include at least one internal reinforcement member. The at least one internal reinforcement member can have a shape that is substantially the same as a shape of the head. The walking stick can also include a shaft. The walking stick can further include a foot for engaging the ground. The foot can be coupled to the shaft.

In another embodiment, a walking stick can include a handle that includes a head, a neck, and a height adjustment mechanism. The height adjustment mechanism can include a pin and a height aperture sized to receive the pin. The walking stick can further include a shaft. The shaft can include a plurality of height adjustment holes. The plurality of height adjustment holes can be sized to receive the pin of the height adjustment mechanism. The walking stick can further include a friction plug coupled to the shaft. The friction plug can longitudinally align the shaft with the handle such that a user can longitudinally move the shaft with respect to the handle and maintain rotational alignment between the height adjustment holes of the shaft and the height aperture of the handle. The walking stick can also include a foot for engaging the ground. The foot can be coupled to the shaft.

In yet another embodiment, a walking stick can include a handle that includes a head and a neck. The head and the neck can intersect at an intersection point. The head can include an upper portion and a lower portion in the configuration of a C-shape. The upper portion can have a first end and the lower portion can have a second end. The C-shape can be configured such that the second end of the lower portion is disposed laterally outward from the intersection point of the head and the neck of the handle. The walking stick can include a shaft. The walking stick can further include a foot for engaging the ground. The foot can be coupled to the shaft.

In still another embodiment, a walking stick can include a handle for providing a user with a position to grasp the walking stick. The walking stick can also include a shaft. The walking stick can additionally include a foot for engaging the ground. The foot can be coupled to the shaft. The foot can include a top portion and a bottom portion. The bottom portion can include a base. The foot can also include at least two arms extending from the top portion towards the bottom portion. Each of the at least two arms can be coupled together through the base.

In another embodiment, a walking stick can include a handle for providing a user with a position to grasp the walking stick. The walking stick can also include a shaft. The walking stick can additionally include a foot for engaging the ground. The foot can be coupled to the shaft. The foot can include a top portion and a bottom portion. The bottom portion can include a base. The foot can also include at least two arms extending from the top portion towards the bottom portion. At least one loop can be formed between the at least two arms and the base.

In still another embodiment, a walking stick can include a handle for providing a user with a position to grasp the walking stick. The walking stick can also include a shaft. The walking stick can also include a foot for engaging the ground. The foot can include a top portion, a main body portion, and a bottom portion. The top portion can include a socket for receiving to the shaft. The walking stick can also include a foot replacement mechanism. The foot replacement mechanism can include a depressible latch button and a spring. The spring can be disposed within the shaft and can engage the depressible latch button. The depressible latch button can extend through an aperture in the shaft. The foot replacement mechanism can also include a latch aperture in the main body portion of the foot for receiving the depressible latch button.

BRIEF DESCRIPTION OF DRAWINGS

Various embodiments of the present invention will be disclosed, by way of example, in reference to the following drawings in which.

Figure 1:
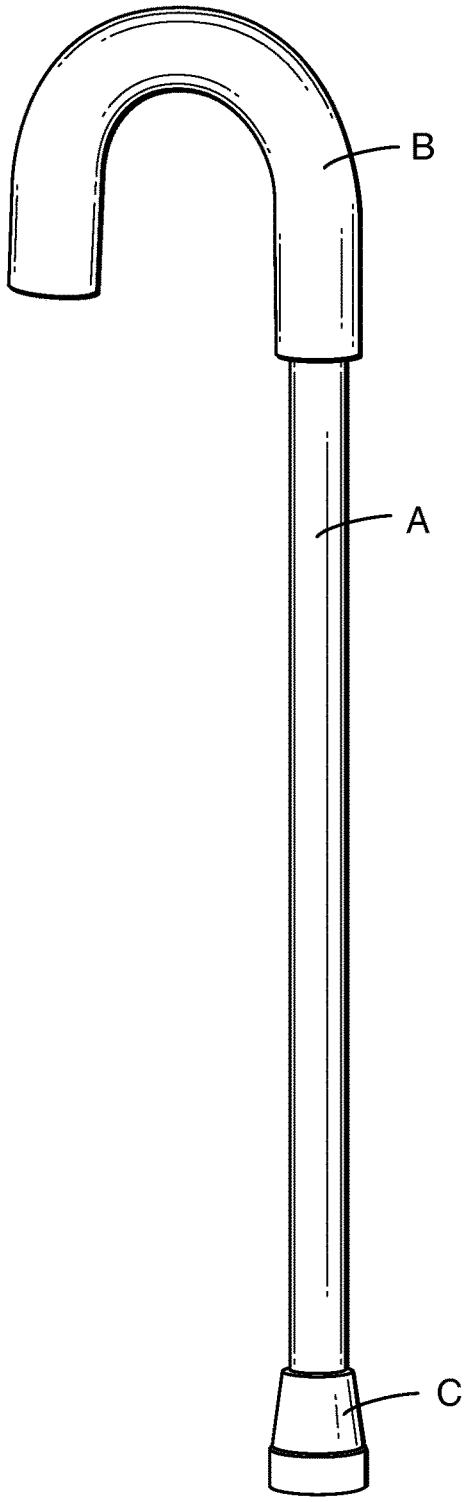
FIG. 1 PRIOR ART
FIG. 1 is a side elevational view of a conventional prior art stick.

Repeat use of reference characters in the present specification and drawings is intended to represent the same or analogous features or elements of the disclosure.

DETAILED DESCRIPTION OF THE DISCLOSURE

The present disclosure is a multi-functional, modifiable walking stick to assist an individual to walk in a variety of conditions. The walking stick generally has a shaft 20, a handle 50 and a foot 150, 180. The user can select from a variety of shafts 20, i.e. wood, painted wood, metal, painted metal, post processed metal, plastics, carbon fiber composites or laminates or other materials known in the art. The shaft 20 could be made from various other materials as described herein. The handle 50 is presented in various configurations that vary in form and function. The handle 50 of choice may be attached to the shaft 20 of choice. Finally, the foot 150, 180 is presented in various configurations that vary in form and function, and it too may be attached to the shaft 20 of choice. While various shafts 20, handles 50, and feet 150, 180 are disclosed herein, it is contemplated that one or more of these features can be substituted with other suitable shafts, handles, and/or feet.

Shaft

Figure 2:
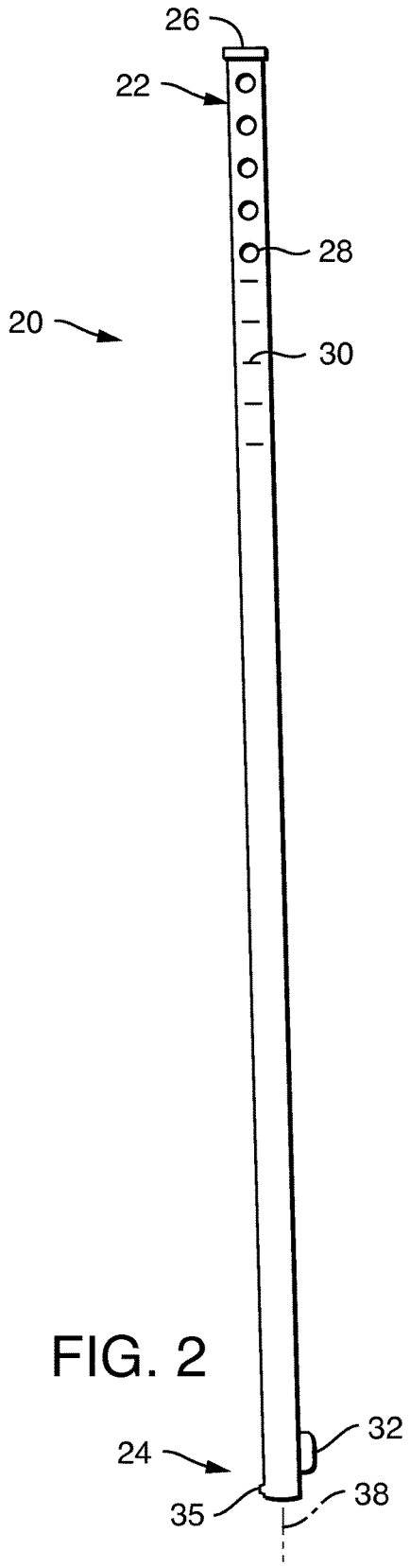
FIG. 2 is a side elevation of one shaft embodiment of the present disclosure.
Figure 3:
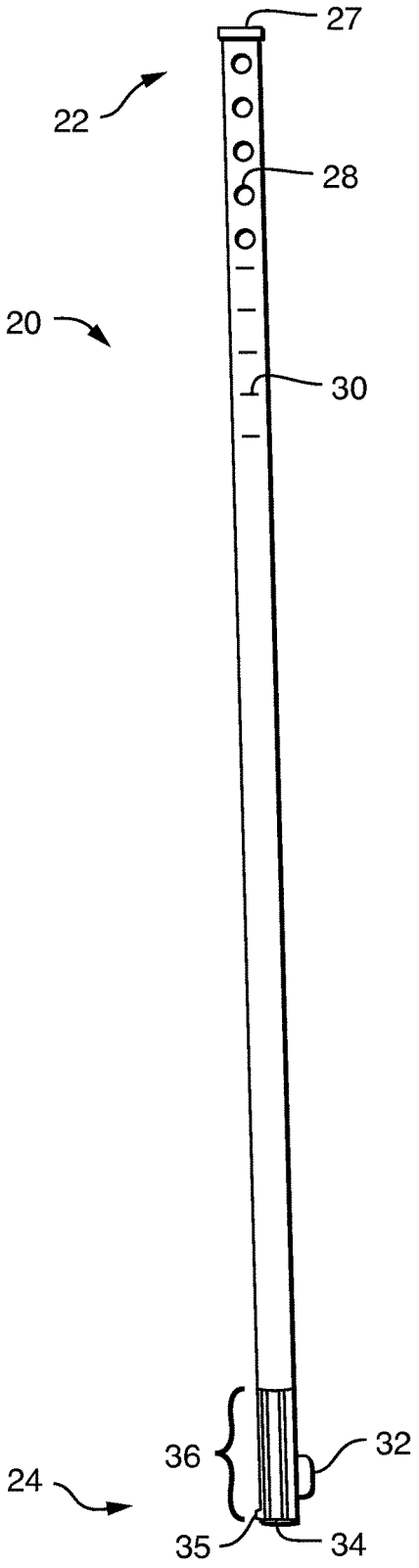
FIG. 3 is a side elevation of another shaft embodiment of the present disclosure.

Shown in FIGS. 2 and 3 are cylindrical shafts 20 according to the present disclosure (FIG. 2 shows a metal shaft, and FIG. 3, a wooden shaft). Each shaft 20 has a first end 22 and an opposite end 24.

Suitable metals that may be used to construct the shaft 20 include aluminum or an aluminum alloy such as AL6061 T6. Other metals may also be used that have high strength to weight ratios. Suitable woods that may be used to construct the shaft can include maple, at least FAS grade. Other woods such as oak, cherry, hickory or tropical woods may be suitable as long as they have a relatively uniform straight grain, substantially aligned with the shaft axis 38, and no defects such as knots. In another embodiment (not shown) the shaft 20 is plastic. Other suitable materials can include composite materials, including but not limited to carbon fiber composites, known to provide high strength to weight ratios.

The shafts 20 may vary aesthetically so that a user can own several shaft to interchange with the other walking stick components. For instance, the wooden shaft 20 may be stained in various colors and provided with a matte or glossy polyurethane finish. A metal shaft 20 may be anodized, painted or powder coated. For example, the metal shaft 20 may be painted or powder coated in any color imaginable. The paint or powder coating may be mottled, patterned or include various indicia. The metal may be anodized to have a warmer or cooler tint, e.g. nickel, bronze, copper, gold or the like. The metal surface may appear glossy, matte, satin or brushed. A plastic shaft 20 may be of any color or finish as well, and may have a pattern on the surface. Additionally, the shaft 20 may be made from a carbon fiber composite or carbon fiber laminate. This composite or laminate may be post processed to provide an aesthetically pleasing finish. Such post processes may include painting processes. Many aesthetic options are available, and these few examples are not meant to be limiting.

Figure 2A:
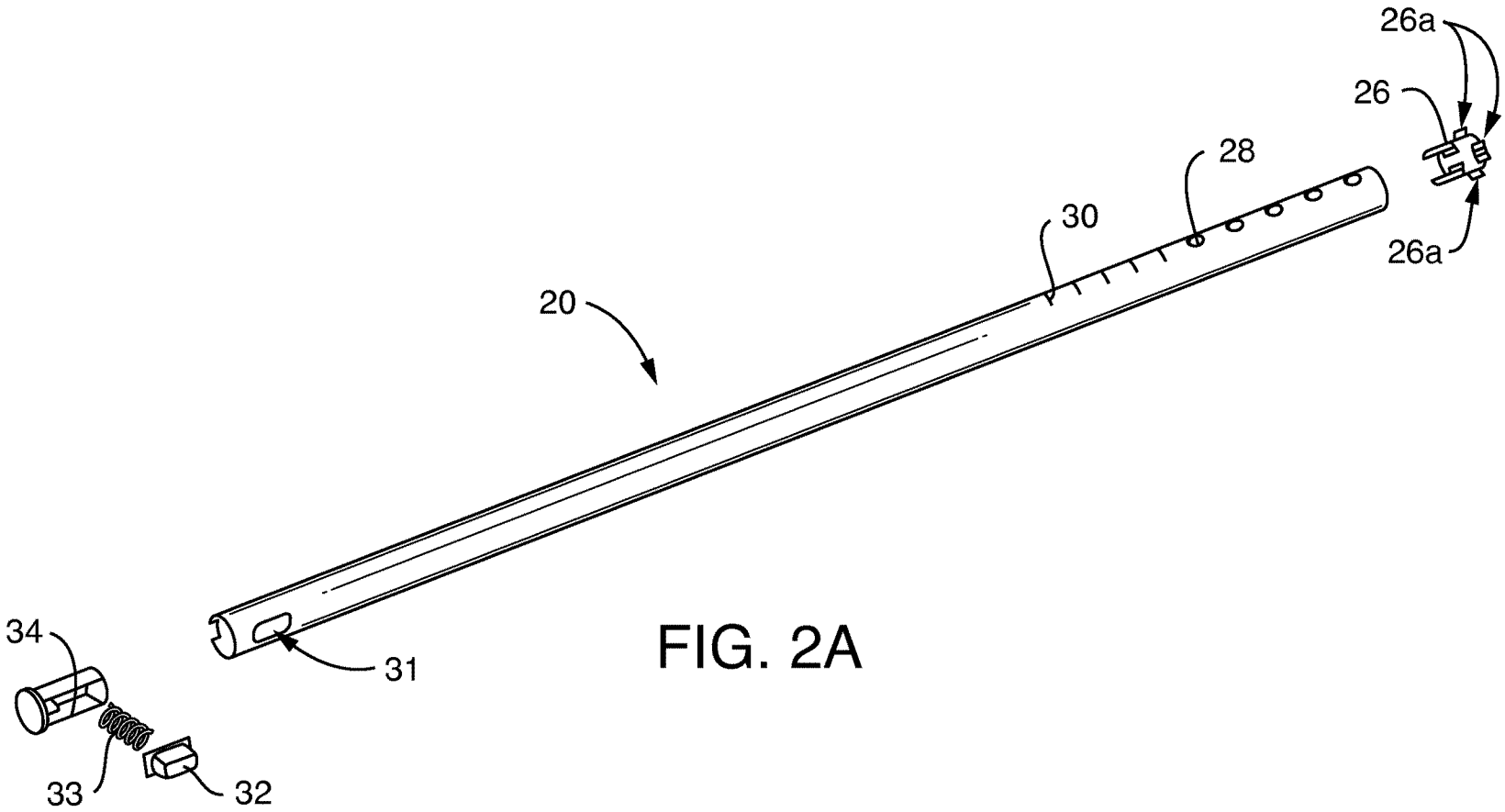
FIG. 2A is an exploded perspective view of a metal shaft of FIG. 2.

Referring to FIG. 2, located at the first end 22 is a friction plug 26. The friction plug 26 provides several functional benefits to the walking stick. First, it provides a friction-fit with the handle 50. Second, it reinforces the first end 22 so that it cannot deform if struck against another object. FIG. 2A shows the friction plug 26 in more detail. Third, the friction plug 26 also longitudinally aligns the shaft 20 with the handle 50, keeping the height adjustment holes 28 in the shaft 20 and the height aperture 49 in the handle 50 rotationally aligned so the user can adjust the height without the frustration of losing the location of the height adjustment holes 28. This will be discussed further below in relation to the height adjustment mechanism 62 of the walking stick. In one embodiment, the friction plug 26 keeps rotational alignment between the height adjustment holes 28 in the shaft 20 with the height aperture 49 in the handle 50 by having ribs 26*a* (labeled in FIG. 2A) keying into protruding ribs 54*a* (two labeled in FIG. 4A) on the inside surface of neck 54. The protruding ribs 54*a* can extend along a substantial length of the neck 54, or in some embodiments, along the entire length of neck 54. Of course, it is contemplated that the friction plug 26 can maintain rotational alignment between the height adjustment holes 28 in the shaft 20 with the height aperture 49 in the handle 50 by other means. Located along a common elongated axis 38 of shaft 20 is a series of height adjustment holes 28. The purpose of the height adjustment holes 28 will be more evident as the handle 50 operation is discussed, infra. The friction plug 26 also helps to reduce play or rattle in the walking stick by creating an aligned fit.

Referring to FIG. 3, located at the first end 22 is a friction element 27. Friction element 27 provides a friction fit with the handle 50, and can operate in the same way as friction plug 26 described above. Thus, friction element 27 can include ribs 27*a* that can key into protruding ribs 54*a* on the inside surface of neck 54 of the handle 50, as discussed above. The friction element 27 can be screwed into the first end 22 of the shaft 20 by screws.

Also located along the axis 38 of shaft 20 is a series of markers 30 which are shown as lines perpendicular to axis 38. However, they could be dots, dashes or any other indicia as desired. There can be a marker 30 corresponding to each height adjustment hole 28 in the shaft 20. Again, the purpose of the markers 30 will become more evident as the handle operation is discussed, infra.

Referring to FIGS. 2 and 2A, in some embodiments a support post 34 can be disposed in the opposite second end 24 of the shaft 20. Similar to the friction plug 26, part of the purpose of the support post 34 is to provide support for the opposite second end 24 so that it does not deform if struck by or against an object. However, another purpose of the support post 34 is to support the depressible latch button 32 and spring 33 as seen best in FIGS. 3B and 3C. In operation, depressing latch button 32 allows one to easily remove the interchangeable foot.

Figure 3A:
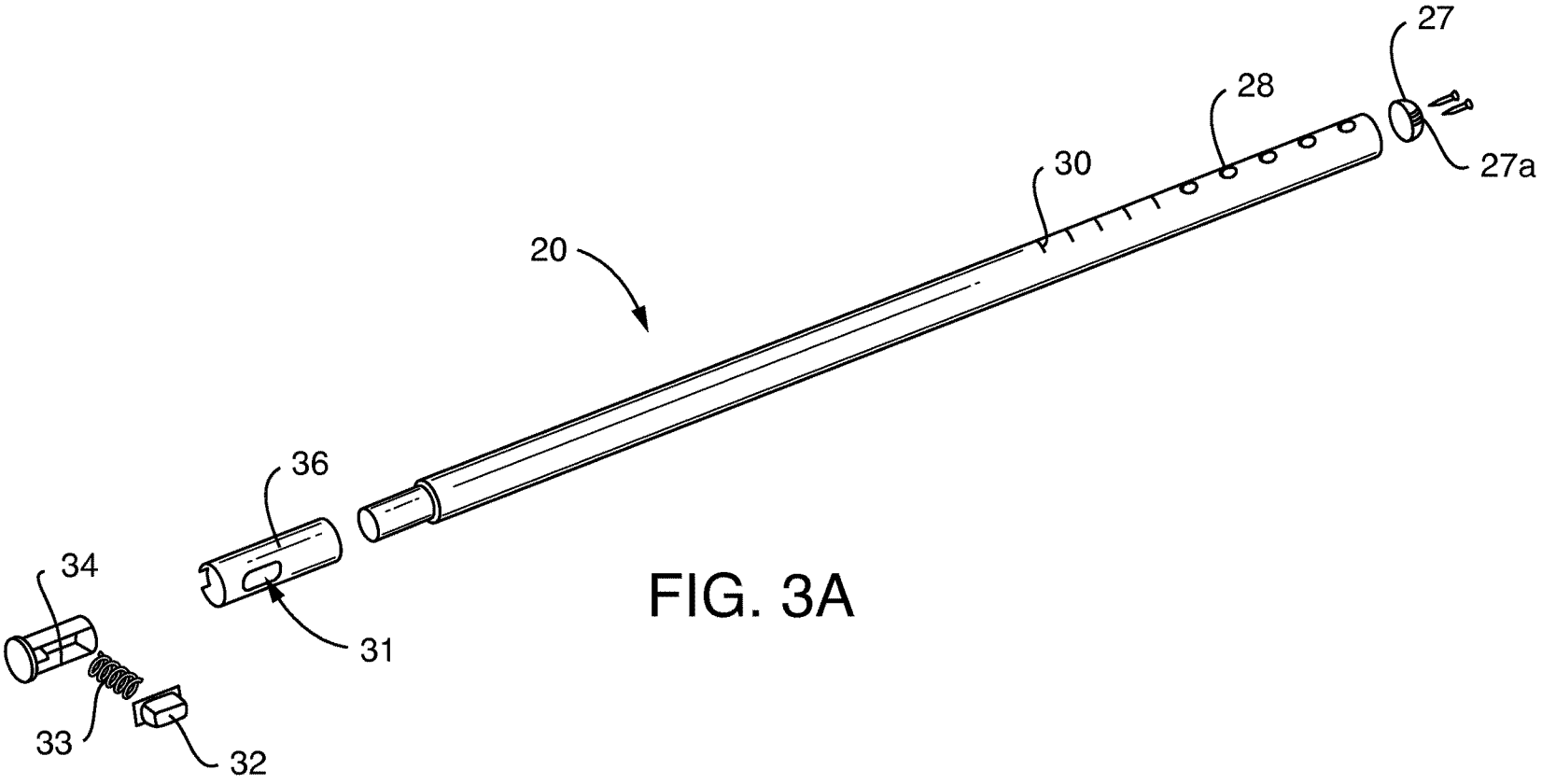
FIG. 3A is an exploded perspective view of the wooden shaft of FIG. 3.

Also shown in FIGS. 3 and 3A, at the opposite second end 24 of the shaft 24 there can be a sleeve 36. The sleeve 36 can be beneficial for embodiments where the shaft 20 is solid, such as in FIG. 3, where the shaft 20 can be made from wood. The sleeve 36 can be hollow and can include an aperture 31 for the depressible latch button 32.

The shafts 20 may be hollow inside or may be solid. In one embodiment, the shaft 20 can be hollow in the middle and can be produced from aluminum 6061 T6. In another embodiment, the shaft 20, such as shown in FIG. 3A, can be solid and can be made from maple or the like. This is particularly encouraging as this provides the consumer or user an adjustable wooden stick which may be sized by the user to meet their needs.

Interchangeable Handle

Figure 4:
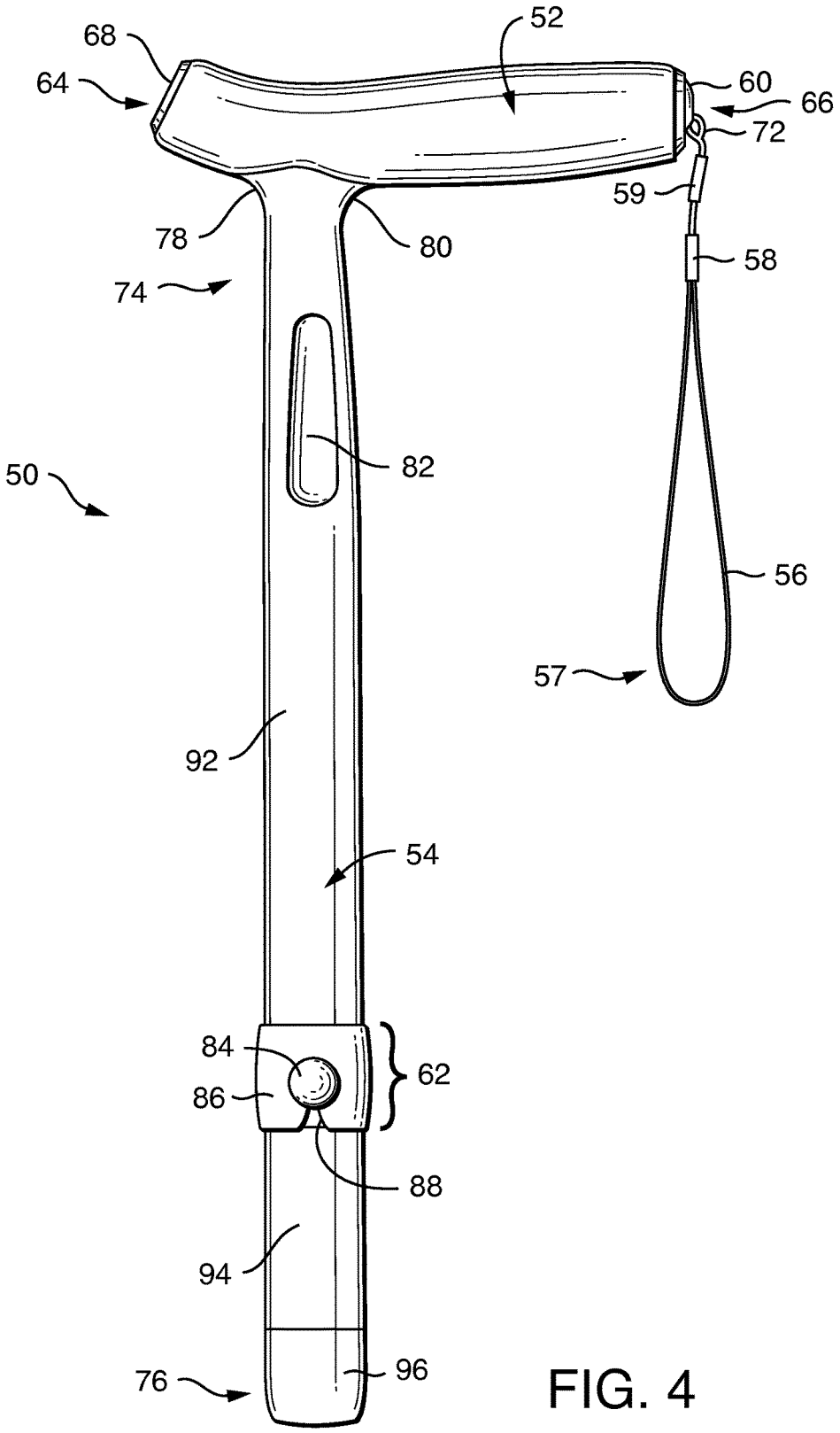
FIG. 4 is a side elevation of a first handle embodiment of the present disclosure.
Figure 5:
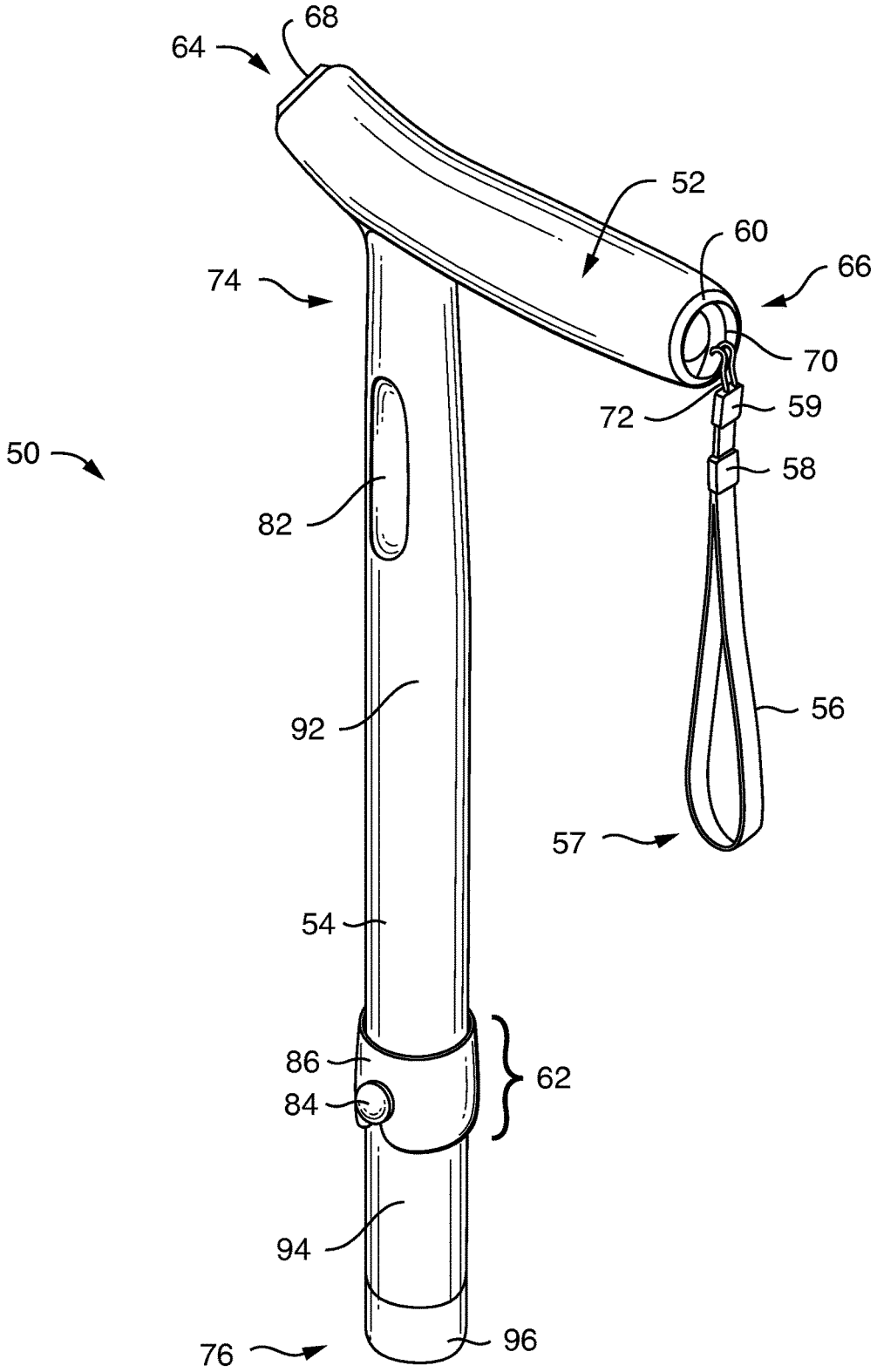
FIG. 5 is a top perspective view of the handle of FIG. 4.
Figure 6:
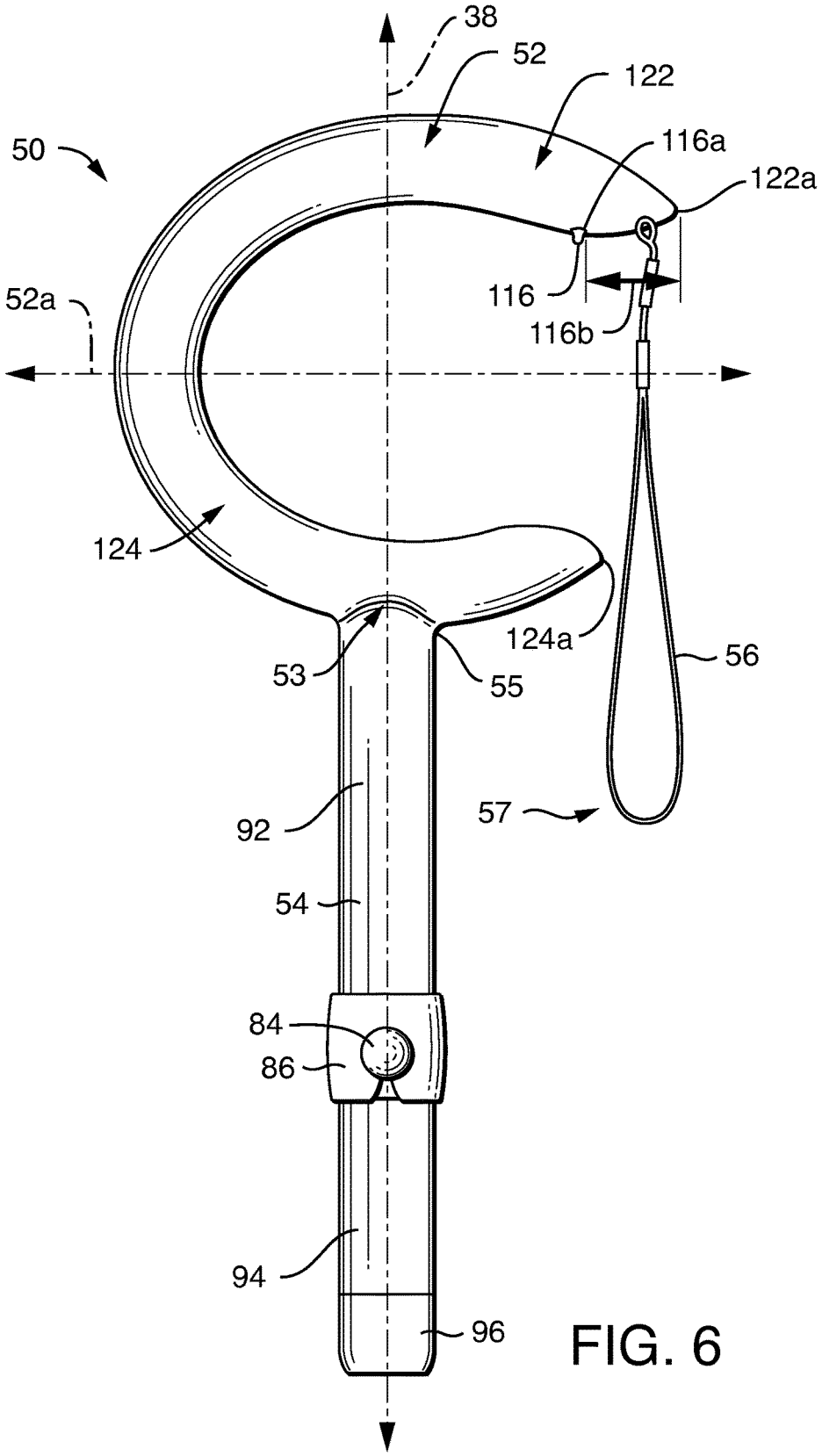
FIG. 6 is a side elevation of a second handle embodiment of the present disclosure.
Figure 7:
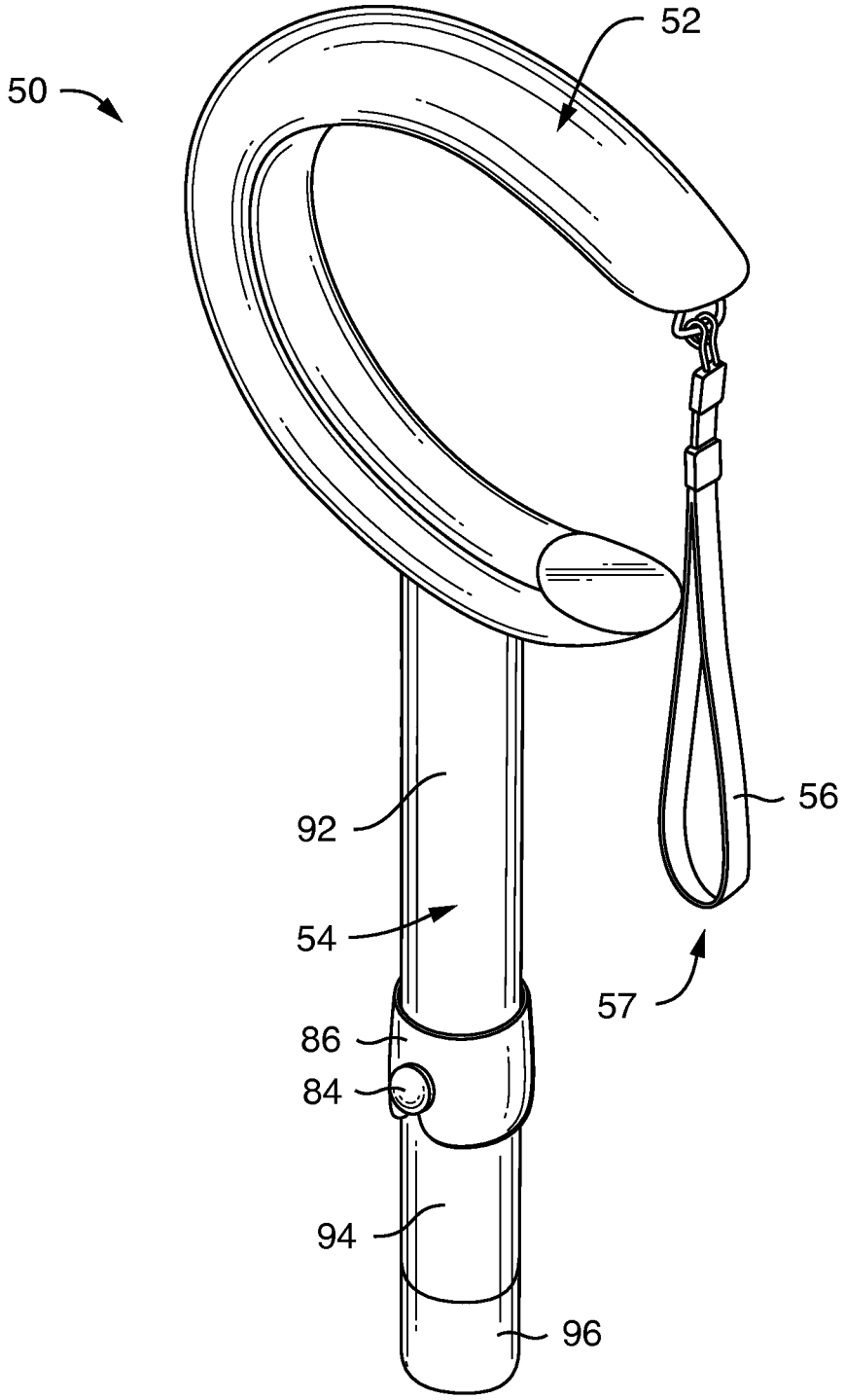
FIG. 7 is a top perspective view of the handle of FIG. 6.
Figure 8:
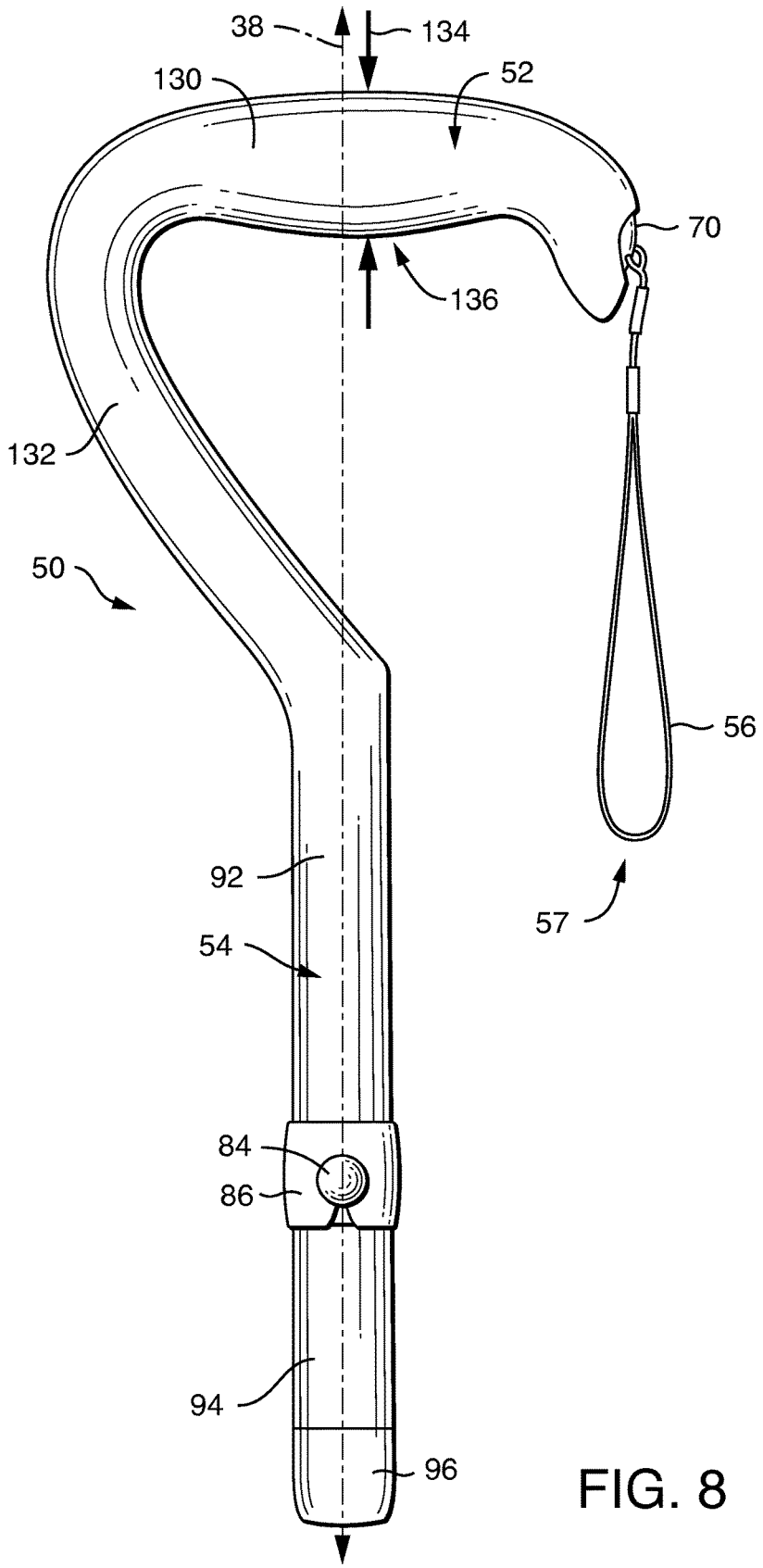
FIG. 8 is a side elevation of a third handle embodiment of the present disclosure.
Figure 9:
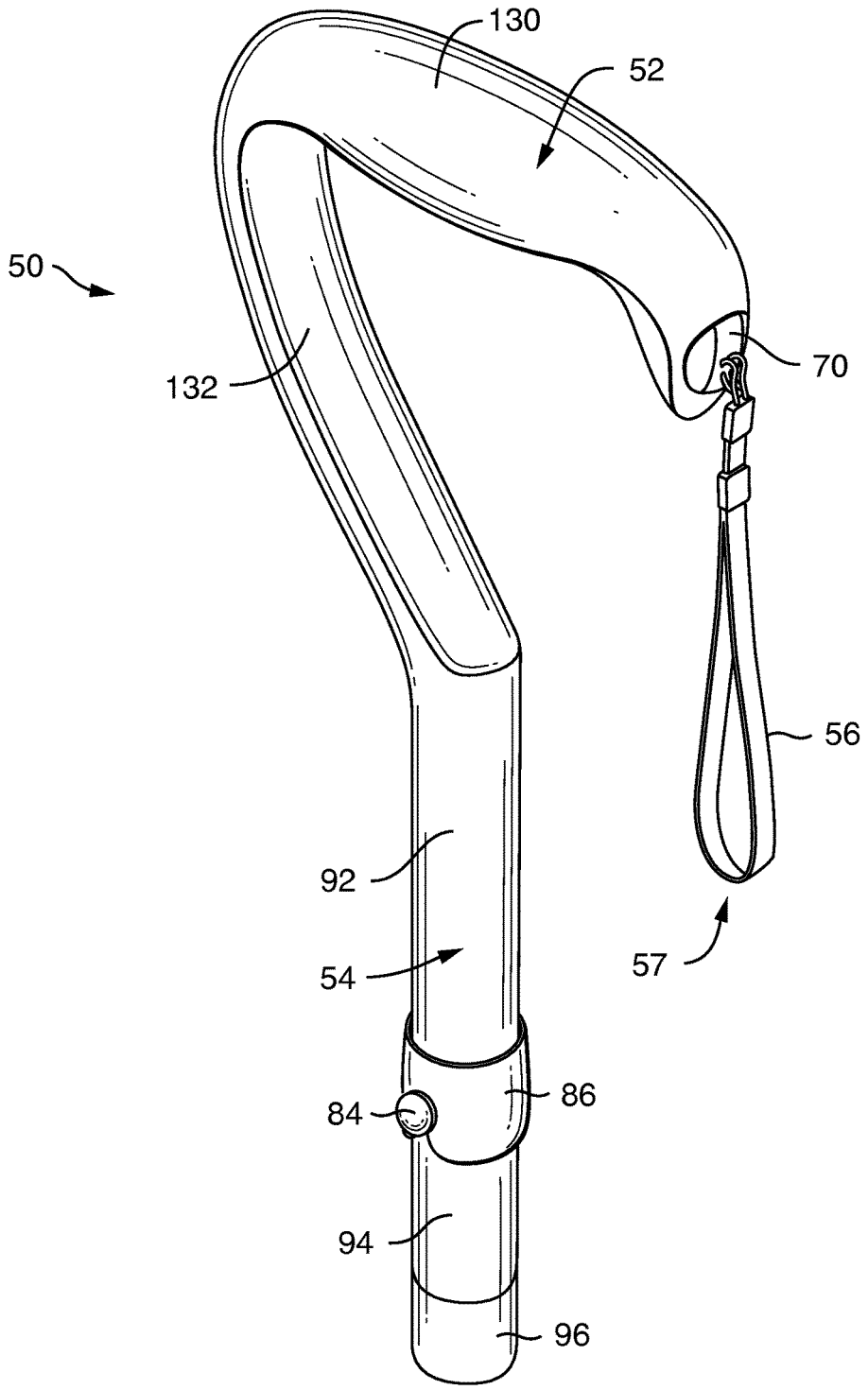
FIG. 9 is a top perspective view of the handle of FIG. 8.

There are three interchangeable handles 50 generally shown in FIGS. 4 through 9, which represent some embodiments of handles 50 that can be coupled to a shaft 20. Specifically, FIGS. 4 and 5 depict a "rectilinear" handle 50, FIGS. 6 and 7 depict a "C" handle 50, and FIGS. 8 and 9 depict an "offset" handle 50. Each handle 50 has a head 52 that can be coupled to a neck 54. In some embodiments, the neck 54 can be integral to the head 52. The handle 50 is grasped by a user, and the neck 54 easily and selectively couples to shaft 20 as will be described, infra. Also common to each handle 50 is a wrist lanyard 56 and a height adjustment mechanism 62. Each handle 50 presents different advantages, and users may choose the handle 50 that best suits their needs. In some embodiments, the handle 50 can be separate from the shaft 20 and coupled to the shaft 20. However, it is contemplated that in other embodiments, the handle 50 can be integral to the shaft 20.

A. Rectilinear Handle

Figure 4A:
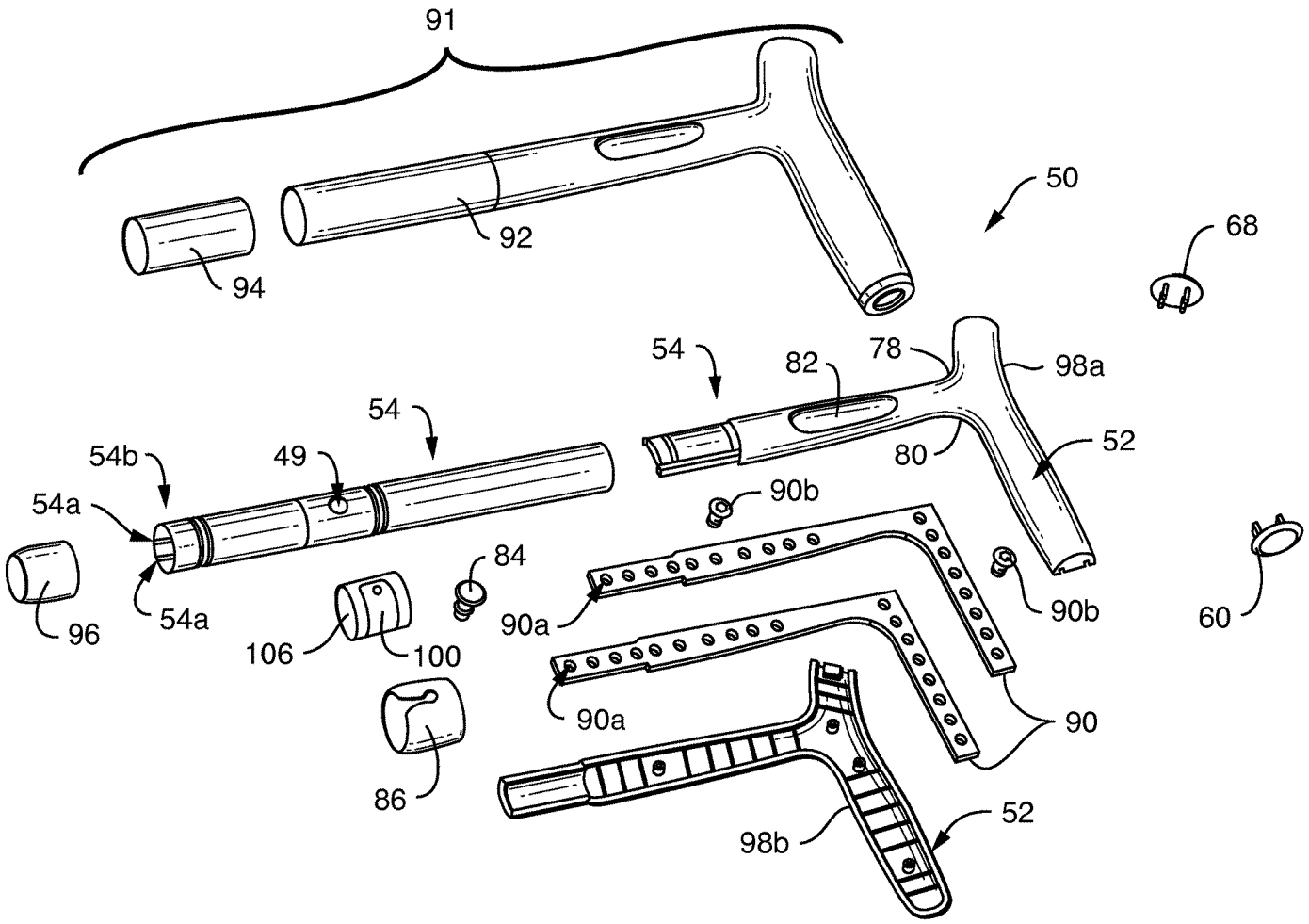
FIG. 4A is an exploded view of the handle shown in FIG. 4.

Referring to FIGS. 4 and 5, the rectilinear handle 50 has the head 52 positioned substantially normal to neck 54. Generally, head 52 is an elongated cylinder having a forward end 64 with a slight bend at the location where head 52 connects to neck 54. In the embodiment depicted in FIGS. 4 and 5, the head 52 can have a slightly tapered rear end 66. A chamfered cap 68 can cover the forward end 64, and a button 60 can cover the rear end 66. FIG. 4A shows a loop external to button 60 to which the wrist lanyard 56 connects.

Wrist lanyard 56 can be a simple strap folded to create a loop portion 57. The ends of the strap can be clinched together by a fixed metal clamp 59. The clamp 59 can be connected to a hook 72 that is used to connect wrist lanyard 56 to button 60. A slide member 58 can be raised or lowered along the strap to change the size of loop 57 and therefore, accommodate different sized hands.

Figure 4B:
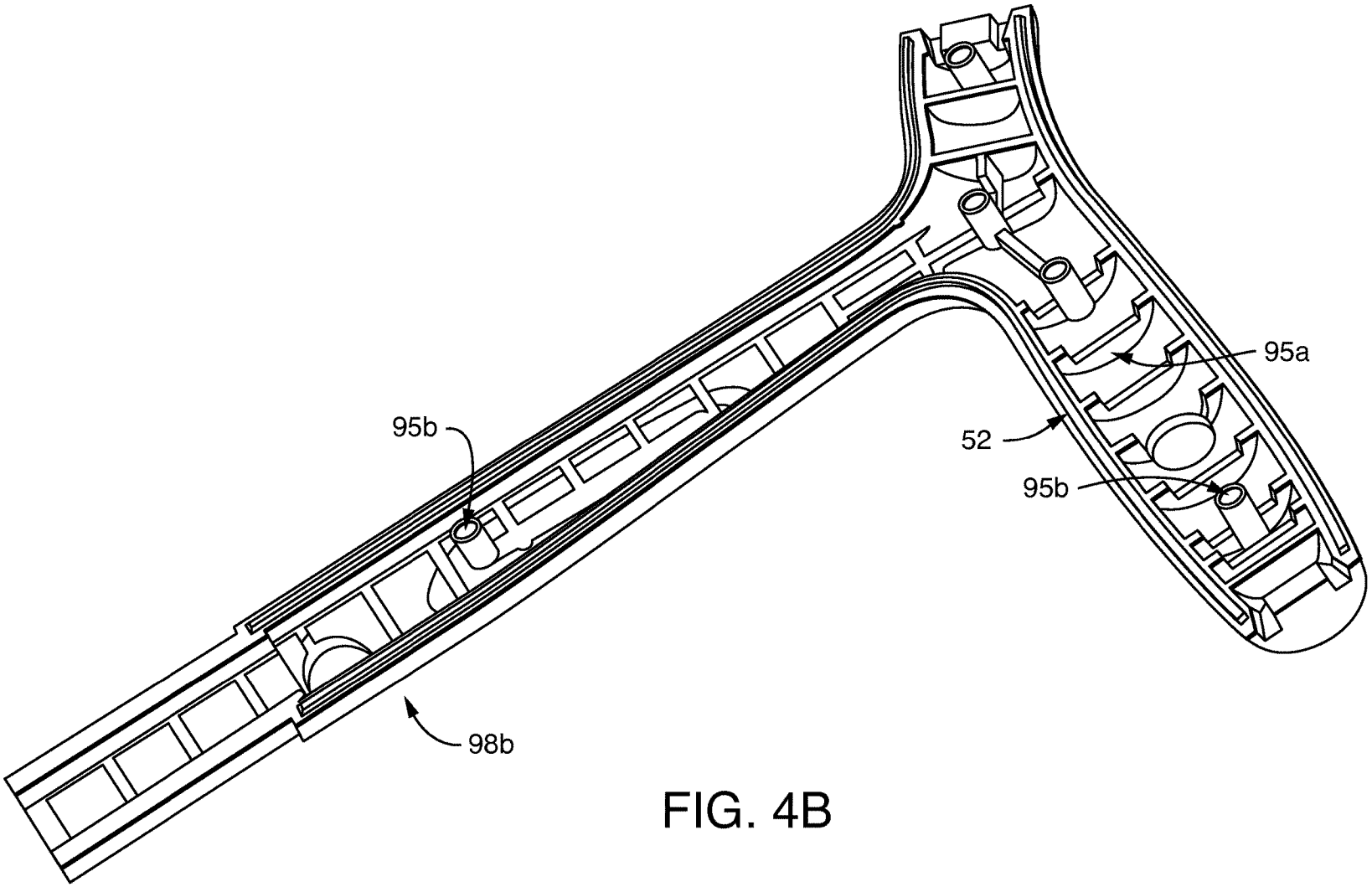
FIG. 4B is a view of the clamshell shown in FIG. 4A.
Figure 4C:
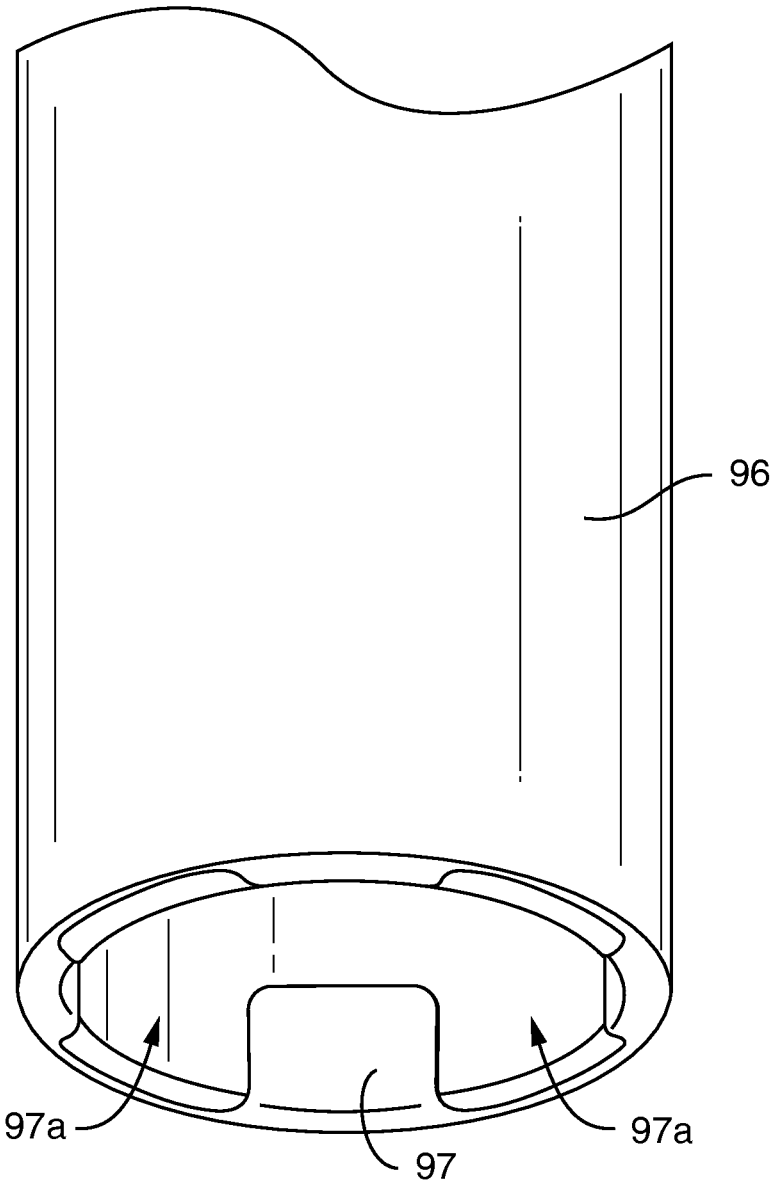
FIG. 4C is a perspective view of a shoulder from FIG. 4A.

FIGS. 4A-4C are exploded views showing the various internal parts of rectilinear handle 50. The handle can include a head 52 that includes at least one internal reinforcement member 90. Shown is a pair of internal reinforcement members 90, each fitting inside the corresponding clam shell members 98*a* and 98*b*. It is contemplated that the handle 50 could include only one internal reinforcement member 90, or three or more internal reinforcement members 90. As illustrated in FIG. 4A, the at least one internal reinforcement member 90 can have a shape that is substantially the same as a shape of the head 52. One suitable material for the internal reinforcement members 90 can be an aluminum alloy such as 6061-T6. Suitable materials for the clam shell members 98*a* and 98*b* can include plastics, metals, or composites thereof, including injection molded polypropylene and ABS plastic, and injection molded polycarbonate and ABS plastic.

The internal reinforcement members 90 can include a plurality of apertures 90*a* (only one aperture 90*a* being labeled in FIG. 4B for purposes of clarity). The apertures 90*a* can reduce the weight of the internal reinforcement member 90 without substantially affecting the strength of the internal reinforcement members 90. The internal reinforcement members 90 can be disposed within the clam shell members 98*a* and 98*b*. One or more of the plurality of apertures 90*a* can provide a through hole for receiving a fastener 90*b* for coupling the internal reinforcement members 90 together. The fastener 90*b* can be a rivet in some embodiments, however, it is contemplated that other types of fasteners can be used to couple the internal reinforcement members 90 together and/or to secure the internal reinforcement members 90 to the clam shell members 98*a*, 98*b*. As illustrated in FIG. 4B, the clam shell member 98*b* can include ribs 95*a* (only one rib 95*a* being labeled in FIG. 4B for purposes of clarity) for additional strength and can include one or more projections 95*b*. Clam shell member 98*a* can be configured to include ribs 95*a* and/or projections 95*b* as well. Projections 95*b* on clam shell member 98*b* can pass through an aperture 90 in the at least one internal reinforcement member 90 and be secured in an aligning projection 95*b* on clam shell member 98*a* via a press fit. Of course, it is contemplated that the clam shell members 98*a*, 98*b* can be coupled to one another in any other suitable fashion.

Once assembled, the internal reinforcement members 90 and the clam shell members 98*a* and 98*b* can slidably fit into the neck 54 of the handle 50, such that at least a portion of the clam shell members 98*a* and 98*b* are received within the neck 54. As illustrated in FIG. 4A, in some embodiments, the head 52 can be separate from the neck 54 and the neck 54 can be coupled to the head 52. It is contemplated that the head 52 and neck 54 could be made to be integral.

In some embodiments, the handle 50 can also include an overmold 91. The overmold 91 can be one integral piece, or in some embodiments, can be two separate components (first component 92 and second component 94) as illustrated in FIG. 4A. The overmold 91 can fit over at least the head 52. In some embodiments, the overmold 91 can also fit over the neck 54 and clam shell members 98*a* and 98*b*. In the embodiment illustrated in FIGS. 4 and 4A, the first component 91 of the overmold 91 fits over the head and at least an upper portion of the neck 54 and the second component 92 of the overmold 91 fits over at least a lower portion of the neck 54. In preferred embodiments, the overmold 91 can be a pliable material, such as a thermoplastic elastomer. One suitable material for the overmold 91 is VERSAFLEX OM9-801N. The overmold material may optionally: 1) include an antimicrobial, 2) have a coefficient of friction that the walking stick does not fall under its own weight when leaning against a wall or other surface, 3) be non-odorous, 4) not harden through use, 5) include UV inhibitors, 6) be comfortable, 7) have increased gripping properties, and 8) include colorants.

In some embodiments, a finger detent 82 can be located on each side of neck 54. The finger detent 82 can be formed into the overmold 91. More specifically, the finger detent 82 can be formed into the first component 92 of the over mold 91. As illustrated in FIGS. 4 and 5, the finger detent 82 can be of an elongated shape, the elongation being parallel to the longitudinal axis 38 of the shaft 20 (labeled in FIG. 2). When a user grasps head 52, the user's finger can rest naturally in the detent 82 to prevent it from slipping, allowing for greater stability, and increasing the user's proprioception.

There can be an anti-rattle feature at the interface of the neck 54 and shaft 20. This anti-rattle feature can be a shoulder 96, as shown in FIGS. 4, 4A, and 4C. The shoulder 96 can be integral with the overmold 91, such as the second component 94 of the overmold 91, or the shoulder 96 can be a separate component from the overmold 91. The shoulder 96 can be comprised of the same materials as the overmold 91 discussed above. Alternatively, the shoulder 96 can be comprised of a rigid plastic such as acetal, or any other suitable material. The shoulder 96 can help reduce rattling between the neck 54 and the shaft 20, which users may find irritating.

As illustrated in FIG. 4C, the shoulder 96 can include tabs 97 that engage the inner surface of the neck 54 near end 54*b* of the neck 54, illustrated in FIG. 4A. The spaces 97*a* between adjacent tabs 97 can provide clearance for the insertion of friction plug 26 as the shaft 20 is coupled to the handle 50. More specifically, the spaces 97*a* between adjacent tabs 97 on the shoulder 96 can be configured to be aligned with the protruding ribs 54*a* on the inner surface of the neck 54 to aid in the alignment of the ribs 26*a* on the friction plug 26 to engage with the protruding ribs 54*a* on the inner surface of the neck 54. Such alignment also helps maintain the rotational alignment between the shaft 20 and the handle 50 such that the height adjustment holes 28 of the shaft 20 stay in rotational alignment with the height aperture 49 of the handle 50, as will be discussed further below with respect to operation of the height adjustment mechanism 62.

Referring back to FIG. 4, the neck 54 is generally a cylindrical shape having a slightly tapered top end 74 and an opposite bottom end 76. To prevent stress concentrations at the junctions 78, 80 between head 52 and neck 54, each junction can be configured to have a radius.

Moving down the length of neck 54 there is a height adjustment mechanism 62. As shown in FIGS. 4, 4A, 5, and 20A-20F, the height adjustment mechanism 62 can include a pin 84. The height adjustment mechanism 62 can also include a height aperture 49 in the handle 50 that is sized to receive the pin 84. The plurality of height adjustment holes 28 are also configured to be sized to receive the pin 84. As illustrated in FIG. 4A, the neck 54 can include the height aperture 49. In preferred embodiments, the height adjustment mechanism 62 can further include a slideable collar 86. When the walking stick is in use, collar 86 can be releasably joined to pin 84 with a snap fit. As will be described in further detail below with respect to FIGS. 20A-20F, the collar 86 can include a channel 88 that provides for the snap fit with the pin 84. The height adjustment mechanism 62 can also include a throat sleeve 106, as depicted in FIG. 4A. The throat sleeve 106 can include a flap 100 that can be coupled to the pin 84. The throat sleeve 106 can be received on the neck 54 in a position near the height aperture 49.

Figure 17A:
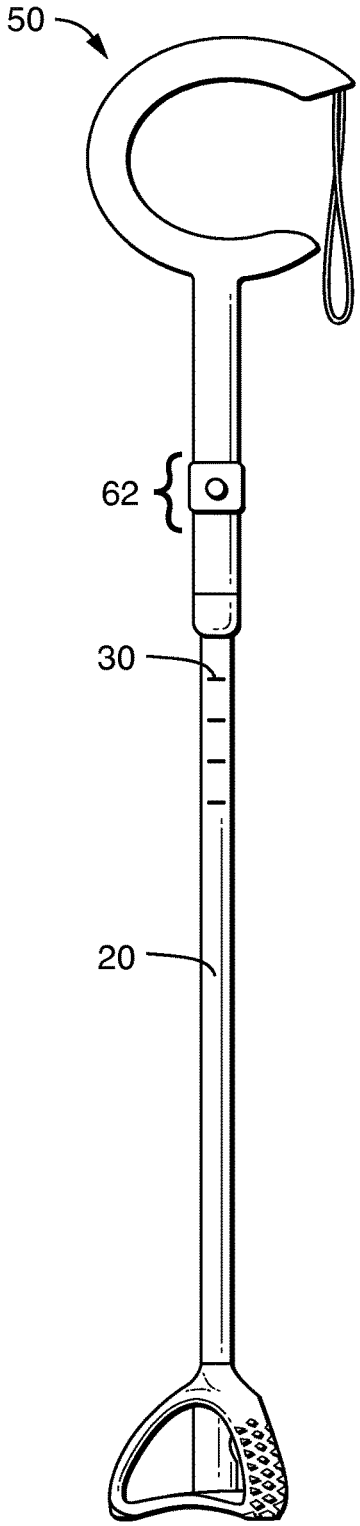
FIGS. 17A and 17B are side elevations of one embodiment of the walking stick of the present disclosure, adjusted at different lengths.
Figure 17B:
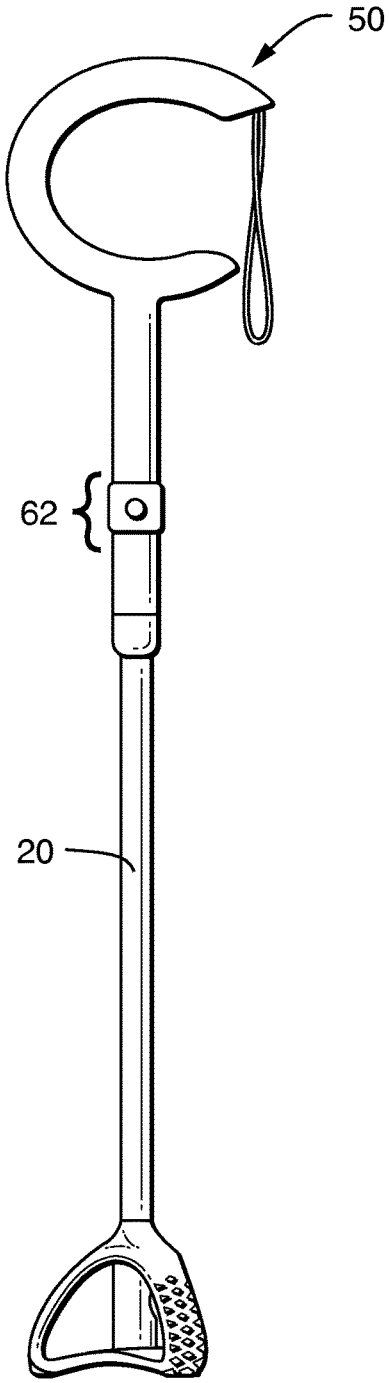
Figure 18:
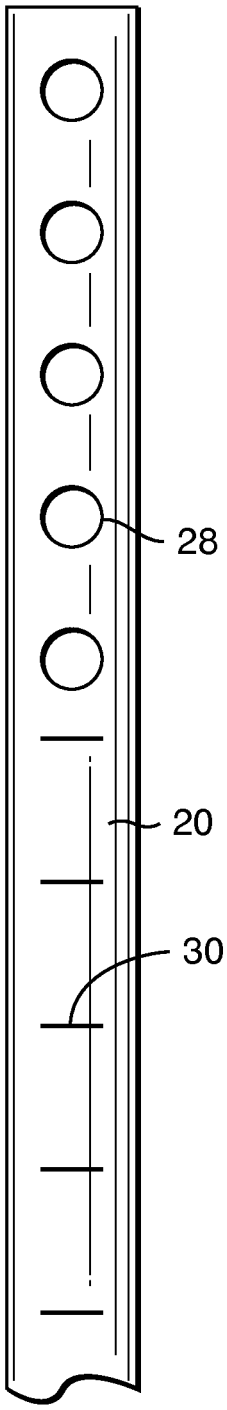
FIG. 18 is a partial front elevation of the shaft of FIG. 2.
Figure 19:
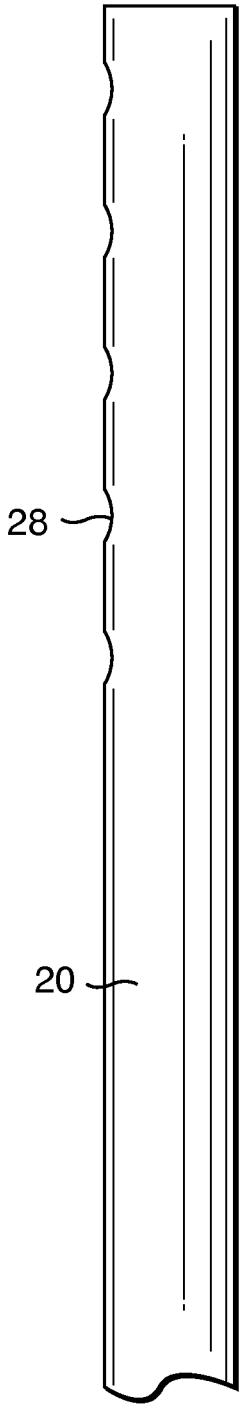
FIG. 19 is a partial side elevation of the shaft of FIG. 2.
Figures 20A, 20B, 20C, 20D, 20E, 20F:
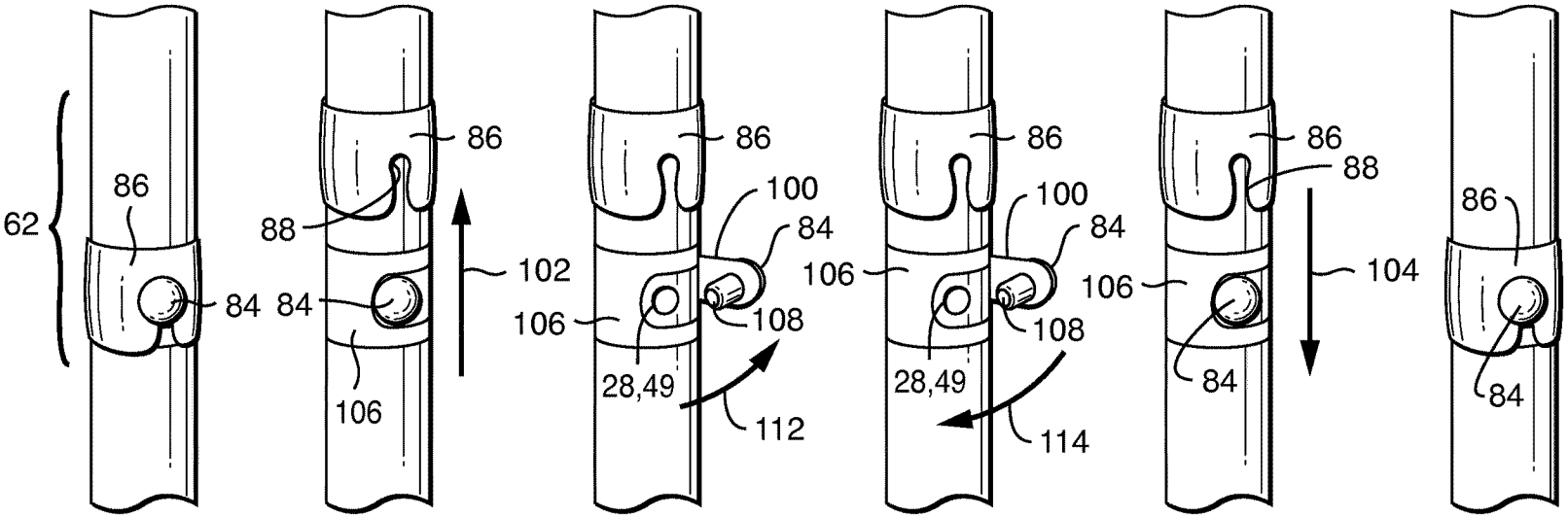
FIGS. 20A through 20F show a series of partial front elevation views of the shaft being adjusted in length with a height adjustment mechanism.

Referring to FIGS. 20A-20F, a preferred embodiment of the height adjustment mechanism 62 and how it can be used to adjust the height of the walking stick will now be described. FIG. 20A depicts the walking stick in a first height setting, in which the pin 84 would be resting in the height aperture 49 of the neck 54 (depicted in FIG. 4A) and one of the plurality of height adjustment holes 28 of the shaft 20 (depicted in FIG. 2). As illustrated in FIG. 20B, to change the height of the walking stick, a user can selectively slide the collar 86 upward in direction fully revealing the pliable throat sleeve 106. The user can then disengage the pin 84 from the height adjustment hole 28 in the shaft and the height aperture on the neck 54 of the handle 50 by pulling on the pin 84, as illustrated in FIG. 20C. The flap 100 of the throat sleeve 106 can move in direction 112, and reveals the pin stem 108 and corresponding height adjustment hole 28 of the shaft 20 and the height aperture 49 of the neck 54. (See height adjustment holes 28 in shaft 20 in FIGS. 2, 18, and 19; height aperture 49 in neck 54 in FIG. 4A) Once the pin stem 108 is removed from the height adjustment hole 28 and preferably removed from the height aperture 49 of the neck 54, the neck 54 of the handle 50 and the shaft 20 can be slidably moved in a longitudinal direction with respect to one another to adjust the height of the walking stick to a desired height. Advantageously, the pin 84 can be controlled by the flap 100 of the throat sleeve 106, and thus, this reduces the possibility of dropping the pin 84 and/or the need for placing the pin 84 in another location while employing the height adjustment mechanism 62 to modify the height of the walking stick. Once the desired height is selected by the user, as illustrated in FIG. 20D, the pin 84 can engage another one of the height adjustment holes 28 located up or down on the shaft 20, thereby shortening or lengthening the walking stick as seen in FIGS. 17A and 17B. As illustrated in FIG. 17A, the markers 30 can indicate to the user that the height adjustment mechanism 62 can be employed to reduce the height of the walking stick by lowering the handle 50 with respect to the shaft 20, such as to the height illustrated in FIG. 17B. Referring to FIG. 20E, the pin 84 and flap 100 can now be moved in direction 114 so that the pin stem 108 again rests in the height aperture 49 in the neck and in one of the height adjustment holes 28 of the shaft 20. The collar 86 can be moved in downward direction 104 as illustrated in FIG. 20E such that the channel 88 engages the pin stem 108, snapping the collar 86 into place as seen in FIG. 20F.

As a benefit, the collar 86 can provide an aesthetically pleasing look to the handle 50 by covering up the throat sleeve 106 and other internal components of the height adjustment mechanism 62. In some embodiments, the collar 86 can be colored and/or designed to be the same or similar to the overmold 91 such that the collar 86 provides a seamless transition between the first component 92 and second component of the overmold 94, above and below the collar 86, respectively. Alternatively, the collar 86 can be designed to a different color than the overmold 91 or other component of the walking stick to provide the user with an indication of position of the collar 86 or other aspect of the height adjustment mechanism 62.

Figure 28A:
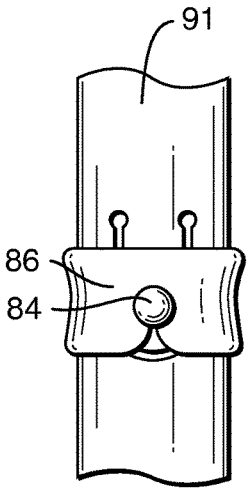
FIG. 28A-28E show a series of partial front elevation views of the shaft being adjusted in height similar to FIGS. 20A-20F, but with an alternative height adjustment mechanism.
Figure 28B:
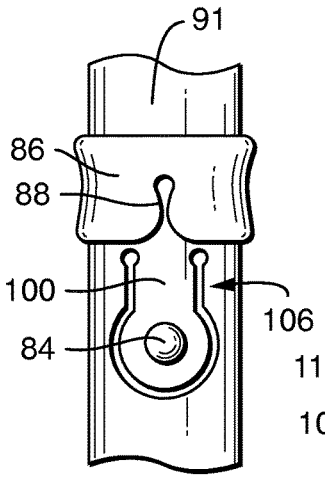
Figure 28C:
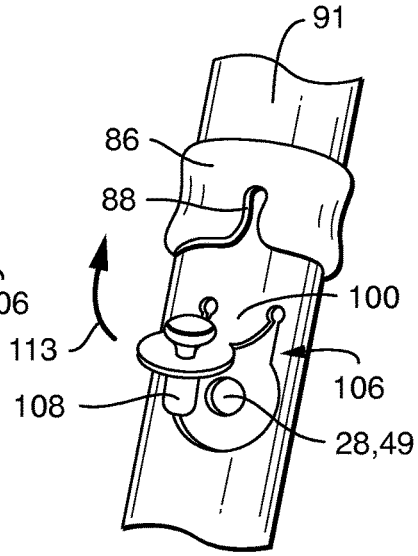
Figure 28D:
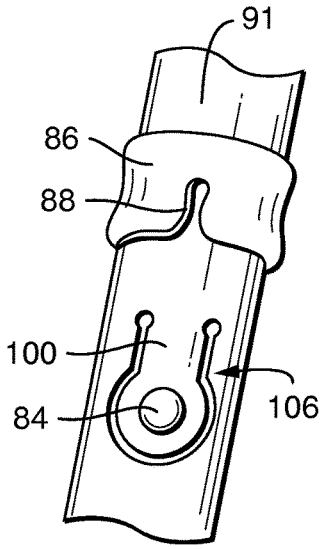
Figure 28E:
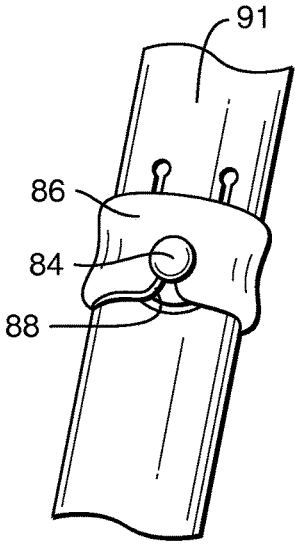

It is contemplated that the height adjustment mechanism 62 can be configured in various ways. For example, FIGS. 28A-28E illustrate an alternative embodiment of a height adjustment mechanism 62 as illustrated in FIGS. 20A-20E, however, the throat sleeve 106 in FIGS. 28A-28E is configured in an alternative fashion. As illustrated in FIGS. 28B-28D, the throat sleeve 106 is configured such that the flap 100 coupled to the pin 84 can move in more of a longitudinal direction to disengage and engage the pin 84 as opposed to a lateral direction as illustrated in FIGS. 20B-20D. For example, FIG. 28C illustrates that the flap 100 can be moved in direction 113, which is longitudinal in nature as opposed to direction 112 shown in FIG. 20C, which is lateral. Similarly, FIG. 28D illustrates that the flap 100 can be moved in direction 115, which, again, is longitudinal in nature as opposed to direction 114 shown in FIG. 20D, which is lateral. Another feature of the alternative throat sleeve 106 in FIGS. 28A-28E is that the throat sleeve 106 can be integral to the overmold 91. For example, the throat sleeve 106 can be formed to be integral with the first component 92 or the second component 94 of the overmold 91. As noted above, the overmold 91 can be a single component, and thus, could also include the throat sleeve 106.

B. C Handle

Figure 6A:
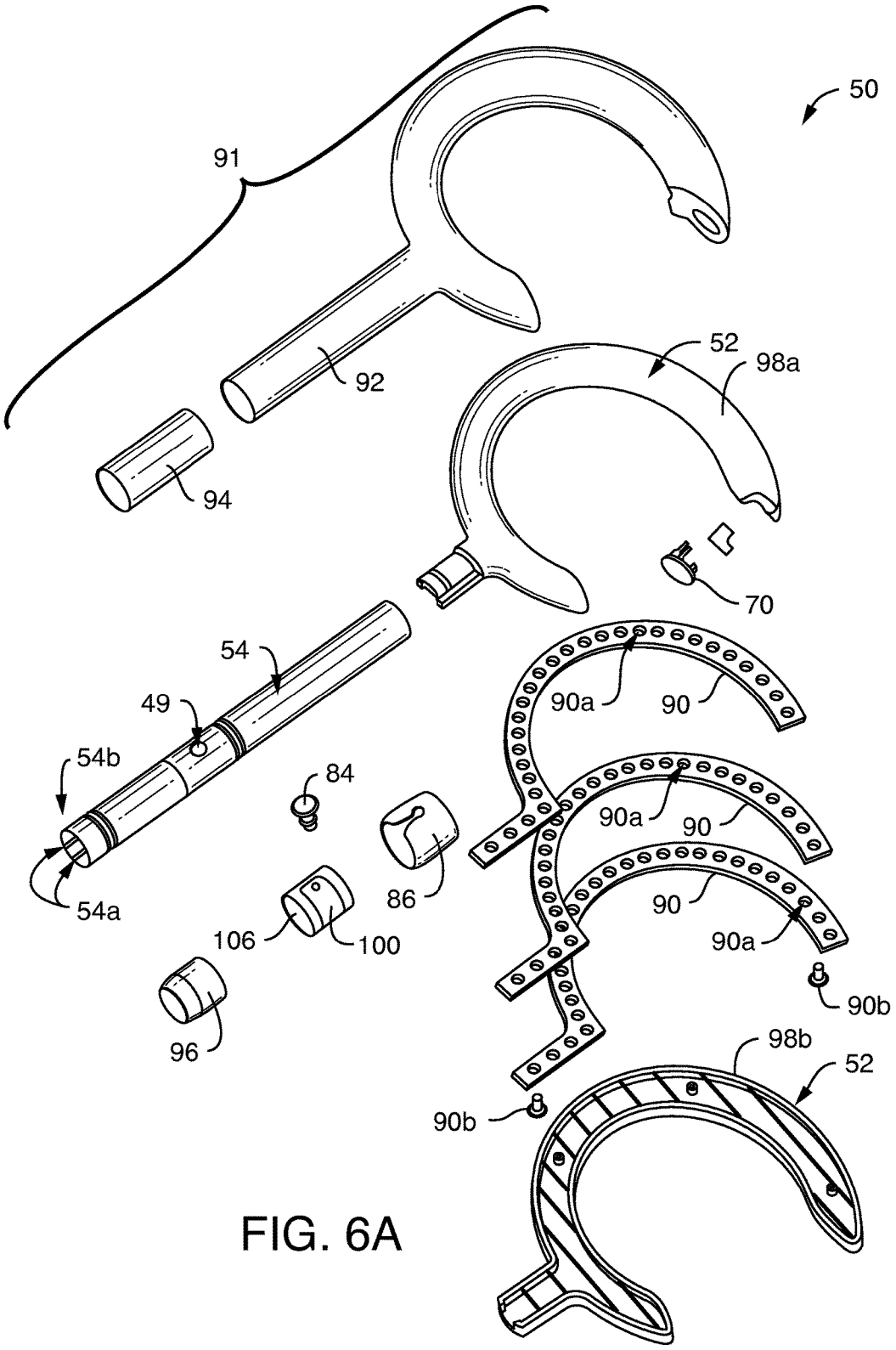
FIG. 6A is an exploded view of the handle shown in FIG. 6.

Referring now to FIGS. 6 and 7, the C handle 50 carries many of the same features as the rectilinear handle 50, described above, which will not be repeated here. As illustrated in FIG. 6A, the C handle 50 can include three internal reinforcement members 90. The primary difference in the C handle 50 as compared to the rectilinear handle 50 is in the shape of head 52, which has a C shape. As illustrated in FIG. 6, the C handle 50 can include a head 52 and a neck 54 that intersect at an intersecting point 53. The head can include an upper portion 122 and a lower portion 124, which can be separated by an imaginary line 52*a* bisecting the C handle 50. The upper portion 122 can include a first end 122*a* and the lower portion 124 can include a second end 124*a*. For purposes herein, the first end 122*a* can be defined as the point on the upper portion 122 of the head 52 that is laterally the furthest from the longitudinal axis 38 of the shaft 20. Similarly, for purposes herein, the second end 124*a* can be defined as the point on the lower portion 124 of the head 52 that is laterally the furthest from the longitudinal axis 38 of the shaft 20. For purposes herein, the "lateral" direction means perpendicular to the longitudinal axis 38 of the shaft 20. As illustrated in FIG. 6 the first end 122*a* of the upper portion 122 can be located laterally further away from a longitudinal axis 38 of the shaft 20 than is the second end 124*a* of the lower portion 124.

As illustrated in FIG. 6, the second end 124*a* of the lower portion 124 is disposed laterally outward from the intersection point 53 of the head 52 and neck 54 of the handle 50. For purposes herein, the second end 124*a* is considered to be disposed laterally outward from the intersection point 53 of the head 52 and neck 54 when the second end 124*a* is disposed away from the outer surface 55 of the neck 54 at the intersection point 53. In some embodiments, it is preferable to have the second end 124*a* be about 20 mm to about 70 mm away from the outer surface 55 of the neck 54 at the intersection point 53, more preferably from about 30 mm to about 55 mm away from the outer surface 55 of the neck 54 at the intersection point 53, and even more preferably about 45 mm away from the outer surface 55 of the neck 54 at the intersection point 53.

Figure 22:
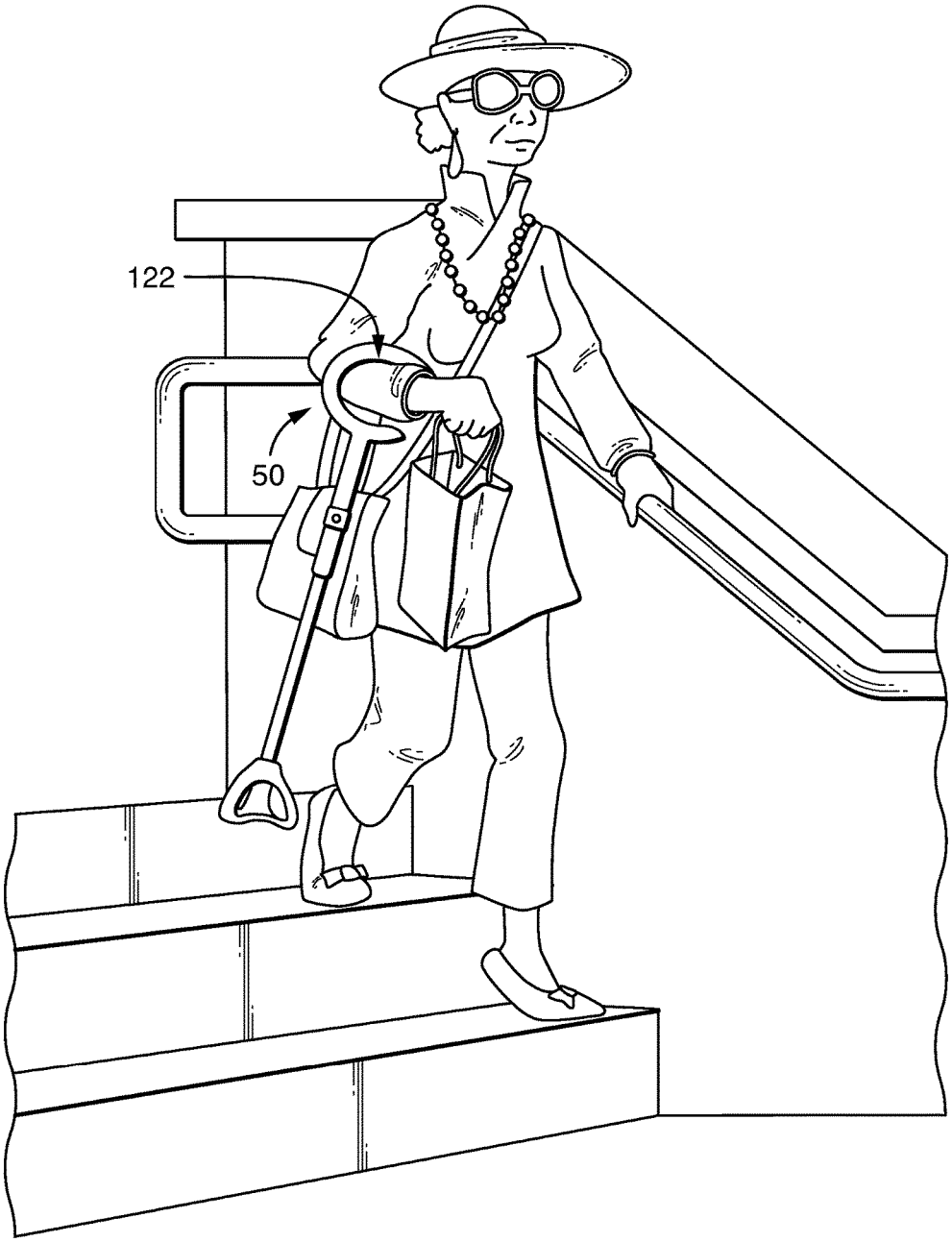
FIG. 22 depicts a user carrying the walking stick having the handle of FIG. 6 and the interchangeable foot of FIG. 13.

The C shape of the C handle 50 provides certain advantages for a user. One advantage to the C shape is that it allows a user to easily carry the walking stick on his or her forearm as depicted in FIG. 22. By configuring the first end 122*a* of the upper portion 122 of the head 52 to be further away from the longitudinal axis 38 than is the second end 124*a* of the lower portion 124 of the head 52 as described above, the upper portion 122 can provide a solid surface for resting the head 52 on the arm of the user, yet the lower portion 124 still allows plenty of clearance for the user to put their arm between the upper portion 122 and the lower portion 124.

Figure 24:
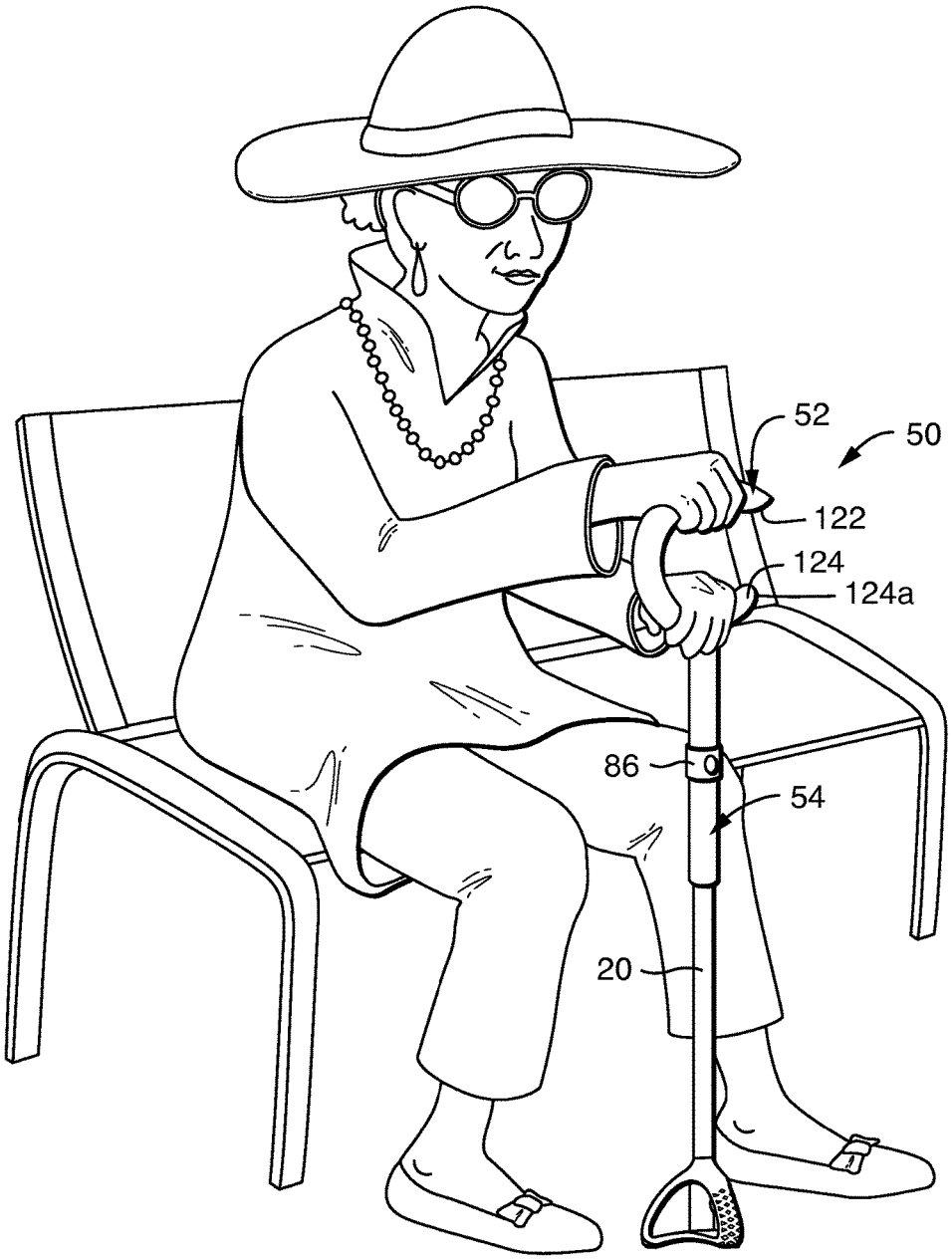
FIG. 24 depicts how a user can raise themselves from a sitting position using the handle of FIG. 6.

Another advantage to the C shaped handle 50 is the ability for persons to raise themselves up from a sitting position using both hands as depicted on FIG. 24. As illustrated in FIG. 24, one of the user's hands can grip the upper portion 122 of the C handle 50 and the other hand can grip the lower portion 124 of the C handle 50, extending over the intersection point 53 of the head 52 and neck 54 and towards the second end 124*a* of the lower portion 124. Such a grip can provide a user with enhanced surfaces for pushing in an upwards direction to aid the user in standing.

Yet another benefit of the C shape handle is that when the second end 124*a* of the lower portion 124 extends away from an outer surface 55 of the neck 54 at the intersection point 53, the lower portion 124 between the intersection point 53 and the second end 124*a* provides an arm for hanging straps or objects, such as bags, shopping bags, purses, etc.

Figure 23:
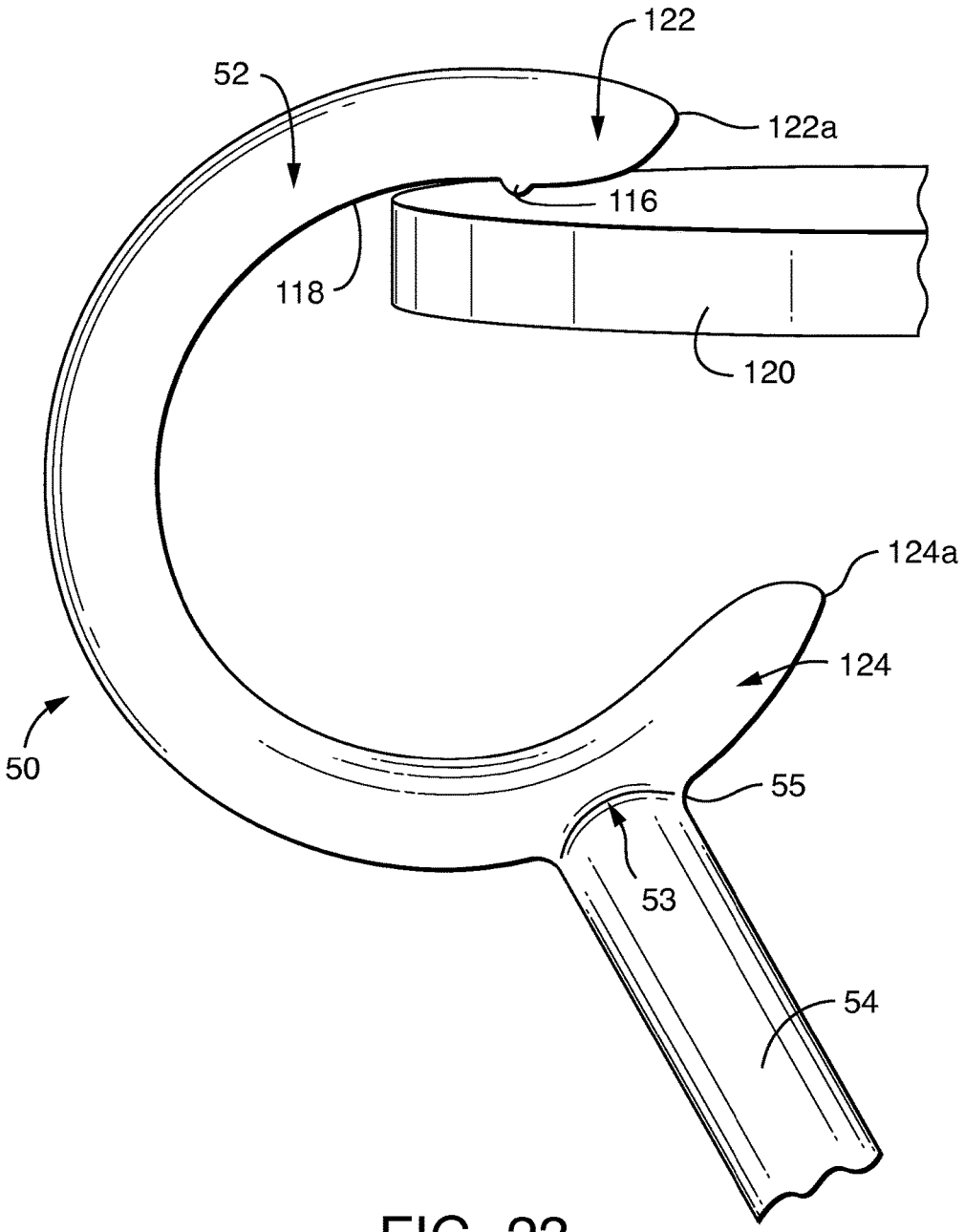
FIG. 23 depicts how the handle of FIG. 6 can hang from a table top.

The C shape handle 50 can also include a boss 116. The boss 116 can be located on the underside 118 of the upper portion 122 of the head 52 of the handle 50. The boss 116 allows one to easily hang the stick from a table top 120 as depicted in FIG. 23. Preferably, there is only one boss 116 located on the underside 118 of the upper portion 122 of the head 52. As illustrated in FIG. 6, an outer edge 116*a* of the boss 116 nearest the first end 122*a* of the upper portion 122 can be between about 10 mm and about 50 mm away from the first end 122*a* of the upper portion 122 of the head 52. In preferred embodiments, the outer edge 116*a* of the boss 116 nearest the first end 122*a* of the upper portion 122 can be between about 20 mm and about 30 mm away from the first end 122*a* of the upper portion 122 of the head 52, and more preferably about 25 mm away from the first end 122*a* of the upper portion 122 of the head 52.

Figure 30A:
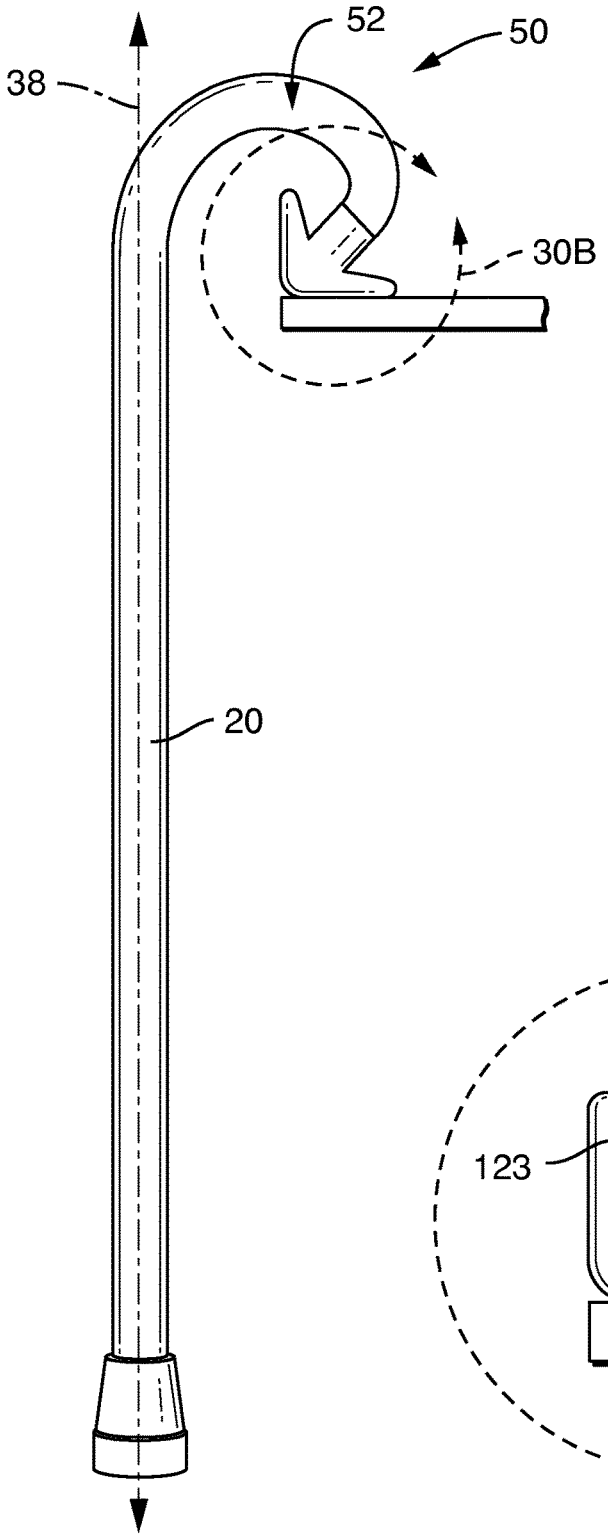
FIG. 30A is a front elevational view of an alternative handle.
Figure 30B:
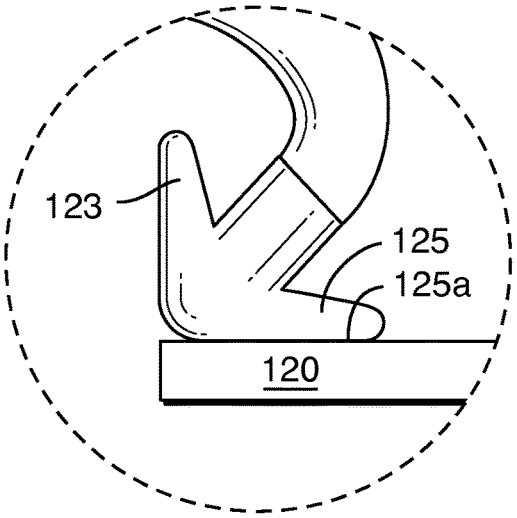
FIG. 30B is a detailed view taken along line 30B-30B from FIG. 30A.

Another structure on a head 52 that can be beneficial in resting on a table top 120, or other flat surface, is illustrated in FIGS. 30A and 30B. The head 52 can include a first projection 123 and a second projection 125. The second projection 125 can include an outer surface 125*a* that is perpendicular to the longitudinal axis 38 of the shaft 20. As illustrated in FIG. 30B, this outer surface 125*a* can provide a balancing and resting position for the head 52 on a table top 120. The first projection 123 can be internal to the head 52 and can provide a hook for a strap of a bag, shopping bag, purse, etc.

Figure 29A:
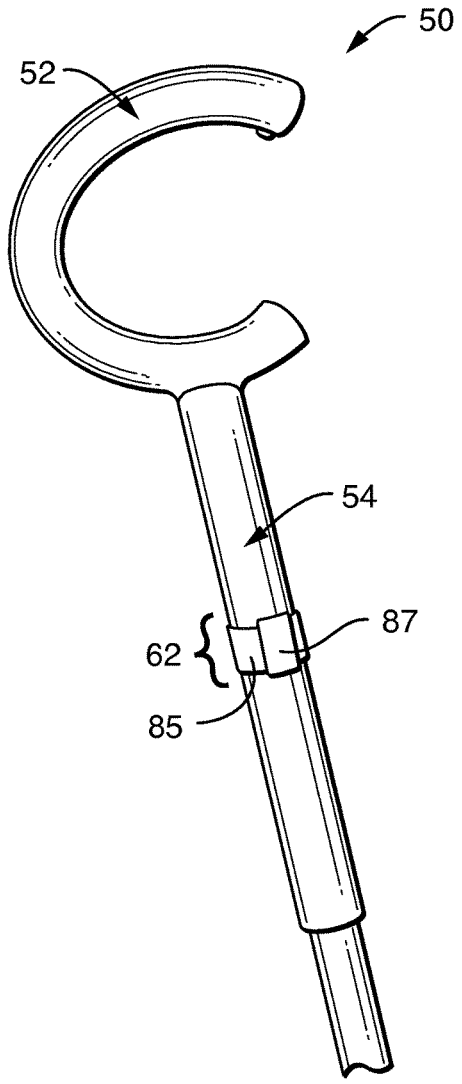
FIG. 29A is a front elevational view of a handle with yet another alternative height adjustment mechanism.
Figure 29B:
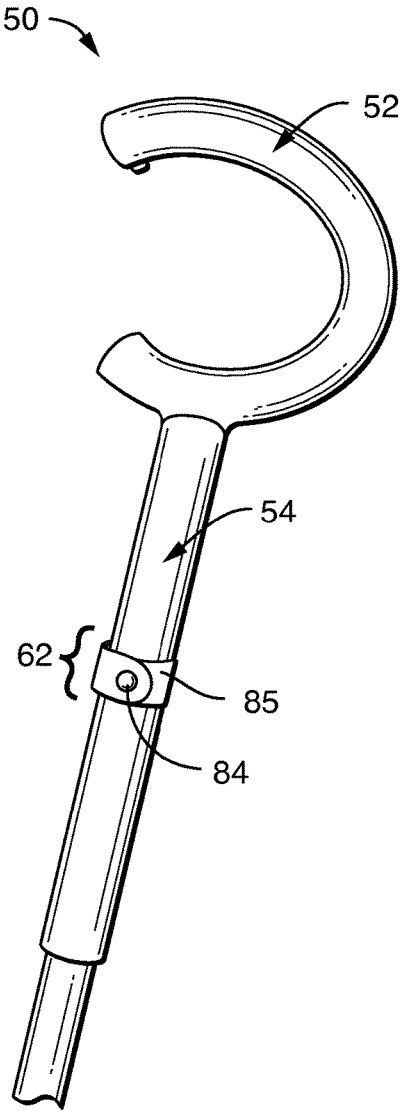
FIG. 29B is a rear elevation view of the handle of FIG. 29A.
Figure 29C:
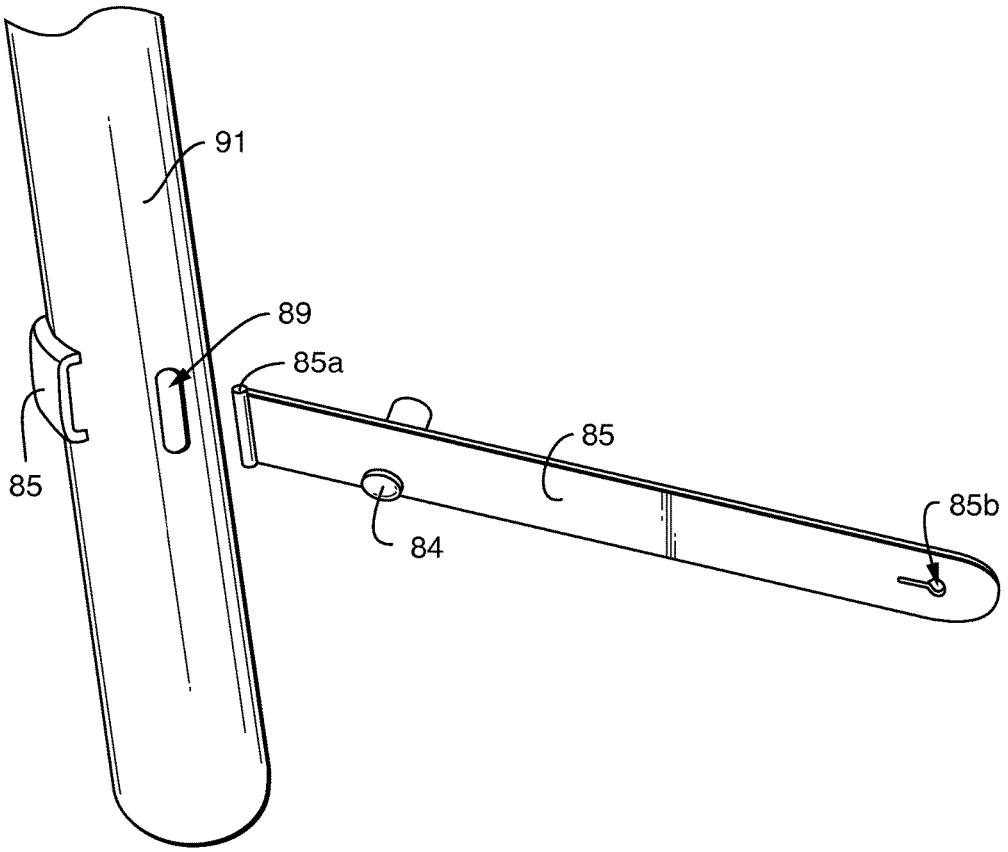
FIG. 29C is a detailed, exploded view of the handle and height adjustment mechanism of FIG. 29A.
Figure 29D:
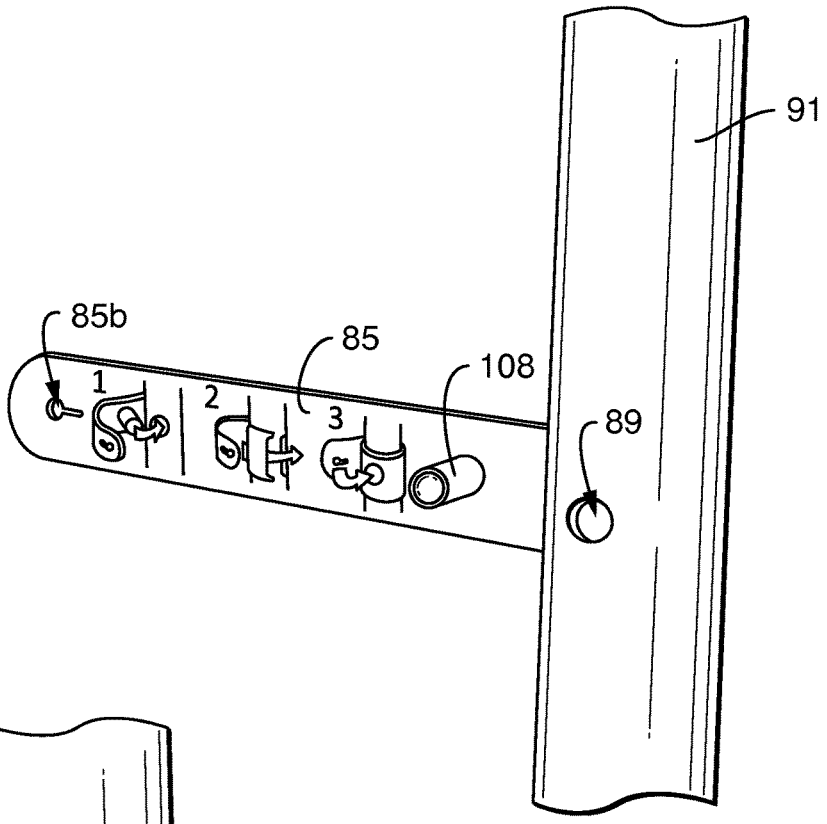
FIGS. 29D and 29E are perspective views of the handle and height adjustment mechanism of FIG. 29A.
Figure 29E:
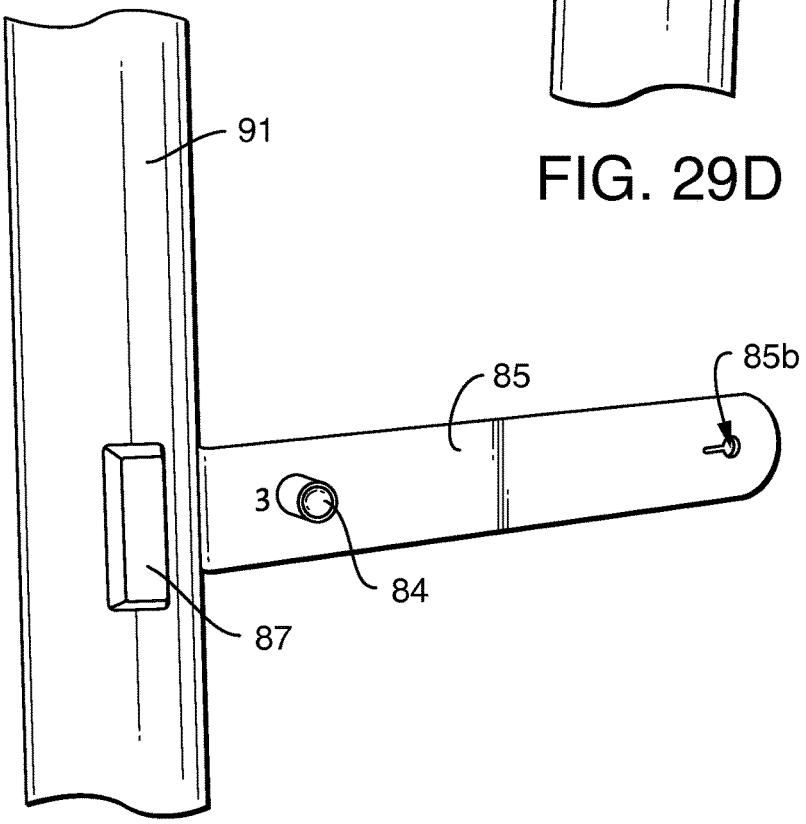

Another alternative height adjustment mechanism 62 is illustrated in FIGS. 29A-29E. FIGS. 29A and 29B depict the front and rear views of a C shape handle 50 with height adjustment mechanism 62 engaged, respectively. While this height adjustment mechanism 62 is illustrated with C-shape handle 50, it could utilized with any handle 50. The height adjustment mechanism 62 can include a pin 84, a strap 85, and a loop 87. As illustrated in FIG. 29C, the loop 87 can be integral to the overmold 91 that covers the neck 54. The overmold 91 can also include a hole 89 for receiving the strap 85. The strap 85 can include a ridge member 85*a* configured to be received within the hole 89, and couple the strap 85 to the overmold 91. The strap 85 can be coupled to the pin 84 and also include an aperture 85*b*. As illustrated in FIGS. 29D and 29E, once the strap 85 is received within the hole 89, the strap 85 can be wrapped around the overmold 91 and the pin stem 108 can rest within the hole 89 in the overmold 91, and also within the height aperture 49 in the neck 54 and one of the plurality of height adjustment holes 28 on the shaft 20, as described above with respect to other height adjustment mechanisms 62. Then the strap 85 can pass through the loop 87 and be secured on the pin 85 at aperture 85*b*.

Similar to other height adjustment mechanisms 62 described above, the height adjustment mechanism 62 illustrated in FIGS. 29A-29E provide for an aesthetically pleasing feature that hides several of the internal components of the height adjustment mechanism. In some embodiments, the strap 85 and the loop 87 can be made from similar materials, colors, and designs as the overmold 91.

C. Offset Handle

Figure 8A:
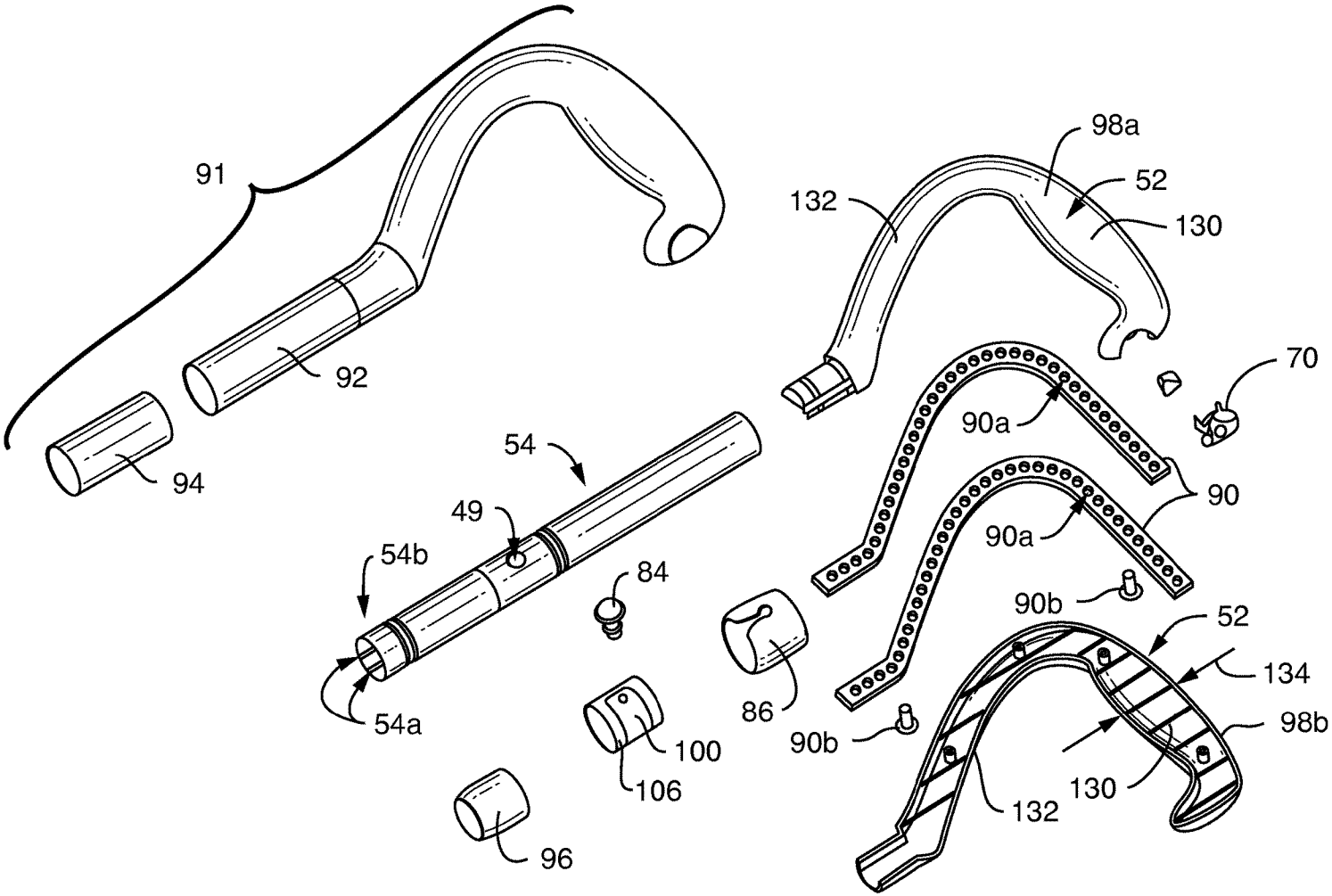
FIG. 8A is an exploded view of the handle of FIG. 8.

Referring now to FIGS. 8, 8A and 9, the "offset" handle 50 carries many of the same features as the rectilinear handle 50 and the C handle 50, described above. The primary difference in the offset handle is in the shape of head 52. The head 52 of offset handle 50 includes an upper grasp 130 and a side section 132 which connects to the neck 54. The benefit of this handle is the user's ability to have a full grip on the handle 50 without any obstruction. It also places the axis 38 of the shaft in line with the users arm, providing less stress on the wrist compared to handles that are not aligned with the shaft. The upper grasp 130 may optionally be thickened in height 134 and/or width (not shown) to provide a more ergonomic handle. The joint 138 connecting upper grasp 130 to side section 132 has a radius to reduce stress concentration.

Interchangeable Foot

Overall, the interchangeable foot preferably includes one or more of the following characteristics: durable; aesthetically pleasing, reasonable cost to manufacture; relatively light weight; grippable, colored, shock absorbent; non-marking; and cleanable. The materials from which the interchangeable foot is made may have the following optional physical characteristics: high abrasion resistance; high elasticity across the entire hardness range; excellent low-temperature and impact strength; resilience to oils, greases and numerous solvents; good flexibility over a wide temperature range; robust weather and high-energy radiation resistance; pleasant tactile properties; suitability for bonding and welding; regions of high coefficient of friction to provide grip; ease of coloring; and recyclability. In a preferred embodiment, the hardness of the material can include a high durometer to provide rigidness and strength. As an example, the hardness of the material may be Durometer 50-70 Shore A. The material can include a micro-texture on the surface to provide increased gripping ability. In another aspect, the abrasion resistance per ISO 4649/DIN 53516 may be 50-150 mg. In yet another aspect, the material may have a compression set of about 10% (compression set tests are static load tests as described in standard test ASTM D-395). Materials that may be suitable for the interchangeable foot include polyurethane, ethylene propylene, styrene butadiene, neoprene/chloroprene, natural rubber, and silicone rubber.

In one aspect, the material of the interchangeable foot is a thermoplastic polyurethane such as polyether polyurethane or polyester polyurethane (if hydrolysis resistance is sufficient). For instance, one suitable material may be ELASTOLLAN B 60 A ESD TPUR, obtained from BASF, Freeport, Tex. Other suitable materials may be DESMOPAN 6064A and DESMOPAN 5377A.

A. Single Tip Foot

Figure 3B:
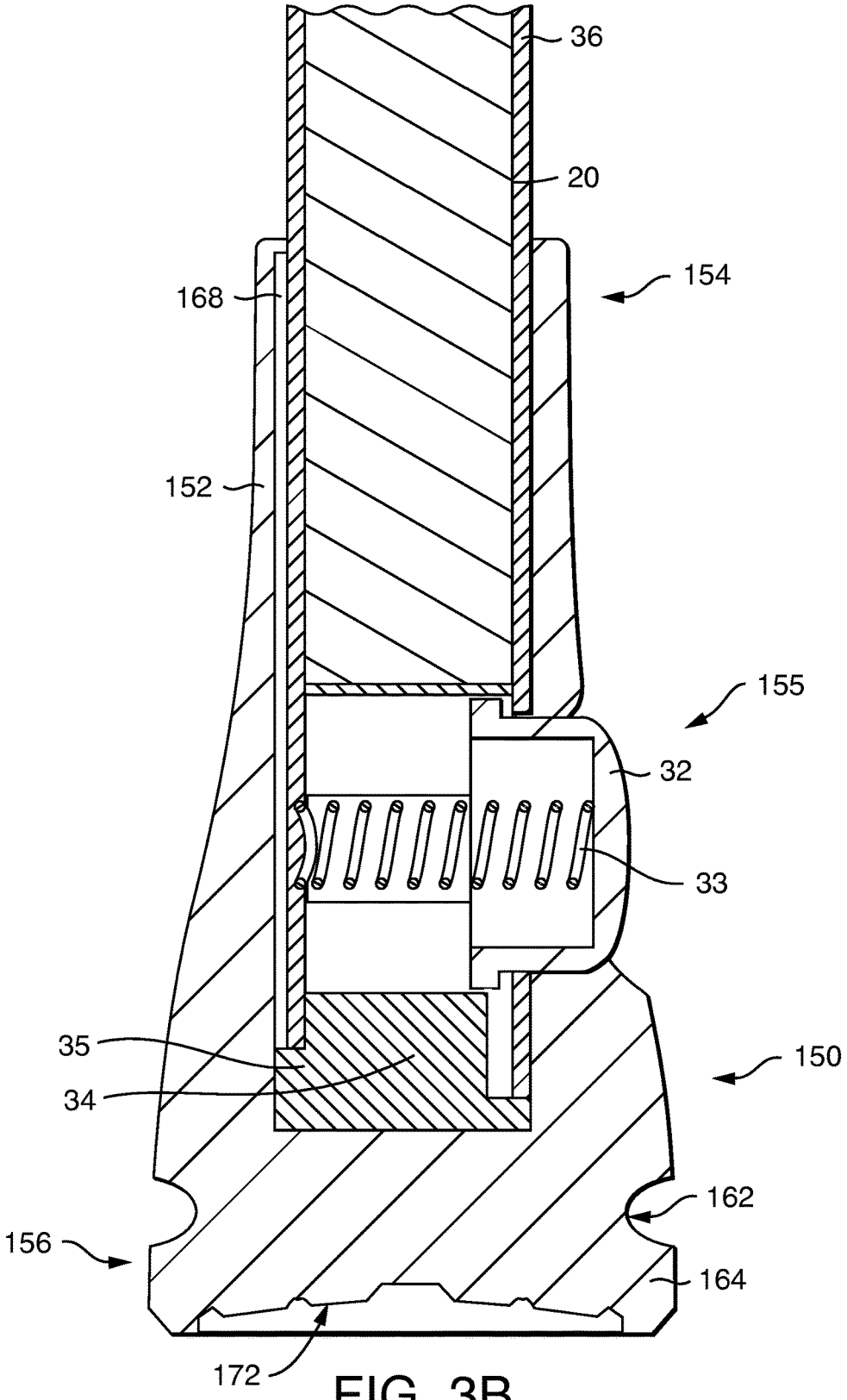
FIG. 3B is a partial side cross-section of the shaft of FIG. 3 in a foot of the present disclosure.
Figure 10:
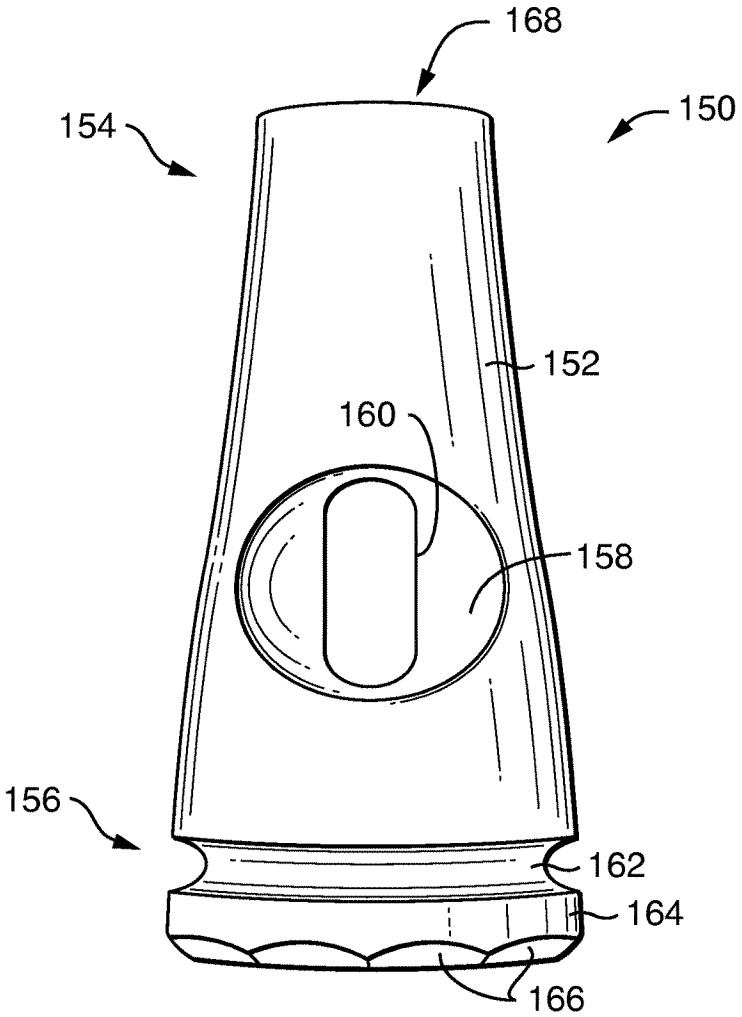
FIG. 10 is a front elevation of a first foot embodiment of the present disclosure.

The single tip foot 150 is shown in FIGS. 3B, and 10-12. Referring to FIGS. 3B and 10, the foot 150 has a top portion 154 with a cylindrical socket 168 extending to the bottom portion 154 (see FIGS. 3A and 11) that accommodates the shaft 20. The single tip foot body 152 is tapered so that it narrows toward the top portion 154.

Figure 3C:
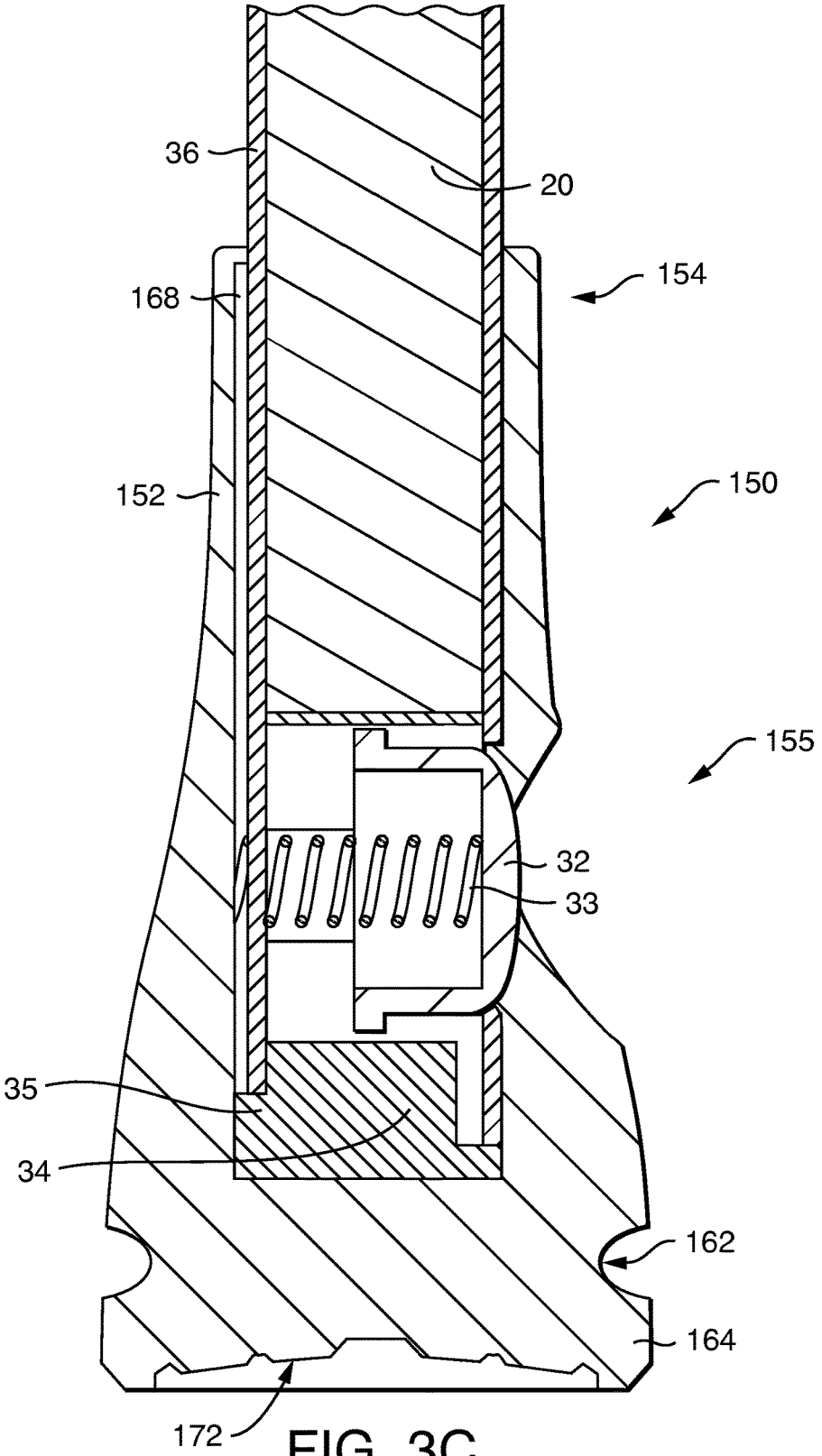
FIG. 3C is the shaft of FIG. 3B having a latch button in a depressed state.

As illustrated in FIGS. 3B and 3C, the foot 150 can include a foot replacement mechanism 155. The foot replacement mechanism 155 can include a depressible latch button 32 and a spring 33. As illustrated in FIGS. 3B and 3C, the spring can be disposed within the shaft 20 and can engage the depressible latch button 32. The foot replacement mechanism 155 can also include a latch aperture 160 for receiving the depressible latch button. The depressible latch button 32 can extend through an aperture 31 in the shaft 20 (as depicted in FIGS. 2A and 3A). In some embodiments, located on the front of the body 152 is a thumb detent 158 surrounding the latch aperture 160 (as labeled in FIGS. 10 and 11). The thumb detent 158 can provide guidance for a user's thumb or finger to find and easily press the depressible latch button 32. The depressible latch button 32 is shown with an elongated shape, but it is contemplated that it could be round, oval or any other geometric shape. Latch aperture 160 has a shape to accommodate the depressible latch button 32 (see FIG. 3B). As illustrated in FIG. 3C, the depressible latch button 32 can be depressed to compress spring 33, providing clearance to remove the foot 150 from the shaft 20.

Figures 21A, 21B, 21C, 21D:
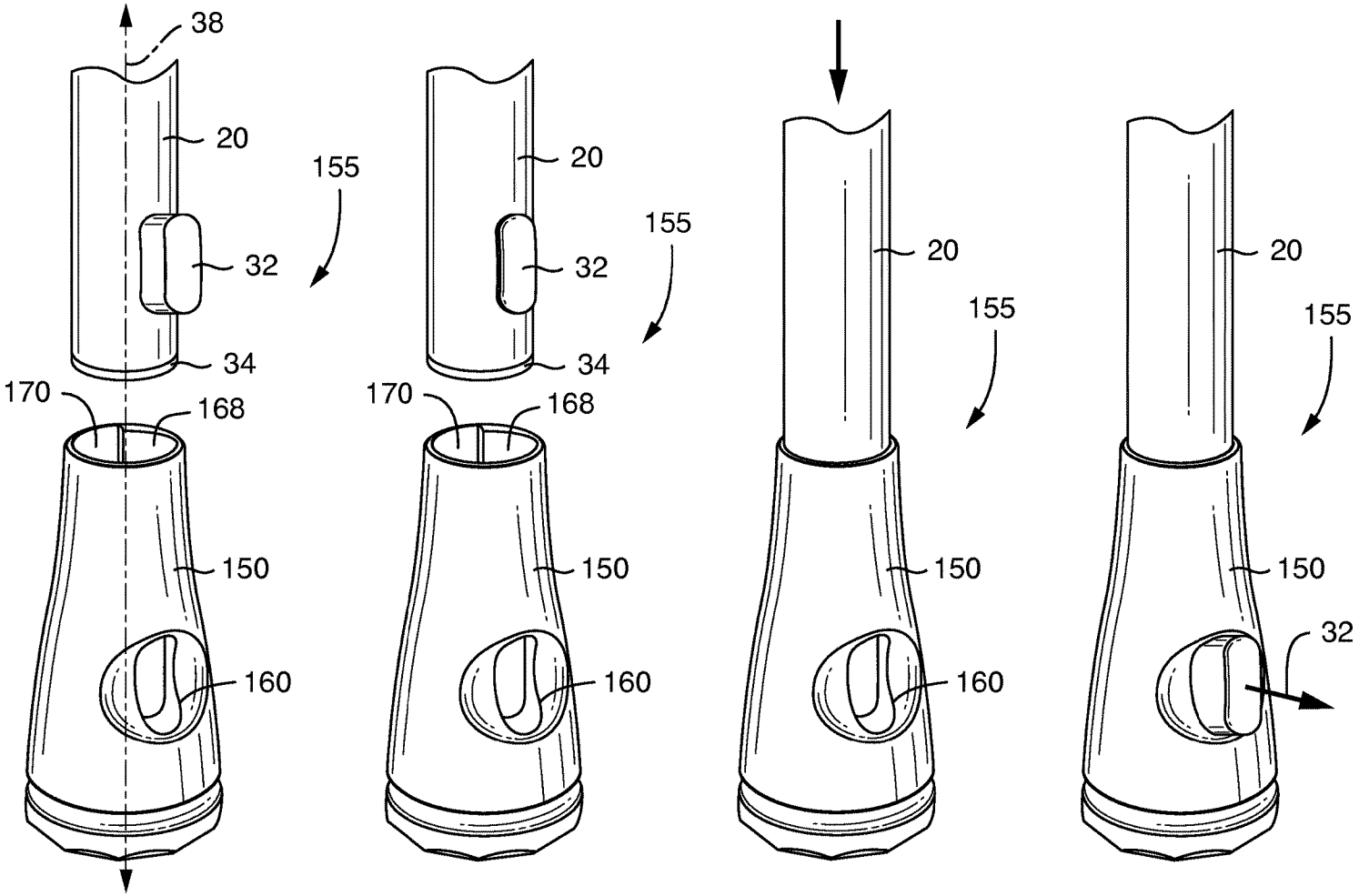
FIGS. 21A through 21D show a series of side perspective views of the foot of FIG. 10 being attached to the shaft of FIG. 2.

The operation of the foot replacement mechanism 155 is depicted in further detail in FIGS. 21A-21D. Referring first to FIG. 21A, the foot 150 is aligned so that the shaft 20 enters the socket 168. The latch button 32 aligns with aperture 160, which can be facilitated by guide 170 on the foot 150 and the ridge 35 on support post 34 coupled to the shaft 20, as discussed above and as illustrated in FIGS. 3B and 3C. As illustrated in FIG. 21B, the depressible latch button 32 can be depressed. As the shaft 20 fully extends into the foot 150 in FIG. 21C, the latch button spring 33 (not shown in FIG. 21C) that is internal to the shaft 20 pushes the depressible latch button 32 outward when the depressible latch button 32 comes to the longitudinal location of the latch aperture 160 and clicks into places, as shown in FIG. 21D.

Located at the bottom portion 156 of the foot 150 is an annular groove 162 and a sole 164. One purpose of the annular groove 162 is to allow the sole to flex when the foot 150 strikes a surface at an angle. The sole 164 may have a plurality of chamfered facings 166 located around the edge of sole 164. One purpose of the chamfered facings 166 is to provide a larger surface to make first contact with the ground when walking, and provide more friction than a non-chamfered edge or a continuous chamfer around the edge.

Figure 11:
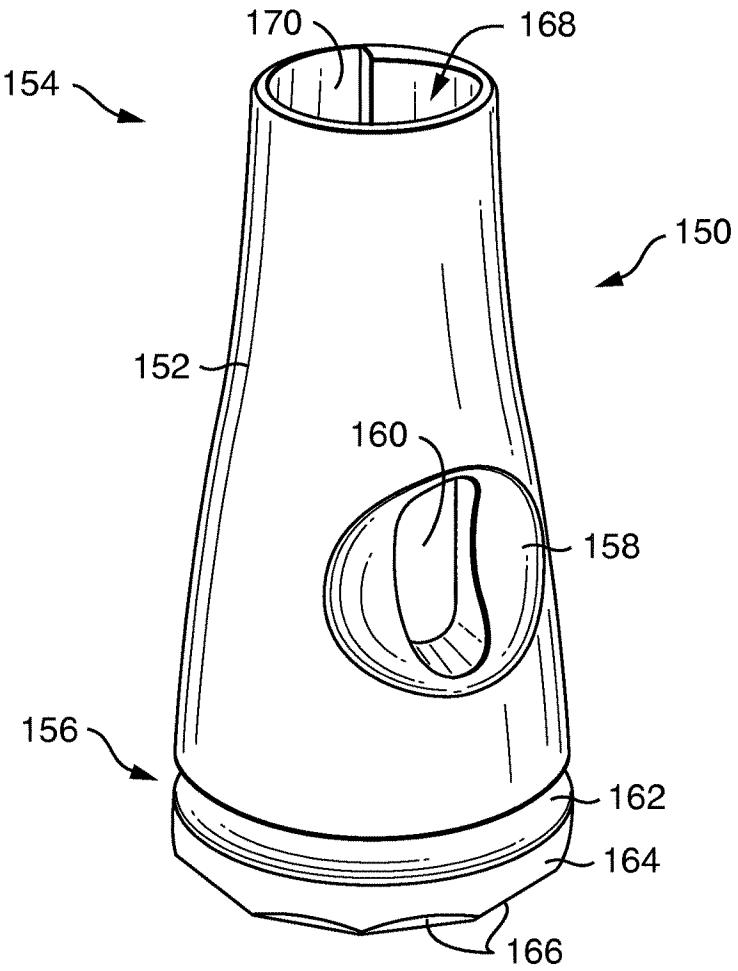
FIG. 11 is a front, left perspective view of the foot of FIG. 10.

FIG. 11 shows the features of FIG. 10 in addition to a view of the socket 168. It can be seen that there is a guide 170, which in one embodiment can be a channel that extends the length of the socket 168. The guide 170 accommodates the support post 34, which has a ridge 35 (as labeled in FIGS. 2, 3, 3B, and 3C) that fits into guide 170. The purpose of guide 170 is to align the shaft 20 so that the depressible latch button 32 fits into latch aperture 160 when the shaft 20 is fully inserted into socket 168. Of course, it is contemplated that the walking stick can be configured such that the guide 170 can be on the shaft 20 and the ridge 35 can be on the inner surface of the foot 150.

Figure 12:
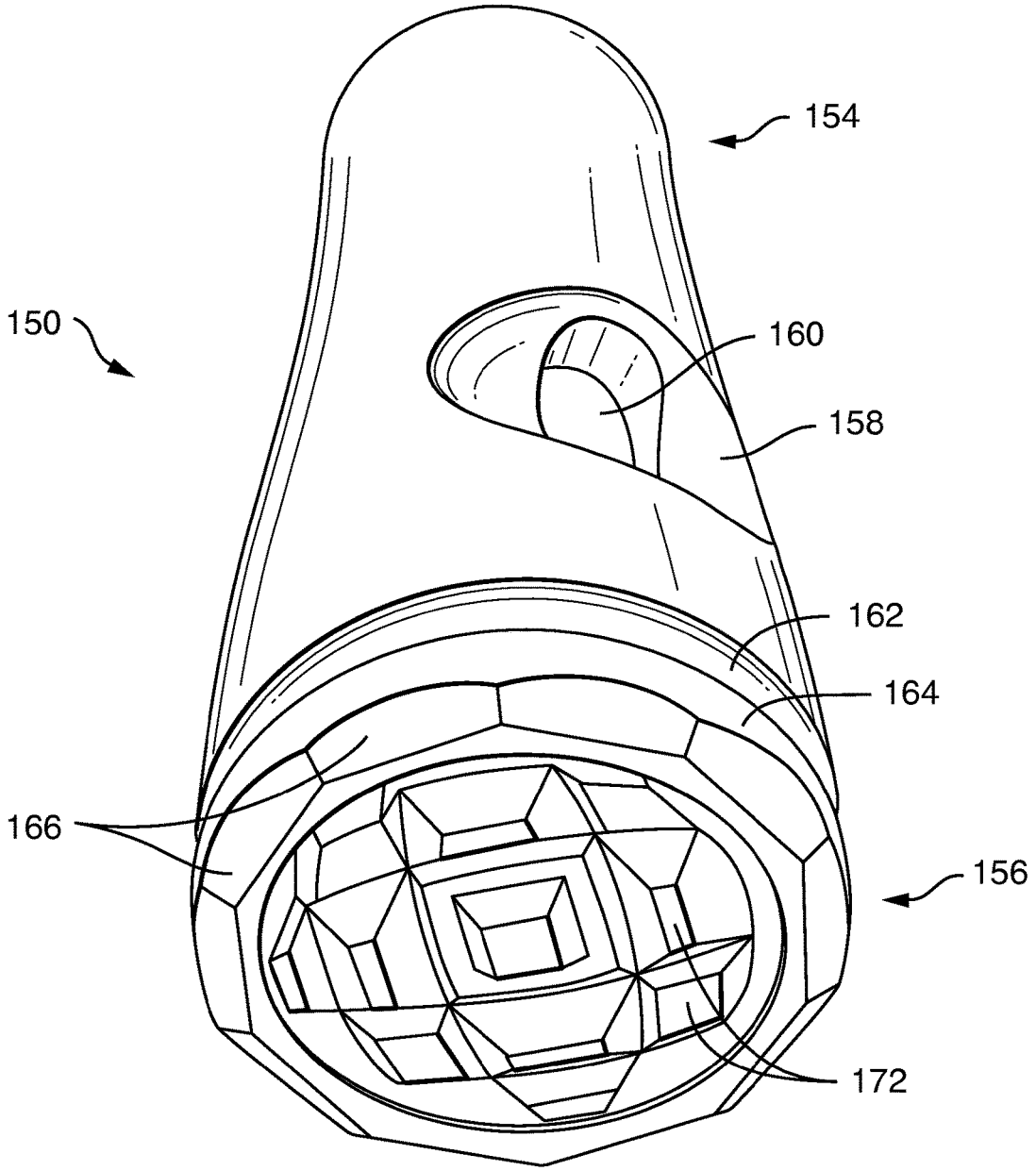
FIG. 12 is a bottom perspective view of the foot of FIG. 10.

Referring to FIGS. 3B, 3C, and 12, shown is the waffled bottom as defined by a plurality of studs 172. Studs 172 may be of any shape and number. It may be beneficial have the studs 172 lie in a plane above that which the sole 164 resides, as shown in the cross-sectional views of FIGS. 3B and 3C. It may also be beneficial to have the sole 164 surround the studs 172 in a ring formation. This will allow the sole 164 to flex more as it strikes a surface, thereby causing more surface area of the foot 150 to make contact with the surface.

B. Foot with Multiple Arms

Figure 13:
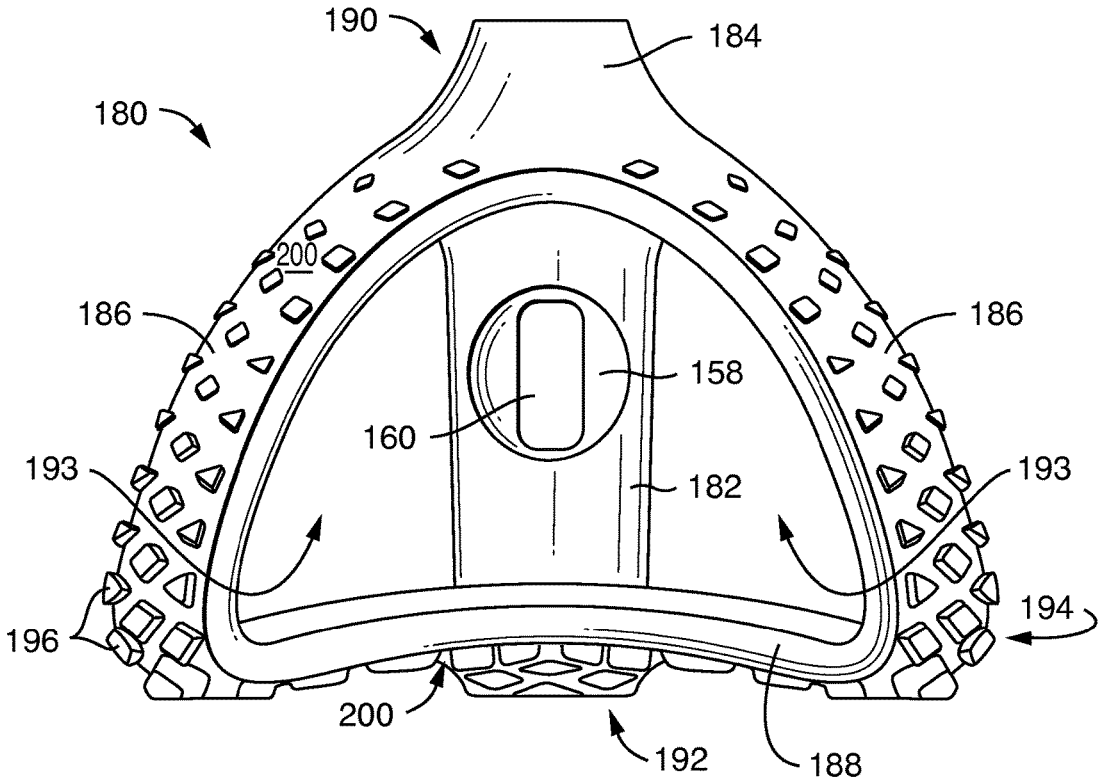
FIG. 13 is a first side elevation of a second foot embodiment of the present disclosure
Figure 14:
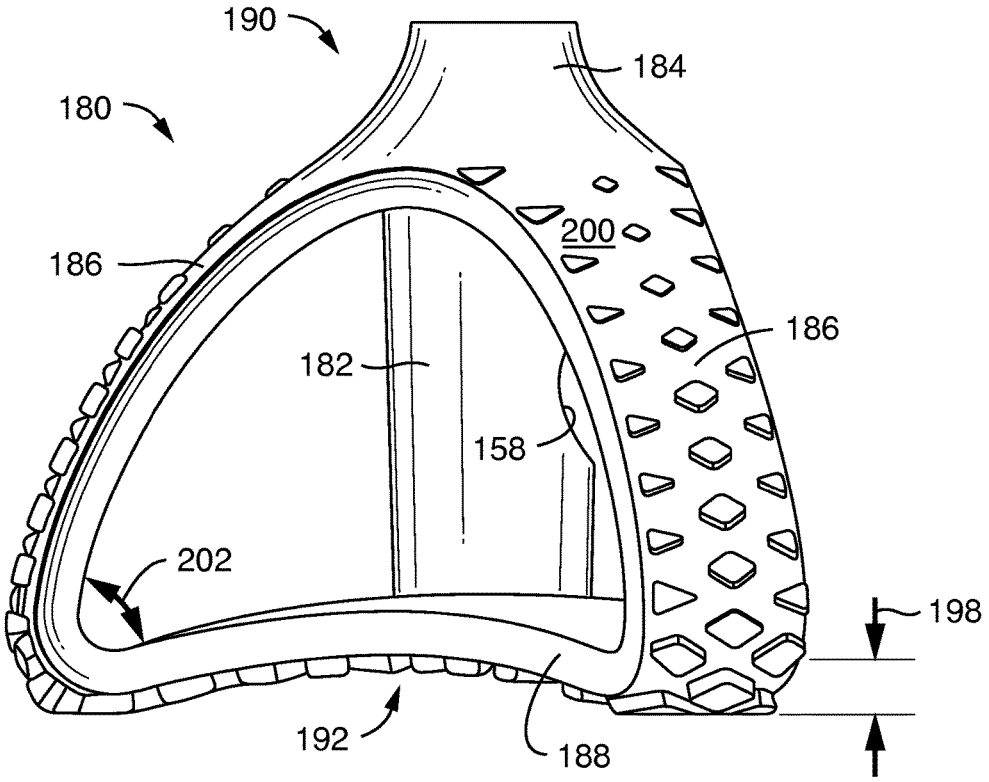
FIG. 14 is a second side elevation of the foot of FIG. 13, shown at a different angle.
Figure 15:
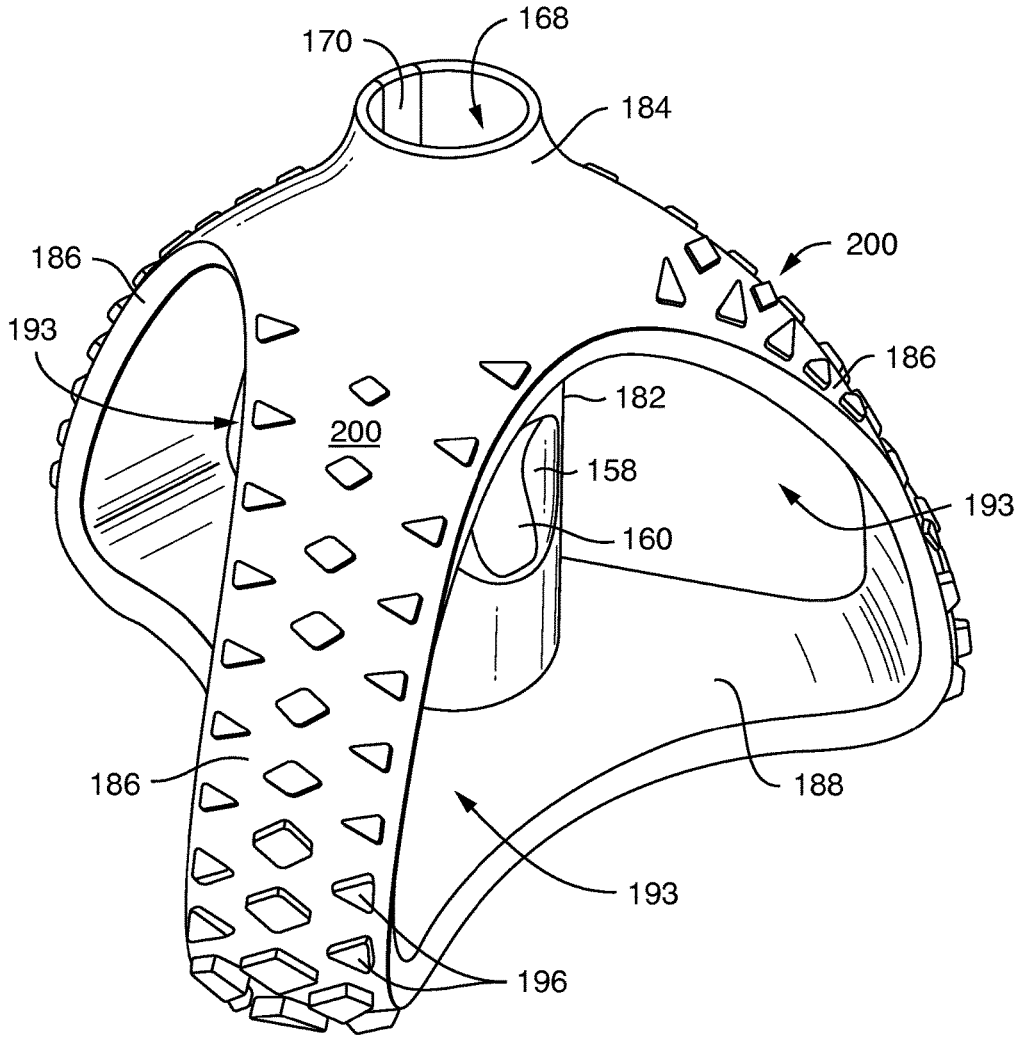
FIG. 15 is a top perspective view of the foot of FIG. 13.
Figure 16:
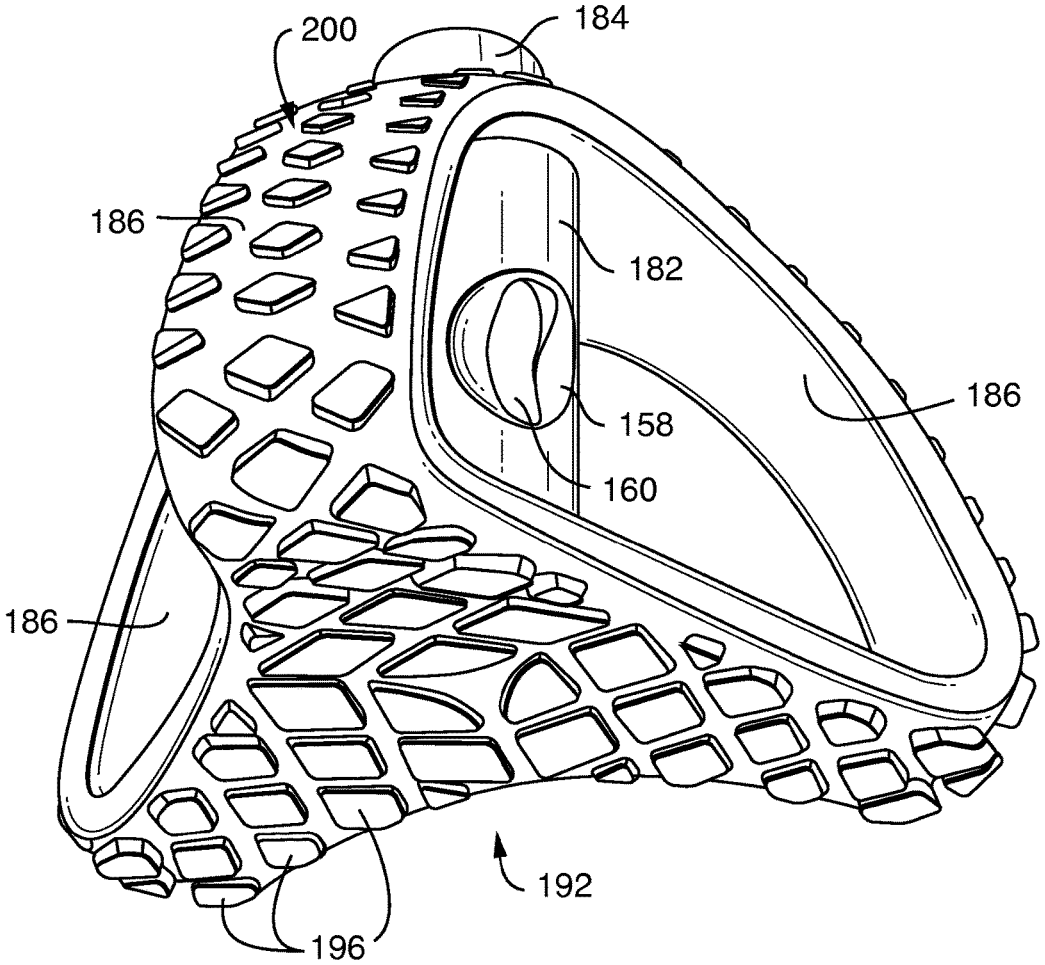
FIG. 16 is a bottom perspective view of the foot of FIG. 13.
Figure 31A:
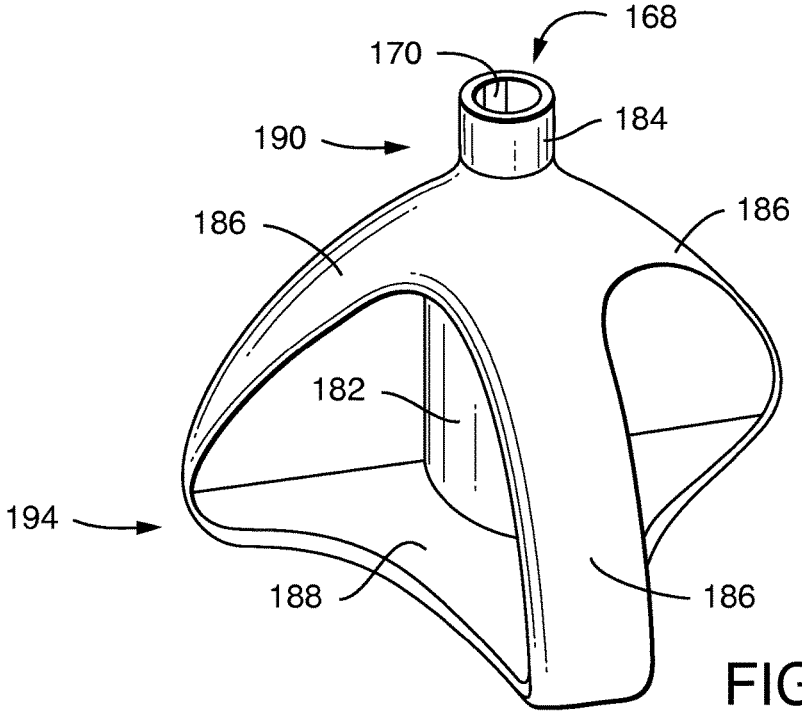
FIG. 31A is a perspective view of an alternative embodiment of a foot of the present disclosure.
Figure 31B:
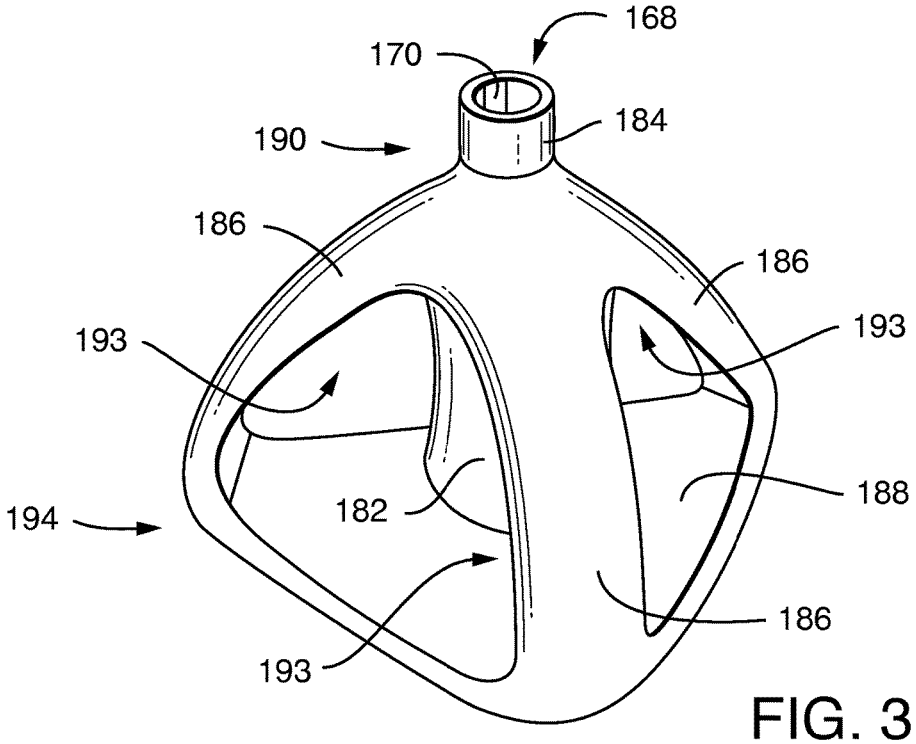
FIG. 31B is a perspective view of yet another alternative embodiment of a foot of the present disclosure.

In some embodiments, a foot 180 can include multiple arms 186. In preferred embodiments, the foot 180 can include at least two arms 186, and more preferably, three arms 186. One preferred embodiment of a foot 180 with multiple arms 186 is depicted in FIGS. 13-16 and 25-27 and can be described as a "tri-loop" foot. Generally, the term "tri-loop" refers to the three spaced arms 186 extending from the top portion 190 towards the bottom portion 194 and forming three loops 193. In some embodiments, the arms 186 can be equally spaced from one another. In some embodiments, the arms 186 can extend between the neck 184 of the main body 182 to a base 188. The arms 186 can be coupled together through the base 188, providing a rigidness to the foot 180. In a preferred embodiment, the base 188 can be triangular in shape. In a preferred embodiment, the base 188 can include concave arcs between arms 186 along the outer perimeter of the base 188, as illustrated in FIG. 15. However, in other embodiments, the base 188 can be triangular in shape and include convex arcs along the outer perimeter of the base 188, as illustrated in FIG. 31B.

The bottom surface 192 of the foot 180 can be arcuate to help provide more of a springy feel to the foot 180 when it strikes the ground. It also ensures that the outer points of the arms 186 make contact with the ground. FIGS. 13 and 14 illustrate the arcuate nature of the bottom surface 192 of the foot 180. For example, FIG. 14 illustrates that the bottom surface 192 can provide a depth 198.

Figure 26:
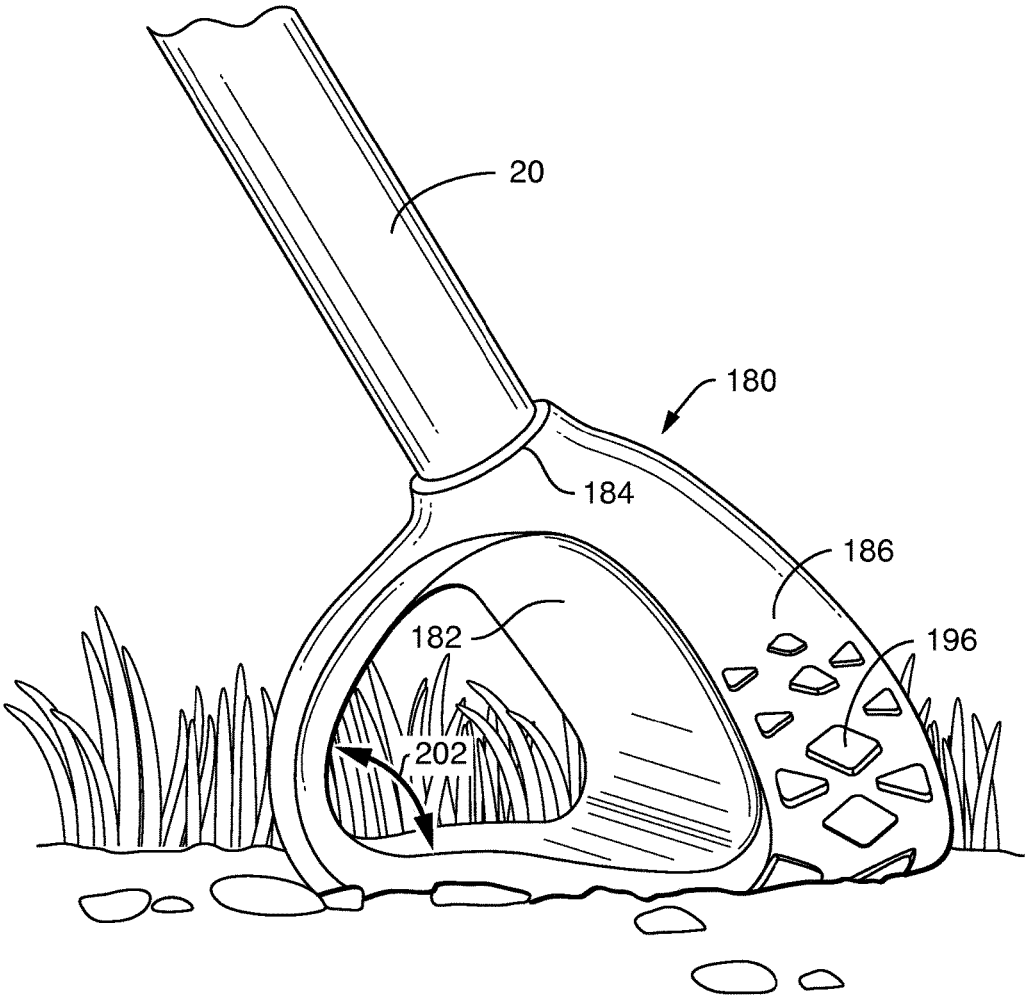
FIG. 26 depicts how the foot of FIG. 13 can deform in use.

Each joint 202 where an arm 186 connects to base 188 has a radius 202. As seen in FIG. 26, when the foot is in use, this radius can open up as the foot 180 flexes. Each loop 193 can provide flexibility for the foot 180 in this regard. However, because each arm 186 is coupled together at the base 188, the foot 180 can provide a rigid feel even though one or more arm 186 can flex at a time.

Figure 25:
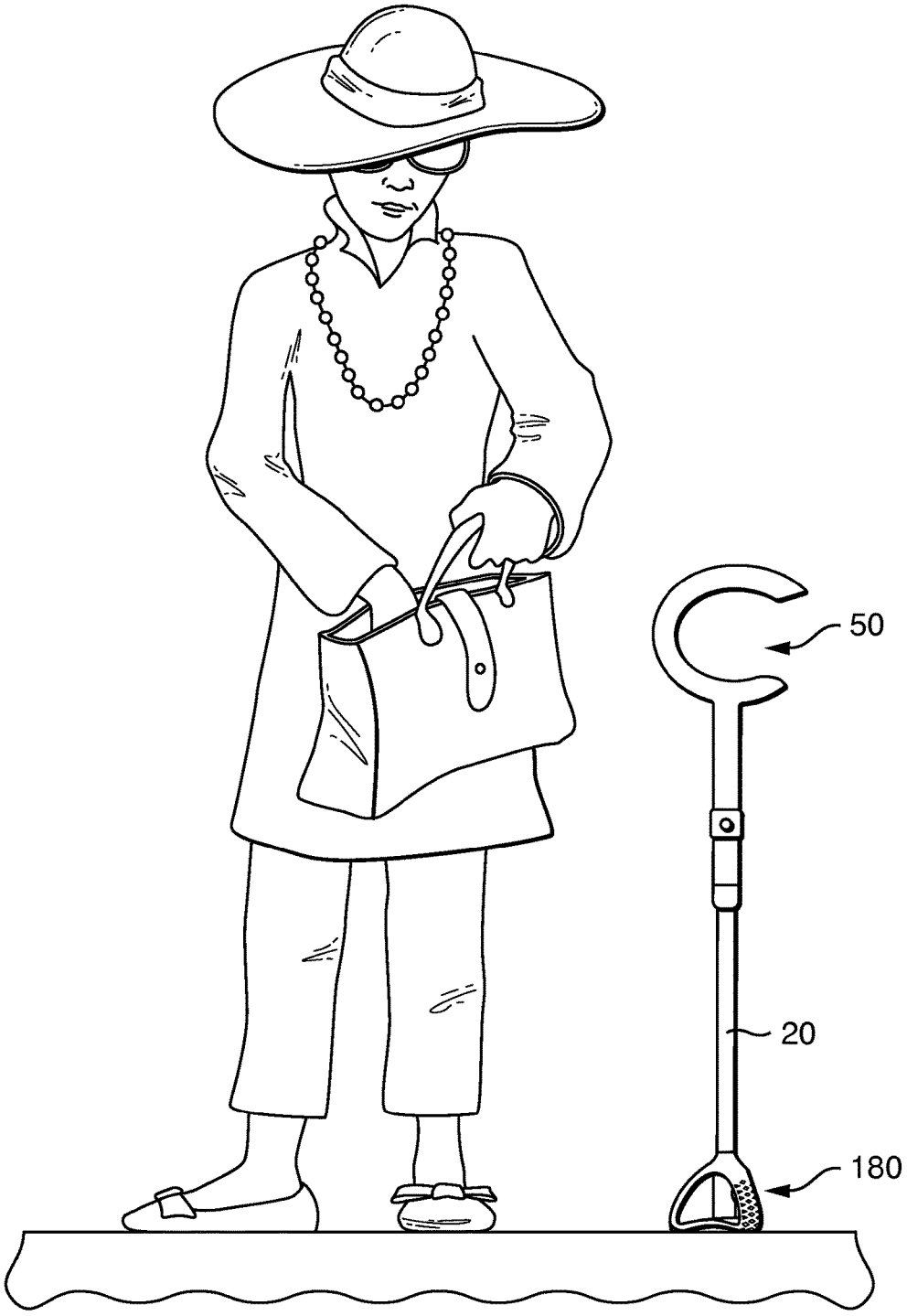
FIG. 25 depicts how the walking stick can stand independently with the foot of FIG. 13.
Figure 27:
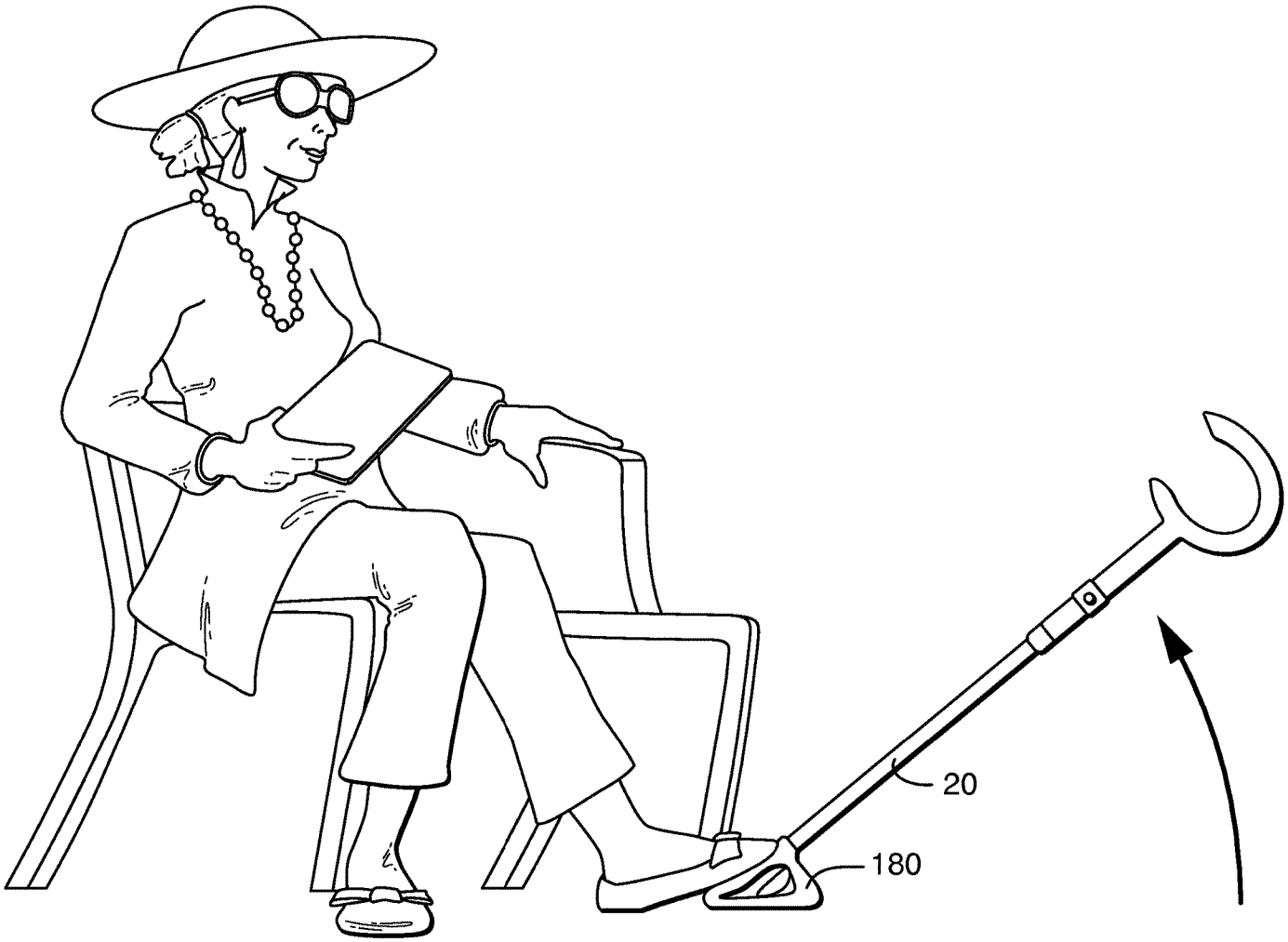
FIG. 27 depicts how a user can upright the walking stick be depressing the foot of FIG. 13.

As shown in FIG. 25, the tri-loop foot 180 allows a user to stand the walking stick upright so that they may attend to other activities. As seen in FIG. 26, the tri-loop foot 180 is quite deformable. In fact, as shown in FIG. 27, it is deformable in such a way that it can function as a lever. Should the stick fall to the ground, all a user needs to do is simply depress an arm 186 with their foot. This causes the stick to rise upright.

Referring specifically to FIGS. 13 and 14, some embodiments of the foot 180 can include a main body portion 182. The main body portion 182 may have a cylindrical shape. The main body portion 182 can extend from the top portion 190 to the bottom portion 194 such that the main body portion 182 extends all the way to the base 188. However, it is contemplated that the main body portion 182 need not extend all the way to the base 188, or that the foot 180 include a main body portion 182 at all.

In some embodiments, such as the foot 180 depicted in FIGS. 13-16 and 31B, the loops 193 can be formed between the respective arm 186, the main body portion 182, and the base 188. It can be appreciated that in some embodiments, not every arm 186 needs to form a loop 193. For example, it is contemplated that a foot 180 can include multiple arms 186, but not every arm 186 forms a loop 193. It is also contemplated that in some embodiments, a foot 180 with multiple arms 186 need not form any loops 193. For example, FIG. 31A depicts such an embodiment. The foot 180 in FIG. 31A includes three equally spaced arms 186 that extend from the top portion 190 towards the bottom portion 194. Each of the arms 186 can be coupled together through the base 188.

Figure 35A:
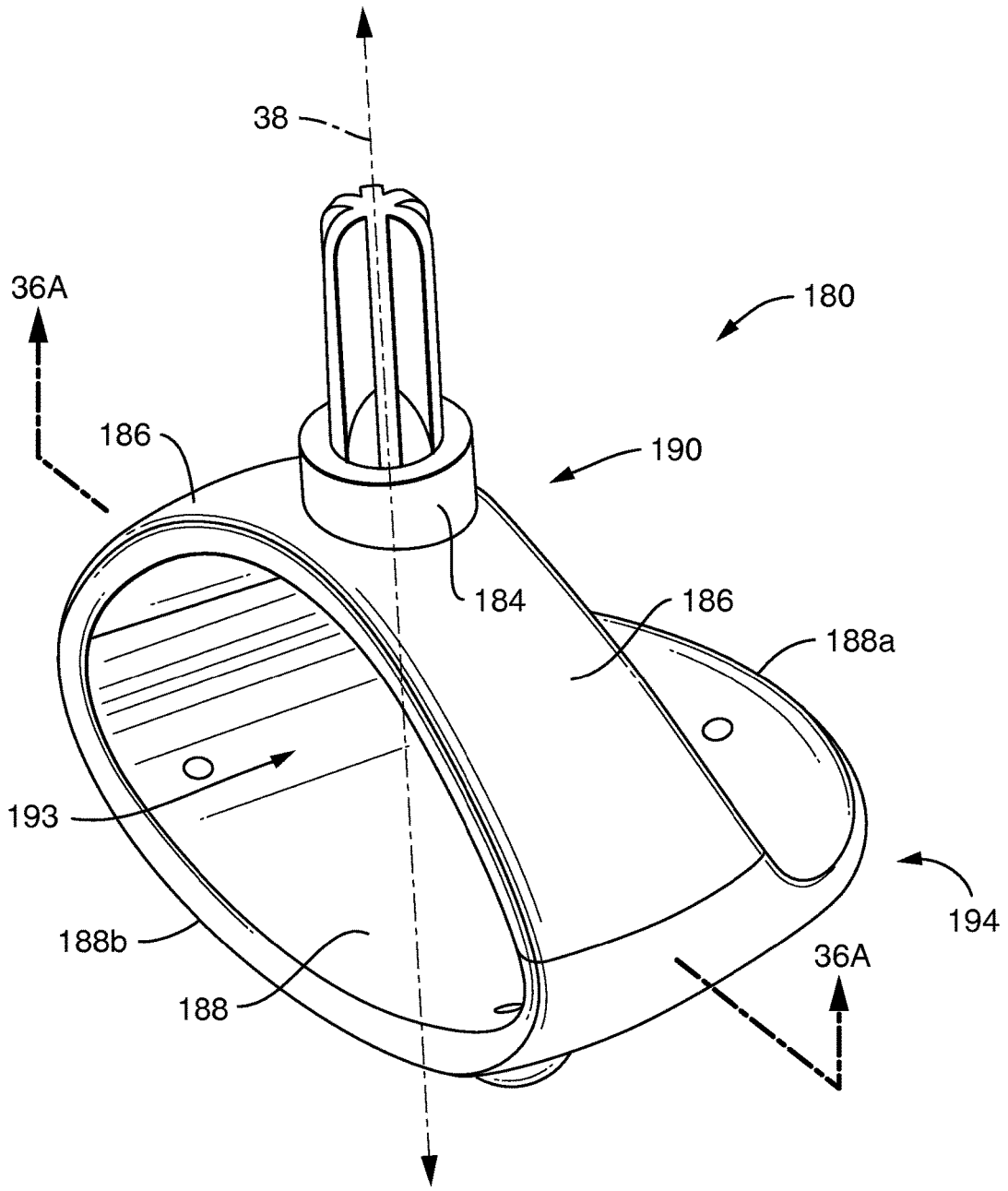
FIG. 35A is a top, perspective view of another embodiment of a foot of the present disclosure.
Figure 35B:
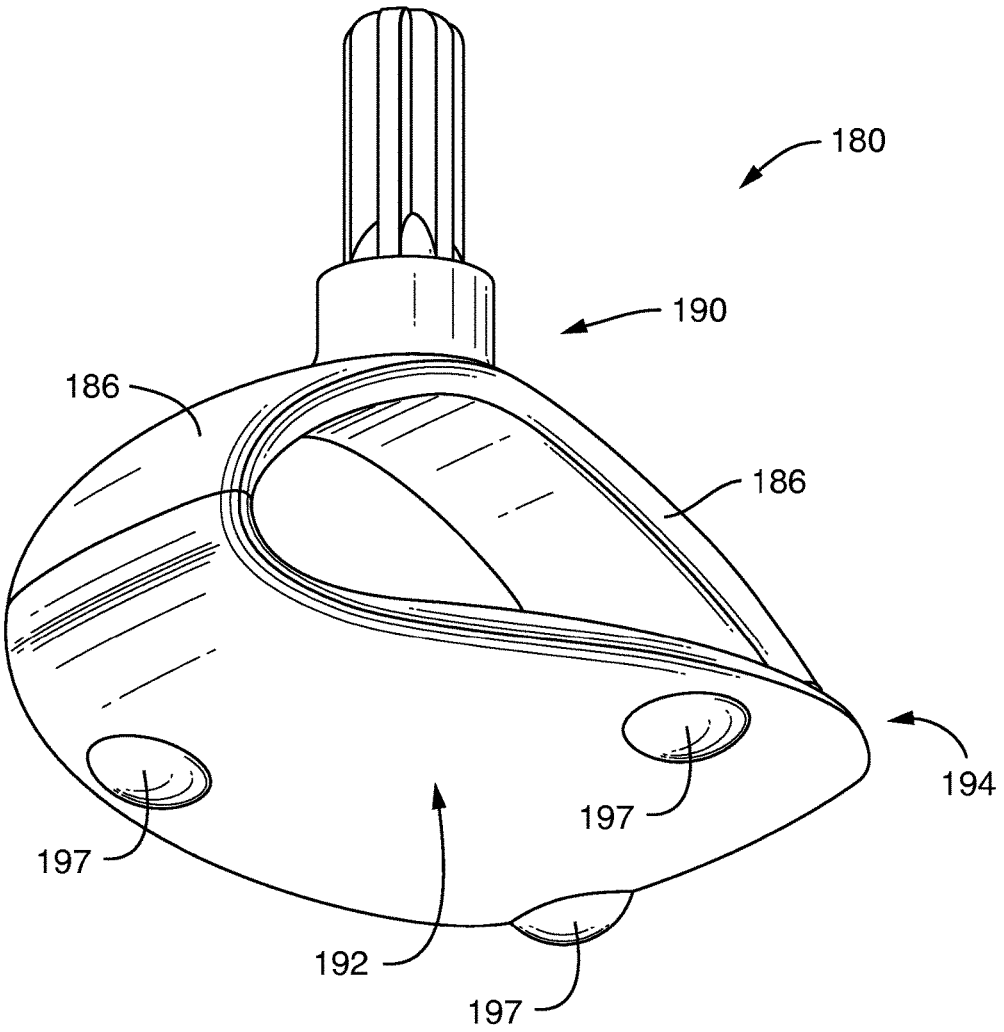
FIG. 35B is a bottom, perspective view of the foot of FIG. 35A.

Some embodiments of a foot 180 including multiple arms 186 can include only two arms 186, instead of three arms 186 as described above in prior embodiments. For example, FIGS. 35A-36B illustrate embodiments of a foot 180 including two arms 186. Each arm 186 can extend from the top portion 190 towards the bottom portion 194 and can extend to the base 188. The arms 186 can be coupled together through the base 188. In the embodiment of FIGS. 35A and 35B, the two arms 186 form a single loop 193. The loop 193 is formed between the two arms 186 and the base 188. The foot 180 in FIGS. 35A and 35B does not include a main body portion 182. As illustrated in FIGS. 35A and 35B, the base 188 can be non-symmetrical such that one side 188*a* of the base 188 extends further from the longitudinal axis 38 than the other side 188*b* of the base 188.

Referring back to FIGS. 15 and 16, the exterior surface 200 of arms 186 and base 188 may have a plurality of raised indicia 196. The primary purpose of the raised indicia is to provide traction between the ground and the base 188. However, it may be desirable to have traction on the surface of the arms 186 for the purpose of stepping on the foot 180 to lift the stick. See FIG. 27. The raised indicia 196 may be of any pattern: the pattern shown is just one embodiment. It is contemplated that the indicia 196 could include letters, numbers, geometric shapes, floral shapes, and the like.

Figure 36A:
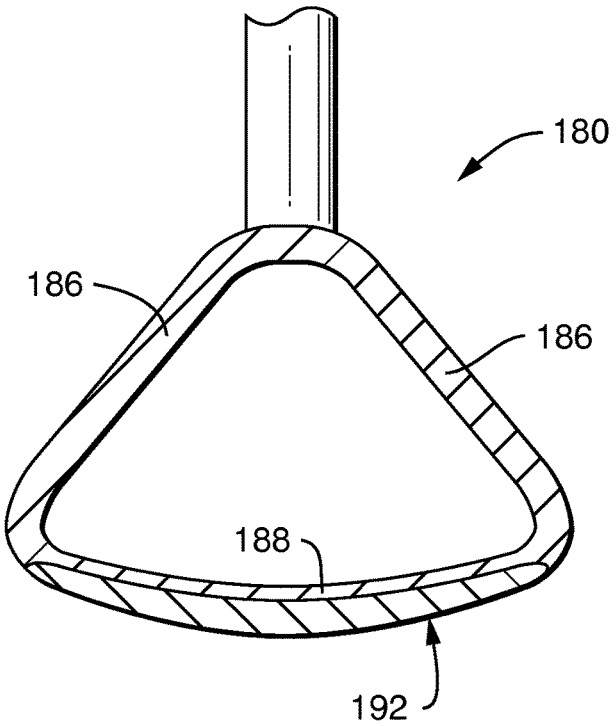
FIG. 36A is a cross-sectional view taken along line 36-36 from FIG. 35A.
Figure 36B:
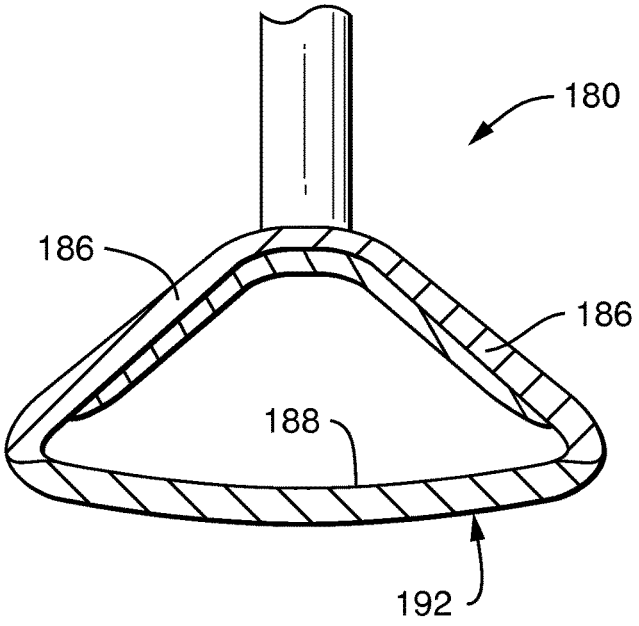
FIG. 36B is a cross-sectional view similar to FIG. 36A, but of an alternative embodiment of a foot of the present disclosure.
Figure 37:
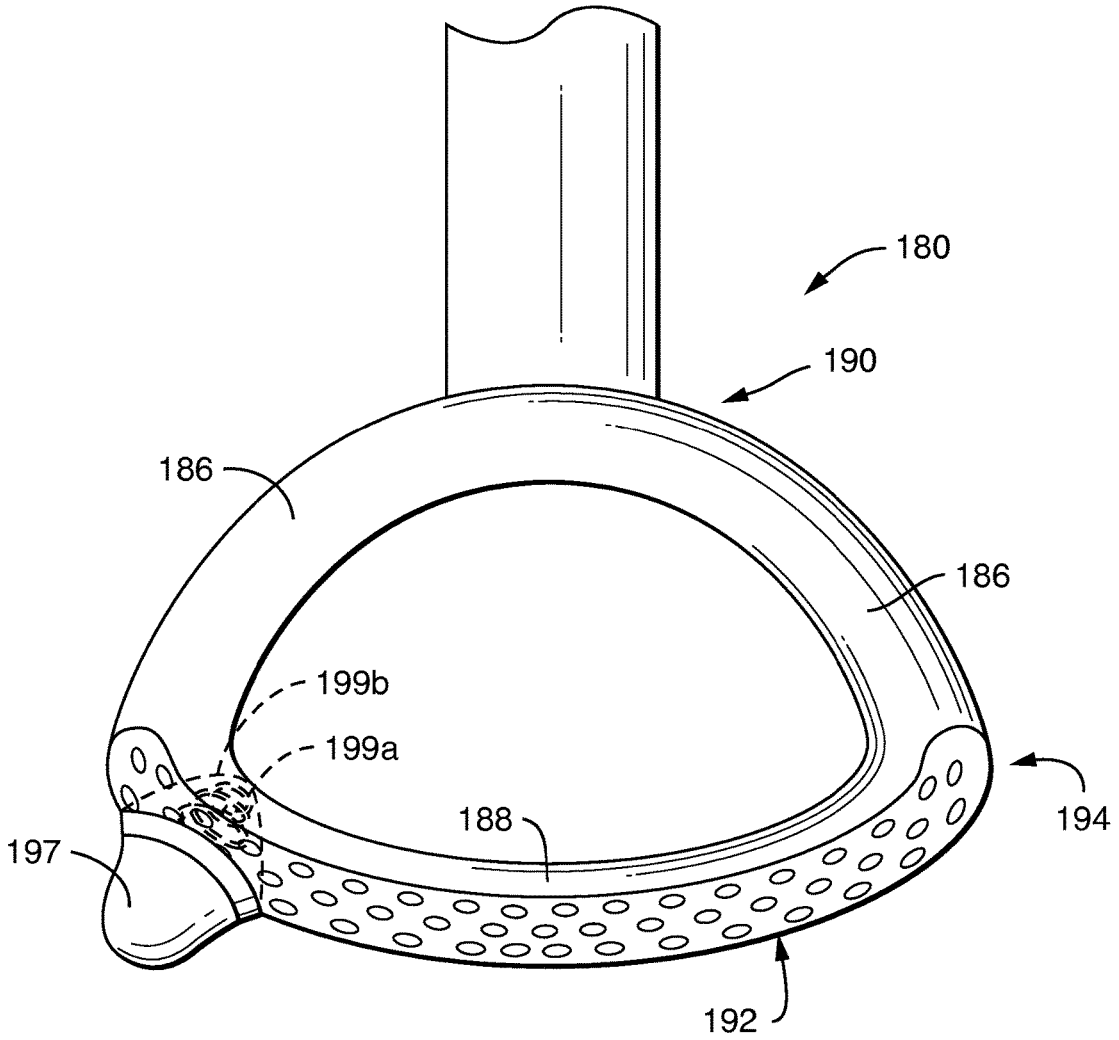
FIG. 37 is a front elevational view of another embodiment of a foot of the present disclosure.

Similarly, the embodiments of the foot 180 illustrated in FIGS. 35A-36B, and the embodiment of the foot 180 illustrated in FIG. 37, can include one or more projections 197 on the bottom surface 192 of the base 188. The projections 192 can be comprised of the same material that forms the base 188, or a different material. In some embodiments, such as the embodiment illustrated in FIG. 37, the projection 197 can include an internal spring 199*a* that can allow the projection 197 to flex as the user applies force to the projection 197 against the ground or another surface. The spring 199*a* can be housed within an internal cavity 199*b* in the projection 197 and/or base 188.

In some embodiments, the foot 180 can be comprised of more than one material. For example, in the embodiments depicted in FIGS. 35A-37, the foot 180 can include two different materials. As shown in the cross-sectional view of FIG. 36A illustrating the foot of FIG. 35A, the foot 180 can include a first material on the outer surface of the arms 186 and a second material on the inner surface of the arms 186 and the base 188. In some embodiments, the first material can be more rigid than the second material. For example, the first material could be a metal or hard plastic and the second material could be rubber. FIGS. 36B and 37 provide examples where the bottom surface 192 of the base 188 comprises a first material and the arms 186 and the upper surface of the base 188 comprise a second material. The materials can be optimized to provide desired properties of different features of the foot 180, such as strength and flexibility. Of course, it is contemplated that any of the feet 150, 180 described herein can be configured to have more than one material.

The embodiments of the foot 180 including multiple arms 186, at the top portion 190 of the foot 180 is the tapered neck 184. This is the entrance to socket 168. Like the single tip foot 150 described above, there is a guide 170 to guide the shaft 20 into the foot 180 via a ridge 35 on the support post 34 coupled to the shaft 20. In embodiments including a main body portion 182, the midsection of the main body 182 includes a thumb detent 158 and latch aperture 160, similar to the description above with respect to the single tip foot 150. In some embodiments, the foot 180 including multiple arms 186 and a main body portion 182 and the single tip foot 150 can be removably attached to the shaft 20 in the same manner as discussed above with respect to FIGS. 21A-21D.

Figure 32A:
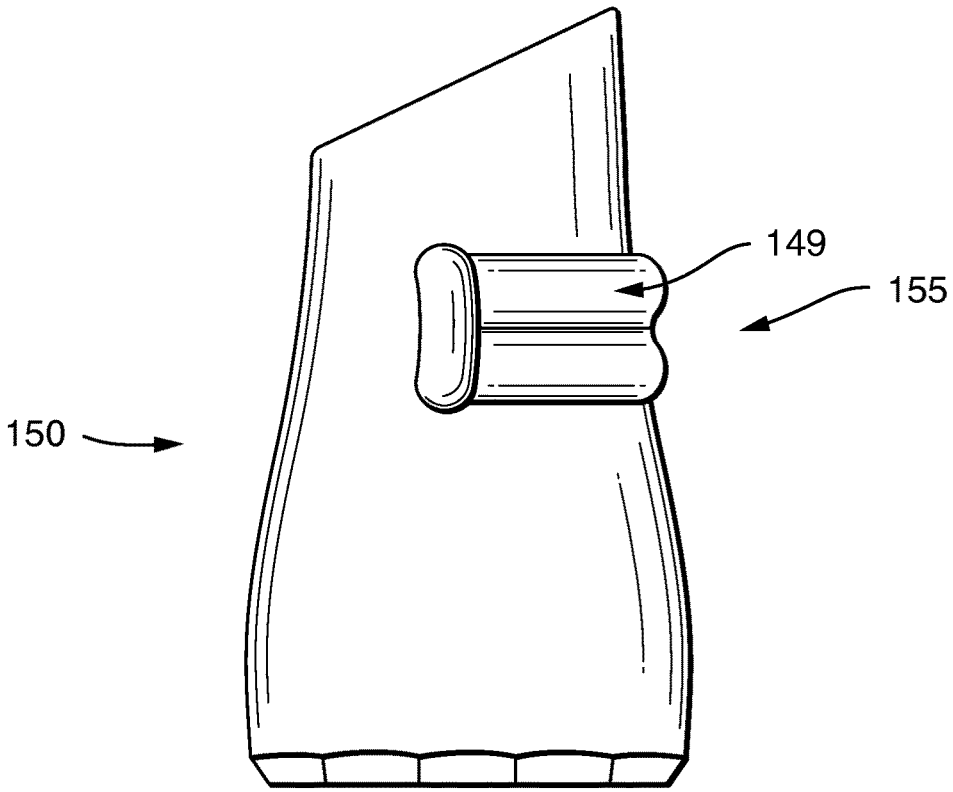
FIG. 32A is a side elevational view of an alternative embodiment of a foot replacement mechanism of the present disclosure.
Figure 32B:
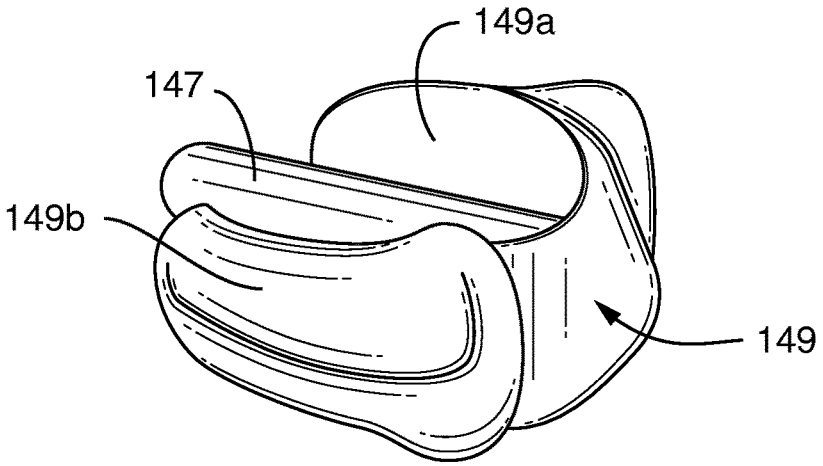
FIG. 32B is a perspective view of a feature of the foot replacement mechanism of FIG. 32A.
Figure 33A:
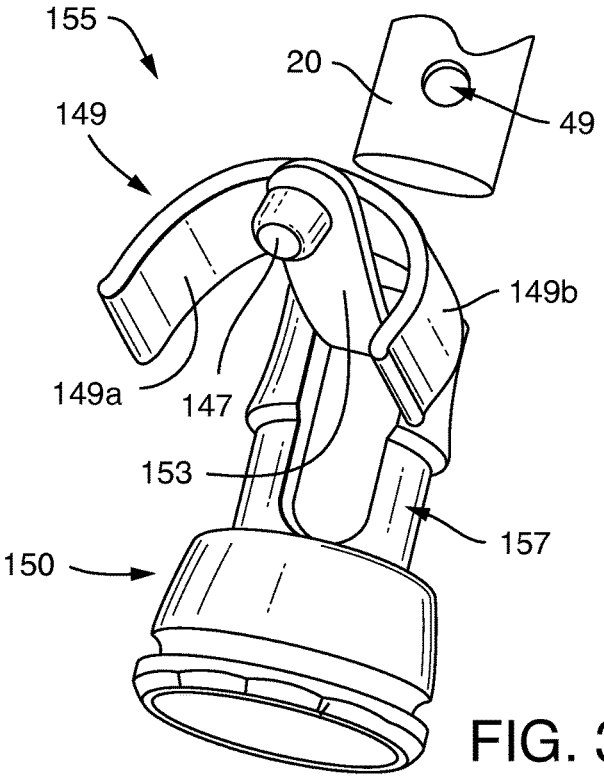
FIG. 33A is a perspective, exploded view of a foot, shaft, and another embodiment of a foot replacement mechanism of the present disclosure.
Figure 33B:
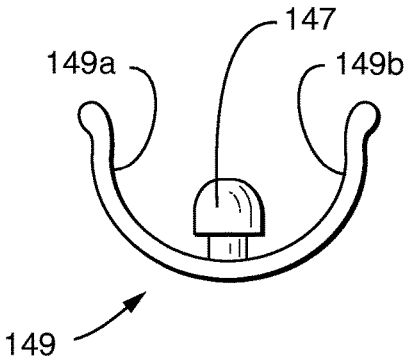
FIG. 33B is a top plan view of a feature of the foot replacement mechanism of FIG. 33A.
Figure 33C:
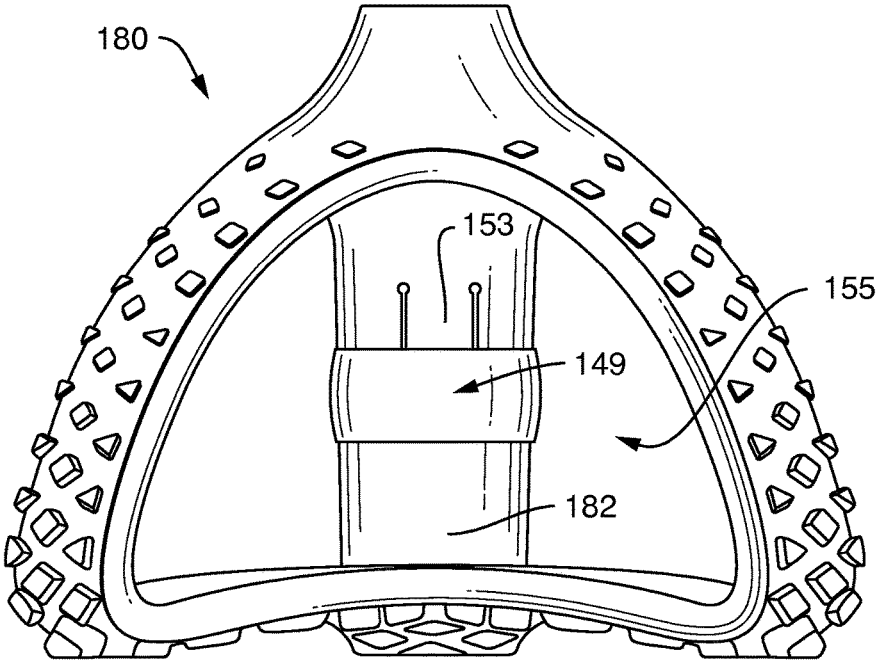
FIG. 33C is a front elevational view of another embodiment of a foot including the foot replacement mechanism of FIGS. 33A and 33B.

Feet 150, 180 can also be removably attached to the shaft 20 in various other foot replacement mechanisms 155. For example, FIGS. 32A-33C provide examples where the foot replacement mechanisms 155 can include a collar 149 having a pin 147. The collar 149 can have arms 149*a*, 149*b*, as illustrated in FIGS. 32B, 33A, and 33B. In the embodiment depicted in FIGS. 32A and 32B, the collar 149 can be integral with or coupled to the pin 147 and the collar 149 and pin 147 can be pushed laterally into the foot 150 and the latch aperture 49 in the shaft 20 (not shown). In the embodiment depicted in FIGS. 33A-33C, the pin 147 can be received by a flap 153 that forms part of the foot 150, 180. As illustrated in FIG. 33A, the pin 147 and the collar 149 can rotate such that the pin 147 enters the latch aperture 49 in the shaft 20. The arms 149*a*, 149*b* on collar 149 can fit within a recess 157 on the foot 150. A similar configuration can apply to the foot 180 illustrated in FIG. 33C.

Figure 34:
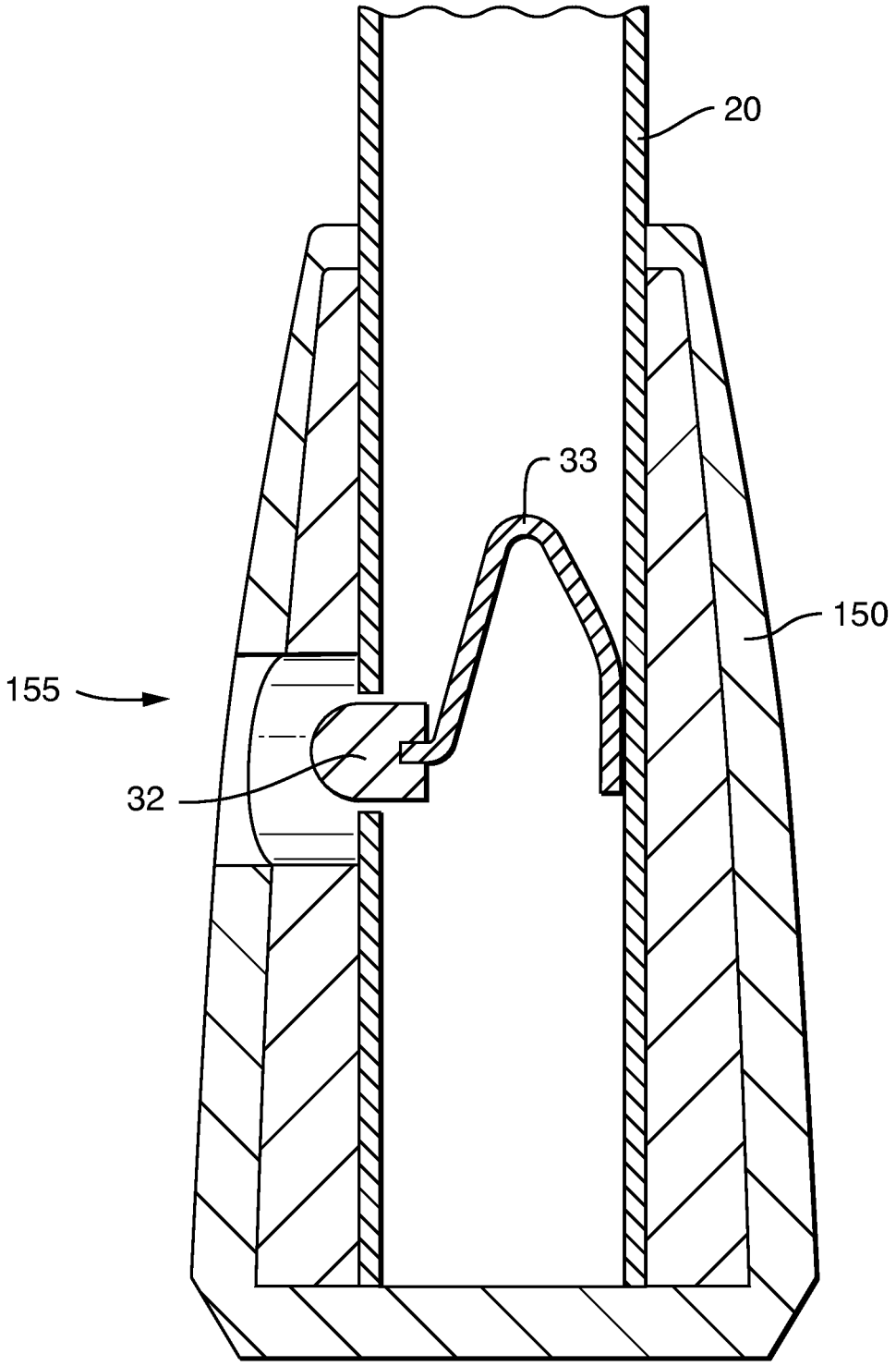
FIG. 34 is a cross-sectional view of a foot, shaft, and another embodiment of a foot removal mechanism of the present disclosure.

FIG. 34 provides a cross-sectional illustration of another configuration of a depressible latch button 32 and spring 33 of a foot replacement mechanism 155. As illustrated in FIG. 34, the spring 33 need not be a coil spring as shown in prior embodiments of the foot replacement mechanism 155. Instead, the depressible latch button 32 and spring 33 can be configured as a standard spring pin.

C. Removal Force Testing for Foot

FIGS. 38-41 depict exemplary set-up and equipment for Removal Force Testing to determine a Removal Force to remove a foot 150, 180 from the shaft 20 of the walking stick. Removal Force Testing for the walking stick is tensile testing that can be conducted in two different respects. First, Removal Force Testing can be conducted to determine at least a minimum Removal Force can be withstood for when the foot replacement mechanism 155 is engaged to keep the foot 150, 180 in place on the shaft 20. This determines how difficult it may be to remove the foot 150, 180 during normal using conditions. Second, Removal Force Testing can be conducted to determine a Removal Force for when the foot replacement mechanism 155 is disengaged for when a user would like to remove the foot 150, 180 from the shaft 20. Preferably, the Removal Force for when the foot replacement mechanism 155 is engaged is substantially higher than the Removal Force for when the foot replacement mechanism 155 is disengaged.

Figure 38:
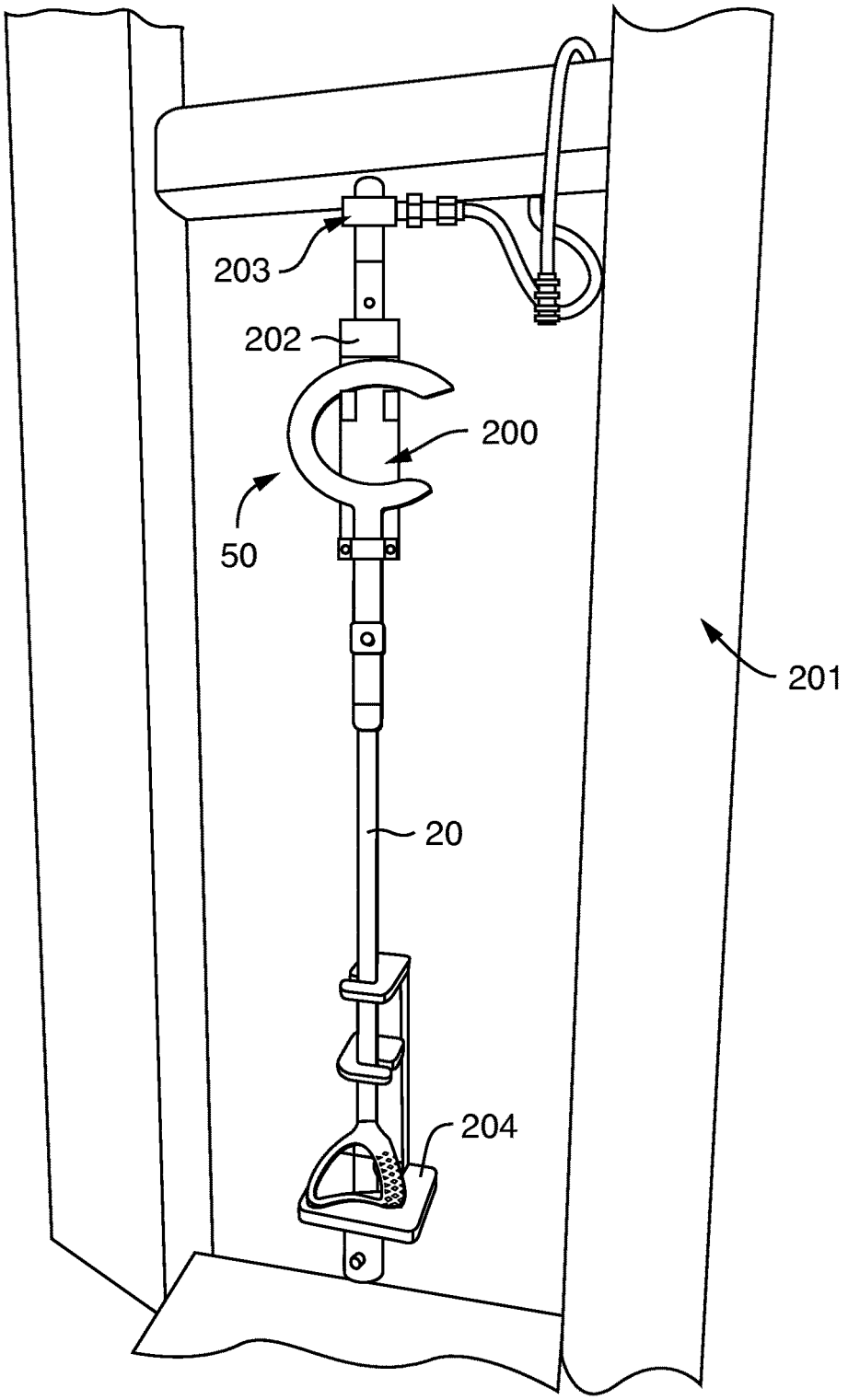
FIGS. 38-41 are perspective views of exemplary equipment for conducting Removal Force Testing.
Figure 39:
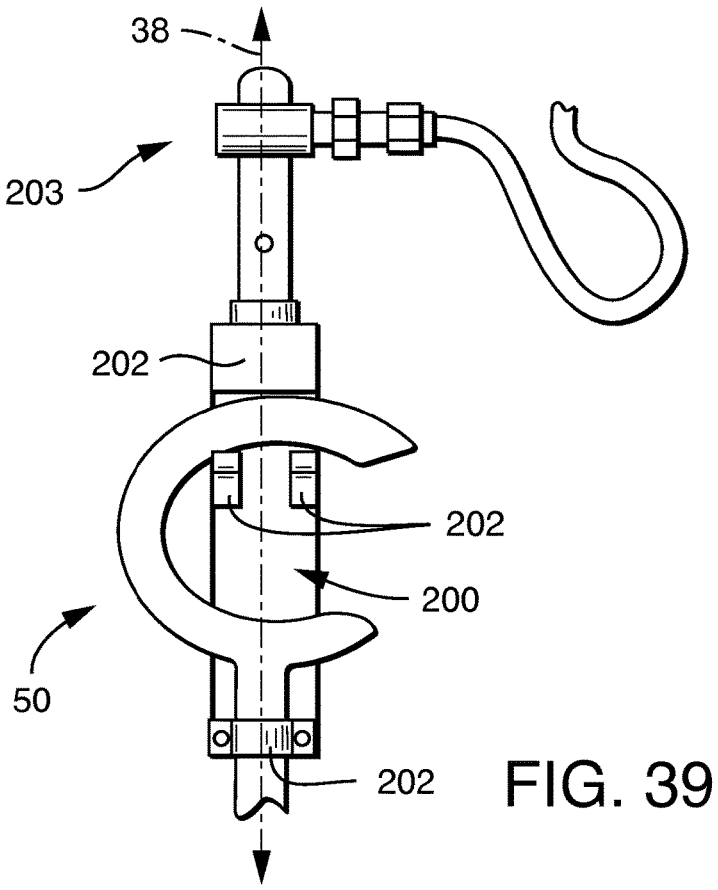
Figure 40:
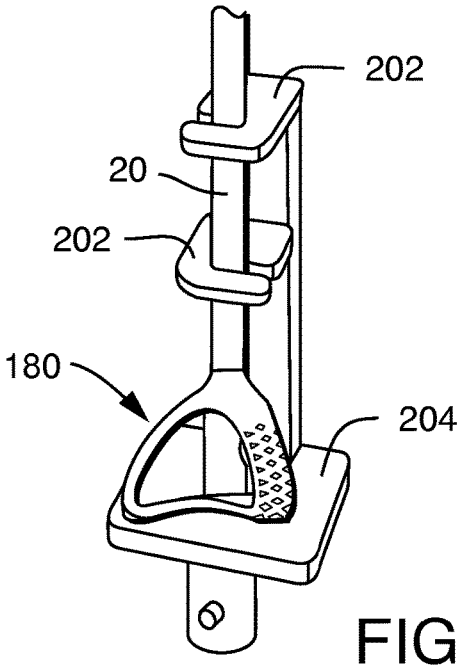

The Removal Force Testing can be conducted with an MTS Criterion load frame 201, such as illustrated in FIG. 38. The serial no. for the MTS Criterion load frame used for the Removal Force Testing conducted herein was #5000951. As illustrated in FIG. 39, the walking stick is connected via the handle 50 to a yoke 200 including guides 202. A load cell 203, such as a 500N load cell serial no. #746001, was connected to the uppermost guide 202 and connected to the cross-member of the MRS Criterion load frame 201. The Removal Force Testing should be conducted such that force applied to the walking stick is in alignment with the longitudinal axis 38 of the shaft 20. The guides 202 are used to ensure complete axial loading of the load cell and to protect again side-loading. As illustrated in FIG. 40, the shaft 20 can also be secured by a guide 202 near the foot 150. The yoke 200 can be configured such that the foot 150 hangs approximately two inches above base plate 204.

Figure 41:
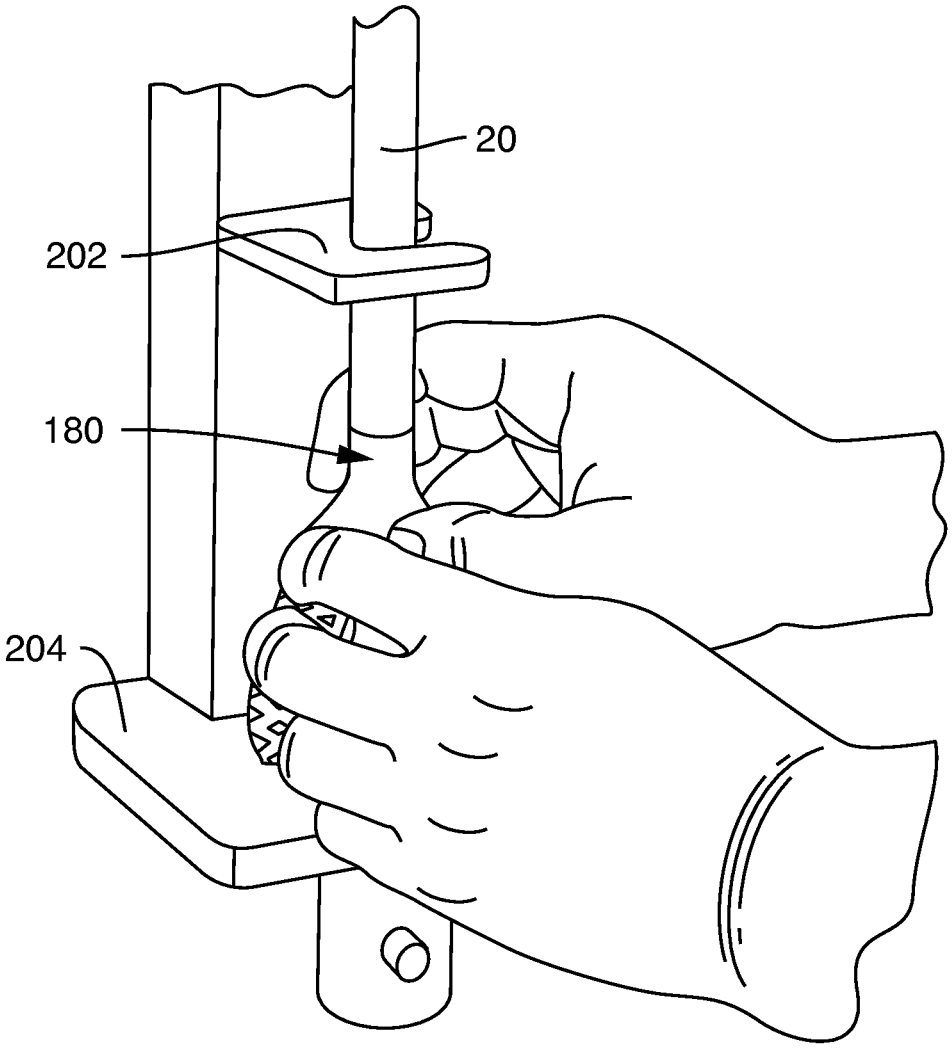

When conducting Removal Force Testing with the foot replacement mechanism 155 engaged, the top of the foot 150, 180 can be brought against the lowermost guide 202, such as the guide 202 shown in FIG. 41. When conducting Removal Force Testing with the foot replacement mechanism 155 is engaged, the tester does not depress the depressible latch button 32. When conducting Removal Force Testing with the foot replacement mechanism 155 disengaged, a tester manually grips the foot 150 firmly as illustrated in FIG. 41, applying equal force around the circumference of the foot 150. When conducting Removal Force Testing with the foot replacement mechanism 155 disengaged, the tester depresses the depressible latch button 32 and an assistant begins the tensile test so that a load can be applied to the foot replacement mechanism 155. In either configuration of the Removal Force Testing, the MTS Criterion load frame was configured to move the load at a test speed of 1 cm/minute.

When the foot replacement mechanism 155 was engaged under the Removal Force Testing as described above, it was verified that the foot 150, 180 could withstand a Removal Force of at least 30 lbf without the foot being removed. Thus, it was established that the foot 150, 180 can withstand at least 30 lbf in an axial direction without being removed from the shaft 20 when the foot replacement mechanism 155 was engaged.

Figure 42:
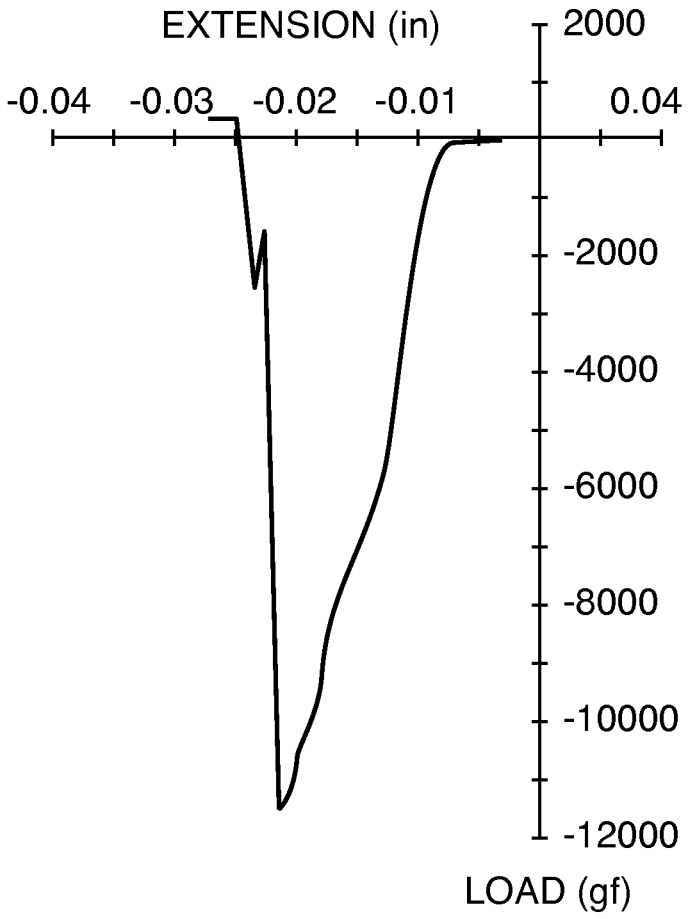
FIG. 42 is an example of an extension vs. load profile for the Removal Force Testing.

Removal Force values were also collected for three samples of a single tip foot 150 and three samples of a tri-loop foot 180 for when the foot replacement mechanism 155 was disengaged under the Removal Force Test as described above. TestWorks 4 software can be employed with the MTS Criterion load frame 201 and the load cell 203 to provide an extension vs. load profile, such as the exemplary profile illustrated in FIG. 42. The Removal Force is recorded as the absolute value of the peak load required to remove the foot 150, 180 from the shaft 20 during testing. For example, in FIG. 42, the Removal Force is the absolute value of the load located at the lowest point of the extension vs. load profile. The Removal Force can initially be calculated in grams, however, it can be converted to any other suitable unit, such as pounds-force (lbf), as known by those of skill in the art. Table 1 below shows the values for this Removal Force Testing. The single tip foot 150 had an average Removal Force of 19.99 lbf after three samples. The tri-loop foot 180 had an average Removal Force of 5.06 lbf after three samples. When the foot replacement mechanism 155 is disengaged to allow the foot 150, 180 to be removed from the shaft 20, it is preferable if a Removal Force is less than about 30 lbf, preferably less than about 25 lbf, and more preferably less than about 20 lbf. In even more preferred embodiments, it is beneficial to have a Removal Force less than about 15 lbf, and even more preferable, to have a Removal Force less than about 10 lbf, when the foot replacement mechanism 155 is disengaged to allow the foot 150, 180 to be removed from the shaft 20. A preferable range for a Removal Force when the foot replacement mechanism 155 is disengaged is about 1 lbf to about 25 lbf, more preferably about 1 lbf to about 20 lbf, and even more preferably 1 lbf to about 10 lbf. This allows a user to remove the foot 150, 180 from the shaft 20 without the use of tools and with minimal force, which may be beneficial for certain individuals that are using a walking stick having limited strength and/or dexterity.

TABLE 1

| Foot Type | Removal Force (lbf) |
|---|---|
| Single Tip Foot | 14.99 |
| Single Tip Foot | 20.72 |
| Single Tip Foot | 24.25 |
| Average for Single Tip Foot | 19.99 |
| Tri-loop Foot | 5.50 |
| Tri-loop Foot | 4.40 |
| Tri-loop Foot | 5.29 |
| Average for Tri-loop Foot | 5.06 |

Embodiments

Embodiment 1

A walking stick comprising: a handle comprising a head, the head including at least one internal reinforcement member, the at least one internal reinforcement member having a shape that is substantially the same as a shape of the head; a shaft; and a foot for engaging the ground, the foot being coupled to the shaft.

Embodiment 2

The walking stick of embodiment 1, wherein the head further includes a pair of clam shell members, the at least one internal reinforcement member being disposed within the pair of clam shell members.

Embodiment 3

The walking stick of any one of the preceding embodiments, wherein the at least one internal reinforcement member includes a plurality of apertures.

Embodiment 4

The walking stick of any one of the preceding embodiments, further comprising a neck, wherein the head is separate from the neck and the neck is coupled to the head, and wherein the shaft is separate from the handle and the shaft is coupled to the handle.

Embodiment 5

The walking stick of embodiment 2, wherein at least a portion of each of the pair of clam shell members are received within the neck.

Embodiment 6

The walking stick of any one of the preceding embodiments, the handle further includes an overmold, the overmold fitting over at least the head.

Embodiment 7

The walking stick of embodiment 6, wherein the overmold fits over the neck.

Embodiment 8

The walking stick of embodiment 7, wherein the overmold is comprised of a first component and a second component, the first component fitting over the head and at least a first portion of the neck, the second component fitting over at least a second portion of the neck.

Embodiment 9

The walking stick of embodiment 6, wherein the overmold includes at least one finger detent, the at least one finger detent is aligned substantially parallel to a longitudinal axis of the shaft.

Embodiment 10

A walking stick comprising: a handle comprising a head, a neck, and a height adjustment mechanism, the height adjustment mechanism including a pin and a height aperture sized to receive the pin; a shaft, the shaft including a plurality of height adjustment holes, the plurality of height adjustment holes sized to receive the pin of the height adjustment mechanism; a friction plug coupled to the shaft, the friction plug longitudinally aligning the shaft with the handle such that a user can longitudinally move the shaft with respect to the handle and maintain rotational alignment between the height adjustment holes of the shaft and the height aperture of the handle; and a foot for engaging the ground, the foot being coupled to the shaft.

Embodiment 11

The walking stick of embodiment 10, wherein the handle further comprises a neck, the neck including ribs that engage with ribs disposed on the friction plug to prevent rotation of the shaft with respect to the handle when the user longitudinally moves the shaft with respect to the handle.

Embodiment 12

The walking stick of embodiment 11, wherein the neck includes the height aperture of the handle.

Embodiment 13

The walking stick of embodiment 12, wherein the height adjustment mechanism further comprises a throat sleeve including a flap coupled to the pin, the throat sleeve being received on the neck in a position near the height aperture.

Embodiment 14

The walking stick of embodiment 10 or embodiment 12, wherein the height adjustment mechanism further includes a sliding collar, the sliding collar including a channel that provides a snap fit with the pin when the pin rests in the height aperture and one of the plurality of height adjustment holes of the shaft.

Embodiment 15

The walking stick of any one of embodiments 10-14, wherein the handle further comprises an overmold, the overmold fitting over the head and at least a portion of the neck.

Embodiment 16

The walking stick of any one of embodiments 10-15, wherein the head further includes a pair of clam shell members and at least one internal reinforcement member disposed within the pair of claim shell members.

Embodiment 17

A walking stick comprising: a handle comprising a head and a neck, the head and the neck intersecting at an intersection point, the head including an upper portion and a lower portion in the configuration of a C-shape, the upper portion having a first end and the lower portion having a second end, the C-shape being configured such that the second end of the lower portion is disposed laterally outward from the intersection point of the head and the neck of the handle; a shaft; and a foot for engaging the ground, the foot being coupled to the shaft.

Embodiment 18

The walking stick of embodiment 17, wherein the second end of the lower portion of the head is disposed at least about 20 millimeters away from an outer surface of the neck at the intersection point.

Embodiment 19

The walking stick of embodiment 17 or embodiment 18, wherein the first end of the upper portion of the head is disposed laterally further away from a longitudinal axis of the walking stick than is the second end of the lower portion of the head.

Embodiment 20

The walking stick of any one of embodiments 17-19, wherein the upper portion includes a boss on an underside of the upper portion of the head.

Embodiment 21

The walking stick of embodiment 20, wherein there is only one boss on the underside of the upper portion of the head.

Embodiment 22

The walking stick of embodiment 20 or embodiment 21, wherein an outer edge of the boss is between about 10 millimeters and about 50 millimeters laterally away from the first end of the upper portion of the head.

Embodiment 23

A walking stick comprising: a handle for providing a user with a position to grasp the walking stick; a shaft; and a foot for engaging the ground, the foot being coupled to the shaft, the foot comprising: a top portion; a bottom portion, the bottom portion including a base, and at least two arms extending from the top portion towards the bottom portion, each of the at least two arms being coupled together through the base.

Embodiment 24

The walking stick of embodiment 23, wherein the foot comprises at least three arms extending from the top portion towards the bottom portion, each of the at least three arms being coupled together through the base.

Embodiment 25

The walking stick of embodiment 23, wherein each of the at least two arms provides a loop between the respective arm, the main body portion, and the base.

Embodiment 26

The walking stick of any one of embodiments 23-25, wherein the foot further comprises a main body portion, the main body portion extending from the top portion towards the base.

Embodiment 27

The walking stick of embodiment 26, wherein the main body portion extends from the top portion to the base of the bottom portion.

Embodiment 28

The walking stick of embodiment 26 or embodiment 27, wherein the top portion includes a socket for receiving the shaft.

Embodiment 29

The walking stick of any one of embodiments 26-28, wherein the main body portion includes a thumb detent and a latch aperture, and wherein the shaft includes a depressible latch button, the depressible latch button being received in the latch aperture to couple the foot to the shaft.

Embodiment 30

The walking stick of any one of embodiments 23-29, wherein the base provides an arcuate bottom surface for the foot.

Embodiment 31

The walking stick of any one of embodiments 23-30, wherein the base includes an outer perimeter, the outer perimeter including concave arcs between the at least two arms.

Embodiment 32

The walking stick of any one of embodiments 23-32, wherein at least one of the base and the at least two arms include raised indicia.

Embodiment 33

A walking stick comprising: a handle for providing a user with a position to grasp the walking stick; a shaft; and a foot for engaging the ground, the foot being coupled to the shaft, the foot comprising: a top portion, a bottom portion, the bottom portion including a base, and at least two arms extending from the top portion towards the bottom portion, at least one loop being formed between the at least two arms and the base.

Embodiment 34

The walking stick of embodiment 33, wherein the foot comprises at least three arms extending from the top portion towards the bottom portion, each of the at least three arms providing a loop between the respective arm and the base.

Embodiment 35

The walking stick of any one of embodiments 33-34, wherein the foot further comprises a main body portion, the main body portion extending from the top portion towards the base of the bottom portion, and wherein the top portion includes a socket for receiving the shaft.

Embodiment 36

The walking stick of embodiment 35, wherein the main body portion extends from the top portion to the base of the bottom portion, and wherein each of the at least two arms provides a loop between the respective arm, the main body portion, and the base.

Embodiment 37

The walking stick of any one of embodiments 33-36, wherein the main body portion includes a thumb detent and a latch aperture, and wherein the shaft includes a depressible latch button, the depressible latch button being received in the latch aperture to couple the foot to the shaft.

Embodiment 38

The walking stick of embodiment 34, wherein each of the at least three arms are coupled together through the base.

Embodiment 39

A walking stick comprising: a handle for providing a user with a position to grasp the walking stick; a shaft; and a foot for engaging the ground, the foot including a top portion, a main body portion, and a bottom portion, the top portion including a socket for receiving to the shaft; and a foot replacement mechanism, the foot replacement mechanism comprising: a depressible latch button, a spring, the spring being disposed within the shaft and engaging the depressible latch button, the depressible latch button extending through an aperture in the shaft; and a latch aperture in the main body portion of the foot for receiving the depressible latch button.

Embodiment 40

The walking stick of embodiment 39, wherein the shaft includes a support post with one of a ridge and a guide, and the socket of the foot includes the other of a ridge and a guide to receive the one of a ridge and a guide of the support post in the shaft and align the depressible latch button with the latch aperture in the foot.

Embodiment 41

The walking stick of embodiment 40, wherein the support post includes the ridge, and the socket includes the guide.

Embodiment 42

The walking stick of any one of embodiment 39-41, wherein the foot replacement mechanism further comprises a thumb detent in the main body portion of the foot, the thumb detent surrounding the latch aperture.

Embodiment 43

The walking stick of any one of embodiments 39-42, wherein a Removal Force to remove the foot from the shaft when the depressible latch is depressed is less than about 25 lbf.

Embodiment 44

The walking stick of embodiment 43, wherein a Removal Force to remove the foot from the shaft when the depressible latch is not depressed is at least about 30 lbf.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. Many modifications and variations of the present disclosure can be made without departing from the spirit and scope thereof. Therefore, the exemplary embodiments described above should not be used to limit the scope of the invention.

What is claimed is:

1. A walking stick comprising:

a handle comprising a head, a neck, and a height adjustment mechanism, the height adjustment mechanism including a pin and a height aperture sized to receive the pin;

a shaft, the shaft including a plurality of height adjustment holes, the plurality of height adjustment holes sized to receive the pin of the height adjustment mechanism;

a friction plug coupled to the shaft, wherein the friction plug longitudinally aligns the shaft with the handle such that a user can longitudinally move the shaft with respect to the handle, wherein the friction plug engages the neck of the handle such that rotational alignment between the height adjustment holes of the shaft and the height aperture of the handle is maintained, and wherein the shaft is rotatable relative to the neck of the handle absent the friction plug; and a foot for engaging the ground, the foot being coupled to the shaft.

2. The walking stick of claim 1, wherein the neck of the handle includes ribs that engage with ribs disposed on the friction plug to prevent rotation of the shaft with respect to the handle when the user longitudinally moves the shaft with respect to the handle.

3. The walking stick of claim 2, wherein the neck includes the height aperture of the handle.

4. The walking stick of claim 3, wherein the height adjustment mechanism further comprises a throat sleeve including a flap coupled to the pin, the throat sleeve being received on the neck in a position near the height aperture.

5. The walking stick of claim 1, wherein the height adjustment mechanism further includes a sliding collar, the sliding collar including a channel that provides a snap fit with the pin when the pin rests in the height aperture and one of the plurality of height adjustment holes of the shaft.

6. The walking stick of claim 1, wherein:

the head and the neck of the handle intersect at an intersection point, the head including an upper portion and a lower portion in the configuration of a C-shape, the upper portion having a first end and the lower portion having a second end, the C-shape being configured such that the second end of the lower portion is disposed laterally outward from the intersection point of the head and the neck of the handle.

7. The walking stick of claim 6, wherein the second end of the lower portion of the head is disposed at least about 20 millimeters away from an outer surface of the neck at the intersection point.

8. The walking stick of claim 6, wherein the first end of the upper portion of the head is disposed laterally further away from a longitudinal axis of the walking stick than is the second end of the lower portion of the head.

9. The walking stick of claim 6, wherein the upper portion includes a boss on an underside of the upper portion of the head.

10. The walking stick of claim 9, wherein there is only one boss on the underside of the upper portion of the head.

11. The walking stick of claim 9, wherein an outer edge of the boss is between about 10 millimeters and about 50 millimeters laterally away from the first end of the upper portion of the head.

12. The walking stick of claim 1, wherein the foot comprises:

a top portion; and a bottom portion, the bottom portion including a base, and at least two arms extending from the top portion towards the bottom portion, each of the at least two arms being coupled together through the base.

13. The walking stick of claim 12, wherein the foot comprises at least three arms extending from the top portion towards the bottom portion, each of the at least three arms being coupled together through the base.

14. The walking stick of claim 12, wherein each of the at least two arms provides a loop between the respective arm, the main body portion, and the base.

15. The walking stick of claim 12, wherein the foot further comprises a main body portion, the main body portion extending from the top portion towards the base.

16. The walking stick of claim 15, wherein the main body portion extends from the top portion to the base of the bottom portion.

17. The walking stick of claim 15, wherein the top portion includes a socket for receiving the shaft.

18. The walking stick of claim 15, wherein the main body portion includes a thumb detent and a latch aperture, and wherein the shaft includes a depressible latch button, the depressible latch button being received in the latch aperture to couple the foot to the shaft.

19. The walking stick of claim 12, wherein the base provides an arcuate bottom surface for the foot.

20. The walking stick of claim 12, wherein the base includes an outer perimeter, the outer perimeter including concave arcs between the at least two arms.

* * * * *